US006789876B2

(12) United States Patent
Barclay et al.

(10) Patent No.: US 6,789,876 B2
(45) Date of Patent: Sep. 14, 2004

(54) CO-OPERATING MECHANICAL SUBASSEMBLIES FOR A SCANNING CARRIAGE, DIGITAL WIDE-FORMAT COLOR INKJET PRINT ENGINE

(76) Inventors: Aaron G. Barclay, 3397 Spring Glen Cir., Prior Lake, MN (US) 55372; Dale G. Nordenstrom, 2844 17th Ter. NW., New Brighton, MN (US) 55112; Daniel L. Jankovich, 5310 Drew Ave. South, Minneapolis, MN (US) 55410; Dennis B. Shell, 7243 40th St. West, Webster, MN (US) 55088; Ivor F. Matz, 3220 Edgemere NE., St. Anthony, MN (US) 55418; John L. Knaack, 11303 Sibley Dr., Burnsville, MN (US) 55337; Kerry R. Anderson, 17353 Faraday Ct., Lakeville, MN (US) 55024; Kevin R. Campion, 15400 Highland Heights Dr., Minnetonka, MN (US) 55345; Larry W. Gonier, 4867 Bryce Ave. E., Inver Grove Heights, MN (US) 55076; Mark E. Olsen, 139th St. W., Savage, MN (US) 55378; Peter E. Malecha, 14175 Bluebird Trail NE., Prior Lake, MN (US) 55375; Peter N. Ladas, 3830 Union Terrace La., Plymouth, MN (US) 55441; Richard J. Bigaoutte, 2362 Manuela Dr., Chaska, MN (US) 55318; Robert A. Schmidt, 4523 Hummingbird Trail NE., Prior Lake, MN (US) 55372; Steven L. Lidke, 300 Pond View La., Chaska, MN (US) 55318; Wade A. Kragtorp, 318 N. Allen St., Madison, WI (US) 53705

( * ) Notice: Subject to any disclaimer, the term of this patent is extended or adjusted under 35 U.S.C. 154(b) by 0 days.

(21) Appl. No.: 10/102,048

(22) Filed: Mar. 20, 2002

(65) Prior Publication Data

US 2003/0007023 A1 Jan. 9, 2003

(Under 37 CFR 1.47)

Related U.S. Application Data

(60) Provisional application No. 60/277,423, filed on Mar. 21, 2001.

(51) Int. Cl.[7] ..... B41J 23/00; B41J 29/38; B41J 29/393; B41J 2/175; B41J 2/01

(52) U.S. Cl. ..... 347/37; 347/19; 347/85; 347/5; 347/86; 347/101; 347/106; 347/107

(58) Field of Search ..... 347/37, 19, 85, 347/86, 5, 101, 106, 107

(56) References Cited

U.S. PATENT DOCUMENTS 4,940,998 A * 7/1990 Asakawa ..... 347/37
4,990,938 A * 2/1991 Brandon et al. ..... 347/37
5,162,179 A * 11/1992 Lewicki et al. ..... 430/15

(List continued on next page.)

*Primary Examiner*—Leonard S Liang
(74) *Attorney, Agent, or Firm*—Carmody & Torrance LLP

(57) ABSTRACT

An improved, large-format digital inkjet print engine that includes a group of co-operating print engine subassemblies that embody various novel elements that both discreetly and cumulatively advance the current art. The group of subassemblies and sensors cooperate to produce high quality graphic images using a plurality of different colors of ink and different types of print media at speeds several times faster than similar conventional inkjet printers. In addition, the use of cooperating elements permit the manufacture of complex, large-format digital color inkjet print engines that are less expensive to fabricated, operated, and serviced. The present invention finds use in large-format digital color printing and imaging, where successful repeatable printing requires precise placement of droplets of ink, toner or other marking material on a print medium such as paper, vinyl, film, or similar substrate.

52 Claims, 31 Drawing Sheets

U.S. PATENT DOCUMENTS 5,285,197 A * 2/1994 Schmidt et al. ..... 345/213
5,469,201 A 11/1995 Erickson et al.
5,587,728 A * 12/1996 Edgar ..... 347/19
5,610,635 A * 3/1997 Murray et al. ..... 347/7
5,696,548 A * 12/1997 Matsui et al. ..... 347/215
5,790,150 A 8/1998 Lidke et al.
5,793,398 A * 8/1998 Hennig ..... 347/88
5,815,171 A * 9/1998 Brugue ..... 347/8
5,833,743 A 11/1998 Elwakil
5,861,899 A * 1/1999 Nguyen et al. ..... 347/40
5,871,292 A * 2/1999 Johnson et al. ..... 400/328
5,872,579 A * 2/1999 Handa et al. ..... 347/8
5,907,343 A * 5/1999 Takemura et al. ..... 347/108
5,969,729 A 10/1999 Erickson et al.
5,992,969 A * 11/1999 Arminana Terrasa et al. . 347/37
6,068,370 A * 5/2000 Miller et al. ..... 347/85
6,091,507 A 7/2000 Vatland et al.
6,164,766 A 12/2000 Erickson
6,213,659 B1 * 4/2001 Elgee ..... 400/633
6,244,688 B1 * 6/2001 Hickman ..... 347/43
6,290,332 B1 9/2001 Crystal et al.
6,308,626 B1 10/2001 Crystal et al.
6,328,415 B1 * 12/2001 Norton et al. ..... 347/37
6,347,857 B1 * 2/2002 Purcell et al. ..... 347/19
6,367,918 B1 * 4/2002 Heiles et al. ..... 347/86
6,386,663 B1 * 5/2002 Olson ..... 347/8
6,394,568 B1 * 5/2002 Menendez ..... 347/8
6,416,165 B1 * 7/2002 Meyer et al. ..... 347/49
6,450,710 B1 * 9/2002 Foster et al. ..... 400/58
6,523,934 B1 * 2/2003 Beauchamp et al. ..... 347/37

* cited by examiner-

CO-OPERATING MECHANICAL SUBASSEMBLIES FOR A SCANNING CARRIAGE, DIGITAL WIDE-FORMAT COLOR INKJET PRINT ENGINE

This application claims the benefit of U.S. Provisional Application No. 60/277,423, filed Mar. 21, 2001.

FIELD OF THE INVENTION

This invention relates to inkjet printers and, more particularly, to an improved large-format digital color inkjet printer including a group of sensors and subassemblies that cooperate to produce high quality graphic images using a plurality of different colors of ink and different types of print media at speeds several times faster than similar conventional inkjet printers. In addition, the use of cooperating elements permit the manufacture of complex, large-format digital color inkjet print engines that are less expensive to fabricated, operated, and serviced. The present invention finds use in large-format digital color printing and imaging, where successful repeatable printing requires precise placement of droplets of ink, toner or other marking material on a print medium such as paper, vinyl, film, or similar substrate.

BACKGROUND OF THE INVENTION

Inkjet printers are well known. Large-format inkjet printers generally move a scanning carriage containing one or more print-head in a transverse or horizontal direction across a print medium, while incrementally advancing—or "stepping"—a print medium in a lengthwise or vertical direction in-between successive printing passes, or scans, of a reciprocating carriage. Inkjet printing involves placing large quantities of tiny ink droplets formed by one or more ink-emitting (or "jetting") nozzles onto predetermined locations on a print medium or substrate. The ink droplets solidify or dry on the print medium forming small dots of color. A quantity of these small colored dots when viewed at a nominal distance will be perceived as a continuous-tone visual image. To increase the rate of print production, a print-head typically employs numerous jetting nozzles per color of ink ganged together in a suitable arrangement to create a band or "swath" of printed area that is much wider than otherwise would be obtainable from a single jetting nozzle. Usually, several linear arrays of jetting nozzles are disposed in a print-head in an orientation parallel to the direction of media travel (X-axis) and perpendicular to the direction of carriage travel (Y-axis). Both text and graphic images may be printed with inkjet printing.

The printed image from an inkjet printer is made up of a grid-like pattern of potential dot locations, called picture elements or "pixels". A pixel generally refers to a coverage area that is defined by the incremental advance accuracy of the media (positioning resolution) of the media drive system along the X-axis, and the maximum number of colored dots the print-head can produce (marking resolution) along the Y-axis. Pixel density is often referred to as print resolution; while pixel density is often the same for both travel axes, this need not be the case for every inkjet printer. Print resolution is often conceived of as a performance measure of an inkjet printer. The print resolution of an inkjet print engine tends to vary as needed for the particular imaging application; hence, the print resolution necessary for printing a billboard, such as are commonly viewed from hundreds of feet away, may be on the order of 6–12 pixels per inch. For many smaller-format documents commonly viewed from 1–6 feet away, the inkjet printing industry has produced printer with a print resolution of between 200 and 2600 pixels per inch (40,000–6,760,00 pixels per square inch) and a maximum media width of 18 inches. While the aforementioned upper range of print resolution may be acceptable for smaller-format documents, such as photo-reproduction or color-matching images, which have an optimum viewing distance of less than 1–8 feet, the use of higher print resolution in large-format devices becomes problematic for a number of reasons.

One reason, which tends to obviate any others, is that employing higher print resolution in larger-format images tends to be counter-productive due to the large amount of image data that must be processed. In digital printing, example, for every doubling of print resolution there is a concomitant quadrupling of the number of required pixels for the same printed area (e.g., 100×100 dpi=10,000 pixels per sq. in.; 200×200 dpi=40,000 pixels per sq. in., etc.). Each pixel requires at least one memory location to represent it: hence, each time print resolution doubles the number of memory locations required to render the same size image quadruples. Data inflation not only affects how much expensive on-line memory is needed to render an image, but also influences various other aspects of printer design and manufacture. For example, higher print resolution requires a fast I/O system to handle the large amount of image data that must be transferred from a rendering device to the print heads, as well as a fast processor and optimized software to quickly render a large image for printing. Higher print resolution also requires large off-line storage devices such as hard-disks and CD-ROM drives to store a rendered image, as well as large data buffers to stage the rendered image data to the print heads. Each of these outcomes tends to increase the cost of manufacture for large-format, graphics-quality inkjet printers.

The problem of data inflation is further exacerbated by the use of process color printing. Inkjet printers generally use one or more of several different types of ink and potential combinations of colors of ink. Color inkjet printers of the prior art typically use the four subtractive primary colors: cyan, magenta, yellow and black ("CYMK"). Color blending of these four ink colors is achieved through two mechanisms. First, the inkjet printer may deposit multiple colors of ink on the same pixel location. Upon combining one or more of the CMYK ink colors at a given pixel location, a particular color combination is formed, either in a dot-on-dot or a dot-next-to-dot pattern. The particular color combination produced by depositing multiple ink colors at a particular pixel location may be affected by the order of printing the various colors, as well as the homogeneity (or lack thereof) of ink mixing. Second, when viewed at a distance, the eye will blend colors from adjacent pixel locations. Thus, for instance, a number of exclusively magenta and yellow colored dots may be laid down in an area of a printed image, with no pixel location receiving two colors of ink. Rather than perceiving individual magenta and yellow dots, the eye will blend the adjacent dots to perceive an orange color. In practice, ink blending at particular pixel locations and perception blending across pixel locations are used to create various colors and shades in a printed image. Usually, a substantial number of the pixel locations in a printed image will be left blank, allowing the perceived visual image to have the correct shades or tones (lightness/darkness values) across the image. Through both forms of color blending, inkjet printers using only four colors of ink can visually reproduce continuous-tone, graphics-quality color images.

However, for every individual color used to render an image, a separate pixel grid—or color plane—must be rendered and staged in either on-line or off-line memory, or both, for transmission to the print-head. Consequently, the amount of memory needed to render and store image data correspondingly increases for each additional color of ink used to print an image. For example, a 36×42-inch image will comprise 1512 square inches of printed area. At a print resolution of 600 dpi, this image area constitutes a pixel grid having 544,320,000 discreet grid locations, or pixels (i.e., 1512×600×600=544,320,000). For each color used to print an image, a separate color plane must be rendered that controls whether a drop of ink of a particular color will—or will not—be deposited at each specific pixel grid location. Thus, to render a CMYK image at 600 DPI requires four separate color planes and generates 2,177,280,000 (c.f, 544,320,000×4=2,177,280,000) bits of total image data. As print resolution increases, or as the number of process colors used to print an image increases, or both, the amount of data needed to represent the image increases accordingly.

Increasing the print resolution for large-format inkjet printers is contra-indicated for other reasons as well. As print resolution increases, either the jetting nozzles in a print-head must fire faster to place the ink drops in a correspondingly smaller and increased number of pixel locations, or the speed of the scanning carriage must be slowed. For example, when print resolution doubles the firing rate of the inkjet print-head also must double, or the scanning speed of the carriage must be halved, to ensure that the print-head has adequate time to precisely deposit a drop of the proper color ink at every predetermined pixel location. Obviously, reducing the scanning speed of the carriage will result in a comparable increase in the amount of time it takes to print an image; put another way, the printer's output speed or rate-of-production will decrease accordingly.

Since users of large-format digital color printers will find any reduction in output speed unacceptable for economic reasons, manufacturers of inkjet print heads tend to increase the firing rate of a print-head commensurately with an increase in print resolution. In addition, increases in print resolution and print-head firing rate usually are accompanied by a decrease in the volume of ink being discharged from the jetting nozzles, since the amount of area in a pixel location is proportionately smaller. For example, a hypothetical 600 DPI print-head with 240 jetting nozzles and a firing rate of 5.6 kHz might discharge an ink drop with a nominal drop volume of 32 nanograms. Doubling the print resolution to 1200 DPI might result in a print-head with 480 jetting nozzles and a firing rate of 11.2 kHz, accompanied by an approximate halving of the nominal drop volume to 18 nanograms.

Clearly, an increase in print resolution dictates a number of requisite characteristics in the design of large-format digital inkjet printers. For example, inks must be formulated that complement both the operating dynamics of the print-head jetting nozzles, as well as the absorptive characteristics of one or more print media. The positioning system of the scanning carriage must be sufficiently accurate and dimensionally stable to precisely deposit a smaller-volume, higher-velocity ink drop in a correspondingly smaller pixel location. The media drive system must be sufficiently exact to more accurately advance a print medium a precise distance between successive reciprocation of the scanning carriage. The printer control electronics must be sufficiently advanced to transmit image data to the print heads as needed to maintain print production without pauses, as well as sophisticated enough to control complex printing operation through the use of sensors and monitoring devices.

The difficulty in effecting any of these requisite characteristics is compounded by challenges inherent in the design of large-format inkjet printers over their small-format counterparts. The deposition of ink droplets in a pixel location must be very carefully controlled over a much larger marking area to create a high-quality image. A related challenge involves the means used to mount and orient the print heads within the carriage to precisely position them relative to each other and to ensure accurate placement of ink drops as the carriage moves across the printed image. Also, large-format printers require a consistent, accurate position-feedback method across a broad expanse of carriage travel to determine when the jetting nozzles should be fired based on the location of the print-head with respect to the printed image. While is it known that accurate positioning of the print-head is key to precise placement of ink drops in a pixel location, this becomes more difficult as the scanning distance (i.e., the width of the print medium) increases and more print heads are used (i.e., the width of the carriage increases). Since the scanning carriage is a reciprocating device, the carriage support structure, or rail, must accommodate a travel margin at each end sufficient to allow the carriage to completely pass over either edge of the print medium. This margin generally is used for "turn-around" space wherein all print heads may pass over the full width of a print medium at the nominal printing velocity, the carriage may then come to a halt, and turn around to begin reciprocal travel. In addition, the rail must adequately support the carriage not only across the entire width of the print medium, but also to accommodate any cleaning, maintenance, or other auxiliary functions that may be required to service the print heads. Therefore, it is common in the art to provide a service zone, commonly called a "maintenance station", away from the print medium where the printer may station the carriage to park the print heads when not in use, or to perform other auxiliary service functions. Service functions may include cleaning and capping of the print heads, replacing print heads and related components, cleaning and adjusting on-carriage sensors, adjusting the height of the print heads relative to a given print medium, adjusting the print-head axial orientations relative to one other, and performing various calibrations of print heads, among others. Therefore, to incorporate a maintenance station or service zone, the rail must support the carriage over a distance greater than the width of the print medium by at least the width of the scanning carriage itself.

The design of a scanning carriage and supporting rail for use in a large-format inkjet printer encounters additional challenges in the form of limitations and instabilities due simply to the length and mass of structural members, the travel distance, and difficulties related to precisely controlling various tolerances in manufacture. Inkjet printers often have problems in aligning and orienting the inkjets that are not easily correctable through mechanical manipulation of the print-head position. These problems are aggravated as the number of print heads increases, as the relative spacing between print heads changes during replacement of the print heads, and as the ink delivery and mechanical placement of print heads becomes more complicated. A known phenomenon called "tolerance stacking" contributes a significant error component in an assembly process wherein at least two precision machining events occur at different times. In the manufacture of a scanning carriage for a large-format inkjet printer, such tolerance stacking may occur at a number of discrete points in the fabrication of related subassemblies. Consequently, machining tolerances specified for various subassemblies, no matter how rigorous, may be either additive or reductive in contributing significant positioning error when arriving at an exact location and orientation of the print heads relative to one another and to the print medium.

Other challenges lie in requisite design elements of the scanning carriage. For example, for large-format printing, a carriage typically must support and precisely orient at least one—and perhaps as many as twelve—inkjet print heads, a portion of the circuitry for controlling multiple print heads, any on-carriage sensors, and apparatus for driving the carriage along the rail in a precisely controlled manner. Moreover, the carriage may support one end of a guide-way or track that contains multiple electrical cables supplying power and signals to the carriage, as well as ink supply tubes supplying ink from off-carriage reservoirs to the print heads. This track applies certain inertial, frictional and/or oscillation forces to carriage motion beyond those inherent in driving the carriage itself. Translational forces may result in vibration problems if the carriage sustains unrestrained movement, causing the print heads to articulate slightly about axes both parallel and perpendicular to the rail, causing the print-head placement with regard to the print medium to be inaccurate. Also, the carriage may shake slightly from side-to-side on the rail in the direction of travel, perhaps due to undamped oscillations communicated from a drive belt and idler apparatus typically used to drive a scanning carriage, as is known in the art. Additionally, carriage position is typically determined by optically sensing indicia from an encoder strip. The encoder indicia are intended to reside at precise intervals along the length of the encoder strip. The optical-sensor produces a signal as the scanning carriage changes location along its travel and the print heads are fired based on the position-feedback data reported. While encoder strips thus may provide means to determine when print heads should be fired, various fabrication errors can occur which prevent the encoder strip indicia from representing exact intervals corresponding to a precise position for firing an inkjet nozzle over a pixel location.

Yet further challenges lie in the means employed for incrementally transporting a print medium during successive passes of the scanning carriage during printing operation. Ideally, inkjet printing is accomplished using vertically aligned jetting nozzles (i.e., parallel to the X-axis), with each nozzle positioned a pixel-interval below a preceding nozzle. In fact, inkjet print heads typically employ numerous jetting nozzles per color in this configuration to facilitate printing in a band of printed area per pass of the scanning carriage, as previously described. Unfortunately, this configuration often predicates what is known in the art as "banding", a pernicious printing irregularity or artifact that is common to inkjet print engines in general, and large-format printers in particular.

One type of banding artifact occurs if the media drive system is not extremely accurate, such that the print medium is advanced slightly more or slightly less than the width of the print-head "swath" or printed band (i.e., the vertical extent of the line of jetting nozzles). If the print medium is advanced slightly too far, a perceptible blank area will occur in the printed pattern at the end of each advance, between two successive print swaths. On the other hand, if the print medium advance is too short, a perceptible darker area will occur in the color pattern at the beginning of each advance, where adjoining print swaths overlap slightly. Banding that occurs due to media advance inaccuracies often is related to variations in the type of media used. Different media types have different handling characteristics and will react to exposure to heat, ink, and tensioning forces in a variety of different ways. Variations in the thickness and stiffness of two different print media often will result in different feed rates through the printer. For example, as known in the art, a print medium typically is advanced through the printer by a drive motor that rotates one or more drive wheels in contact with the medium at a pinch point, or nip. The printing medium typically is forced against the drive wheel by a pinch-roller, or other suitable mechanism. The pinch-roller typically is formed from—or has deposited on its outer surface—a hard rubber material, while the drive wheel typically is formed from—or has deposited on its outer surface—a rough material, such as grit, suitable for gripping and advancing the medium. Depending upon the thickness, stiffness, frictional coefficient of the paper, and the force exerted by the pinch-roller on the print medium, the rubber surface of the drive wheel is deflected by varying amounts. This deflection phenomenon results in a slight increase in throughput speed of the print medium, due to differential compression forces applied to the print medium and the drive wheel from the pinch-roller. Consequently, the distance that the drive wheel advances any given print medium for any given number of rotations of the drive wheel may vary, resulting in different rates of advance for two different print media. Another type of banding artifact may be caused by differences in the tension of the print medium. In particular, the accuracy of print media advance is influenced by the differential tension across the nip-point. That is, the difference between the tension in the print medium on the supply side and the take-up side of the nip-point affects the rate at which the print medium is advanced by the drive rollers. If the differential tension across the nip-point continuously changes during printing operation, the rate of advancement of the printing medium will also continuously change.

Various methods have been attempted to compensate for the above-cited banding problems. One such method is referred to as "multi-pass" printing. In multi-pass printing, the print medium is advanced at a fractional increment of the print-head footprint, or print swath, such that two or more jets of the same color pass over any given pixel row in sequential passes of the scanning carriage. The first jet prints only a portion of the colored dots on that particular pixel row, with remaining dots on the pixel row printed on subsequent passes. Multi-pass printing tends to mask banding artifacts that result from small media advance inaccuracies such that they are not easy to perceive in the printed image. However, multi-pass printing also significantly increases the time it takes to print an image, resulting in a decrease in output speed.

In actual practice of the art such considerations are fundamental. Any of the foregoing inherent design challenges in the manufacture of large-format inkjet printers may produce printing errors and artifacts, including banding, which tend to be exacerbated as the speed of printing, the size of output, the number of print heads, or the print resolution are increased. It follows, then, that a significant increase in print resolution will tend to amplify or magnify even small inaccuracies, variances, or flaws in critical components and assemblies, which will evidence directly as artifacts in the printed image. In effect, the printed image itself becomes a measure of printer performance and proves the inadequacy of existing solutions to meet the new threshold of performance.

Moreover, an increase in print resolution tends to exclude design solutions embodied in the prior art for the same reasons. High speed, large-format inkjet printing requires a high degree of accuracy to generate graphics-quality images.

As a general rule, the cost of manufacture increases as the design tolerances of mechanical systems increase (i.e., demand for accuracy or precision in the fabrication of components and assemblies). Large-format inkjet printers are no exception. In sum, various systemic limitations of design—both individually and in concert—may impede the successful translation of increased print resolution to image quality in a large-format print engine. Hence, the limit of print resolution is not simply what can be achieved in fabrication of a print-head, but instead may also include the resolution needed to render acceptable print quality for the image desired at a sustainable cost of manufacture.

Print resolution in the prior art generally has been understood as beneficial in rendering fine detail in a printed image. However, in printing large-format images, fine detail tends to be enlarged proportionately along with gross detail. Since the human eye is incapable of distinguishing between higher print resolutions (e.g. 600 dpi and above) at distances of more than a few feet (e.g., 10 feet or more), there is little benefit in using a higher print resolution merely to improve the quality of fine detail. Consequently, there must be other relevant purposes in increasing print resolution, such as improving the visual quality of the printed image or increasing the print speed of a print engine.

One means to improve image quality using increased print resolution lies in replicating the tonal variations of a continuous-tone source image. It is well known in the art that tonal variations of a source image may be replicated by approximating the tonal values with corresponding shades or densities—lightness/darkness values—in the printed image. It is less well known that tonal variations in a source image also may be replicated, or enhanced, using relative variations in hue in the printed image. This method of replicating a continuous-tone image results in higher-quality output, since the printed image is more pleasing to the eye. However, this methodology generally requires an extended set of process ink colors, beyond the standard set of CMYK colors. One such extended set of process colors current in the art includes light and medium hues of cyan and magenta inks, effecting an eight-color set (i.e., cyan, magenta, yellow, black, light-cyan, medium-cyan, light-magenta, medium-magenta). Another extended set of process colors current in the art includes red, orange, green and blue inks, effecting a twelve-color set (i.e., cyan, magenta, yellow, black, light-cyan, medium-cyan, light-magenta, medium-magenta, red, orange, green, blue). Either of these extended ink sets will allow replicating tonal variations of a continuous-tone source image using hue values, as opposed to (or in addition to) the use of density values, in a printed image. A related benefit of using an extended set of process ink colors is to extend the color gamut that can be produced by the inkjet printer to more closely approximate that of the source image.

Increased print resolution also enables an increased number of colored dots to be applied to a pixel location in creating a given color or hue, thereby allowing a wider range of hues to be used in replicating a range of tonal values. Obviously, to exploit an increase in print resolution to produce high-quality graphic images in this way requires a scanning carriage that can accommodate an entire set of extended process ink colors (i.e., multiple print heads) simultaneously. Additionally, the printer control system for an inkjet printer of this kind must be capable handling the large amounts of image data that must be transmitted to the print heads, since each pixel location will be represented in as many as 12 different color planes. Further, it is desirable that the printer control system is able to sense or monitor hue values and effect means to automatically effect color-metric adjustments to ensure those tonal values of the source image are consistently reproduced.

It is known that different print media will produce variations in color hues when used with a given set of process inks. Color variations between different media may be due to differences in the physical and chemical interactions between the inks and the print medium, such as the composition of substrates or coatings, the porosity of the medium, or environmental conditions such as the relative humidity. While variations in color may be considered negligible in some applications, in the production of large-format graphics quality images even minor color variations are unacceptable. For this reason, it is desirable to precisely control many of the print engine's operating parameters, as well as to fully characterize the print medium and the ink, to enable accurate reproduction of a desired image. Because differences in ink colors are easily detectable and provide ready demarcation points relative to the individual print heads, it is common to calibrate the print-head position using test patterns printed in the corresponding ink colors. For example, a test pattern may be printed from each of the print heads and compared to determine the degree to which each is positioned correctly relative to one another. The printer control system may then compensate for unaligned jets or inaccuracies in print-head position by adjusting the timing signals that control when the jetting nozzles are fired, based on the print-head location with respect to the pixel location. Similar tests may be used to confirm that a threshold of functioning nozzles is met for each print-head and that combinations of ink colors applied to a given print medium accurately replicate a desired color. Horizontal travel and vertical advance accuracy can be tested and calibrated in a similar ways.

Because calibrating a printer's actual operating parameters is an important part of producing high-quality images, operators spend significant time performing the various calibration routines. In response, the inkjet printing industry continually seeks new and better ways to readily determine what calibration adjustments are needed. It is therefore desirable that any of these functions could be performed automatically by the printer control system, without requiring intervention by an operator.

A second relevant factor for increased print resolution is increased print speed. Here again, the use of a scanning carriage that employs multiple print heads finds application. Multiple print-head locations in a scanning carriage will permit the use of multiple ink sets of the same color in printing an image. For example, a scanning carriage with twelve print-head locations could accommodate three sets of CMYK inks, or two sets of hexachrome inks (e.g., CMYKOG). Accordingly, in a multi-pass inkjet printer the same area can be printed using fewer passes of the carriage, since more jetting nozzles of the same color ink will pass over a given pixel location. However, since more jetting nozzles are being used at an increased firing rate, ink will be applied very quickly and the jetting nozzles will age and fail at a faster rate. These effects are attributable to rapid fatiguing of the mechanical and electrical elements of the jetting nozzles, which causes drop volume and placement accuracy to degrade over time.

Aging and failure of the jetting nozzles manifests in the printed image as colored dots that are deposited out-of-position (misfiring jets), or are simply missing altogether, and in the print irregularities or artifacts that thereby result. It is known that multi-pass printers are able to disguise the failure of a nominal percentage of jetting nozzles, since two or more jets pass over any given pixel location. To extend the useful life of a print-head, it is also known that operating jets may be substituted for failed ones in a multi-pass print mode. Further, multi-pass printing allows an operator to select a print control parameter of an inkjet printer whereby the number of scans or passes of the carriage may be increased by some integer as the percentage of jetting nozzle failures increases. While multi-pass printing is an efficient means of counter-acting degradation of image quality due to print-head aging, the improvement in print quality is bought at the price of print speed. A related problem is that nozzle failure tends to increase very rapidly after a certain point is reached in print-head service life. Since only a fraction of the total number of jetting nozzles need fail before the print-head is rendered unserviceable, this phenomenon makes it more difficult to run an inkjet printer in unattended operation, such as overnight, since a failed print-head can result in unusable printed output. Therefore, in applying print heads with increased print resolution to accelerate print speed, it is desirable that print heads may be replaced quickly and easily. It is also desirable that the printer control system be able to sense when a certain number of nozzle failures has occurred and automatically effect a remediating action in response.

It is known in the art that a plurality of disposable inkjet print cartridges may be used in a scanning carriage. Disposable print cartridges typically contain a print-head and a supply of ink contained within the cartridge and are not designed to be refilled; that is, when the internal ink supply is exhausted, the print cartridge generally is thrown away and a replacement cartridge installed in its place. This waste of resources is unacceptable in the design of large-format inkjet printers, since frequent replacement of the print cartridges will result in high operating costs and since a print cartridge generally has a greater useful life well beyond that needed to exhaust its internal ink supply. Because increasing the ink supply of the print cartridge would increase the total weight of the carriage, it is known to use a set of off-carriage ink reservoirs to provide a continuous supply of replenishing ink to the inkjet print cartridges resident in the carriage. A tube hermetically connected extends from each off-carriage ink reservoir to a print cartridge of the same ink color residing in the carriage, thereby establishing fluid communication between the two components. In the art, the ink supply system and inkjet print cartridge generally are removed and replaced together. In application of a disposable inkjet print cartridge with increased resolution to an inkjet printer with higher print speed, it is desirable that an ink supply system be reliable enough to sustain uninterrupted delivery of replenishing ink on-demand, yet flexible enough to ensure rapid replacement of print heads and related components.

While the type and number of inkjet print cartridges available for use in the design of large-format inkjet printers has increased, so has the complexity of controlling interactions among the various inks, print cartridges, print media, and related elements. As print-head resolution increases and the service life of the jetting nozzles improves, limitations have arisen in the efficacy of prior art mechanisms and apparatus for fully exploiting the benefits that may be derived therefrom. In general, prior art inkjet printers are not designed for rapid and efficient in-field replacement of critical subassemblies and components requiring limited operator intervention and a minimum loss of production. In fact, due to the obvious competing design objectives of mechanical positioning accuracy and field replacement convenience, little has been accomplished in this regard. Likewise, little has been accomplished in automating the many required service routines for effective use of prior art printers, which would result in reduced print engine downtime, fewer service interventions, and more efficient repairs—thereby reducing the overall cost of ownership of print engines of this kind. At the same time, continuing demand for reduced cost of ownership and ease of serviceability continues to inspire innovation in the art. Thus, a continuing need exists for a low-cost, large-format digital color inkjet printer that satisfies most or all of the deficiencies now current in the art, while at the same time providing a technically advanced means for producing high quality, large-format digital color images.

SUMMARY OF THE INVENTION

This invention relates to inkjet printers, and, more particularly, to a co-operating group of sensors and subassemblies that address numerous problems of prior art printers discovered in the design of large-format, graphics quality, digital color inkjet printers that use disposable print cartridges mounted in a scanning carriage. The inkjet printer of the present invention features a group of co-operating sensors, controls and subassemblies that exploit recent advances in the art as embodied in a preferred disposable inkjet print cartridge. The preferred inkjet print cartridge more than doubles the number of ink-emitting jet nozzles, trebles the jetting nozzle firing rate, increases the print-head longevity by several times, and doubles the marking footprint of prior art disposable inkjet print cartridges.

The use of co-operating sensors and subassemblies in a print engine permits the manufacture of an advanced, large-format inkjet print engine that more fully exploits the benefits and advantages inherent in the preferred high-resolution print cartridge, but still may be inexpensively fabricated, operated and serviced. The problems inherent in implementing an inkjet print cartridge having a higher print resolution and a faster firing rate are addressed by dealing with error components across a range of mechanical systems, as opposed to isolating a preponderance of error components within a few expensive machine elements. One advantage of this approach lies in the economic benefit to the ultimate end user of large-format inkjet printers. For example, one difficulty in producing high quality printed images in large-format printers using higher resolution inkjet print-heads, or faster print-heads, lies in precisely positioning the ink-emitting nozzles relative to each other and to the print medium. It lies within the realm of good engineering practice to design an apparatus—such as a penholder—which adheres to very strict design tolerances in fabrication thus ensuring that the cartridge print-head position approaches some ideal. However, this is likely an expensive solution and one not likely to be adaptable to technical advances.

A better approach lies in using both design tolerances and control system software to accomplish an effective countermeasure that is more adaptable and less costly. The co-operating subassemblies of the present invention include an auto-adjusting head-height apparatus, a modular off-carriage ink supply, an auto-adjusting service station, a reliable and efficient media-handling system, an accurate media-drive system, and a sophisticated printing control system that individually and cumulatively provide improvements over the prior art. Together with various sensors and controls, these co-operating subassemblies enable sophisticated monitoring and precise control of various critical printing parameters. These elements cooperate to produce an inkjet print engine that can print high quality, large-format graphic images using up to 12 different colors of ink and different types of print media up to ¼-inch thick at speeds several times faster than similar print engines now current in the art. Moreover, the present invention incorporates a number of novel design features that augment its usefulness and operating simplicity, such as a rotating penholder that facilitates service of the preferred inkjet print cartridges and a compliant service station module that automatically accommodates variations in carriage head-height position without requiring operator intervention. Accordingly, inkjet printers of the present invention may be produced in large numbers, at reduced cost of manufacture, making ownership less expensive and operation easier to perform.

The present invention finds use in the large-format digital color inkjet printing industry, where successful repeatable replication of source images requires precise placement of droplets of ink or other marking material on a print medium such as paper, vinyl, film, or coated substrate. In one embodiment, the inkjet printer of the present invention is an improved, large-format, multipass, digital color inkjet printer capable of handling media widths up to 72 inches wide at a minimum print resolution of 600 dots-per-inch. In an alternate embodiment, the inkjet printer of the present invention has a resolution of 1200 dots-per-inch.

The scanning carriage assembly is equipped with an automatic head-height adjusting apparatus that supports the preferred inkjet print cartridges in close proximity to any of several different types of print media up to ¼-inch thick including paper, vinyl and fabric. The head-height adjusting apparatus operatively couples a moveable penholder to a sliding trolley plate via two axial drive-screws driven by servomotors under control of the printer control system. The trolley plate and attached penholder is supported on a rail member via a plurality of trolley wheels that engage the rail along a plurality of parallel linear datum structures that permit travel along the X-axis for the scanning carriage to fully traverse a print medium. The servomotors drive the axial drive-screws that operatively engage structural members fixed to the penholder to precisely control the vertical position thereof along the Z-axis in response to position signals transmitted from the printer control system. The printer control system calculates optimum head-height position based on an analog control signal received from a media thickness sensor mounted on the rail that indicates the thickness of media currently loaded in the print engine. An on-carriage image sensor provides means to automatically measure and compensate for print-head position inaccuracy, inkjet nozzle failure, and chromatic variation in the printed image quality.

The scanning carriage preferably includes a penholder that supports as many as twelve preferred inkjet print cartridges at one time to maximize image quality and output speed. The preferred penholder provides mounting locations to precisely position the preferred inkjet print cartridges relative to each other. The preferred penholder also rotates through a travel range of about 85 degrees to allow an operator ready access to the inkjet print cartridges for cleaning, maintenance, or service operations without having to remove and reinstall the print cartridge, or recalibrate the print head position. Structural features formed at each end of the penholder provide means to avoid head-strike conditions due to differences in media thickness, low ambient humidity (causing media curl), and similar conditions. It should be noted that twelve cartridges presents a limitation only insofar as this value currently represents the largest number of process ink colors that can be efficaciously combined to produce large-format color prints. If the technology of process color blending were sufficiently advanced to merit the use of additional print cartridges beyond twelve, the preferred print engine of the present invention would be able to accommodate those colors as well.

The off-carriage ink delivery system includes a modular system including a set of independently replaceable components for each different color of ink. The modular set of components includes an on-carriage inkjet print cartridge, an off-carriage ink reservoir, and an interconnecting tube with fluid connectors and check valves, each of which may be installed and removed, either together or independently, by an operator of the inkjet print engine instant. The preferred inkjet print cartridge includes a print-head, an internal cavity containing a first quantity of ink which directly provisions the print-head and the ink-emitting jet nozzles thereof, and an inlet port for receiving a replenishing supply of ink from the off-carriage ink reservoir via the interconnecting ink supply tube. The off-carriage ink reservoir includes sufficient ink to completely replenish the first quantity of ink within the inkjet print cartridge multiple times, thereby maximizing the service life of the print-head and optimizing the delivery of ink to the print cartridge to assist uninterrupted printing of large-format graphic images. The ink supply tube is equipped with quick-release, fluid connectors with check valves at each end permitting rapid interconnection of the inkjet print cartridge and ink reservoir. This modular system design enables an operator to quickly replace individual components as needed due to aging or failure, as well as an entire set of components when different printing needs arise, such as, for example, when switching between indoor dye-based inks and outdoor pigment-based inks.

The modular service station is equipped with automatic means of adjustment, being suspended on spring-loaded cam rollers that automatically adjust the elevation of the service module to compensate for variations in carriage head-height position. The cam rollers also articulate the service module through a complex travel path defined by structural datum integral to the platen and station it through a series of four distinct operating locations. The scanning carriage visits the service station at intervals under direction of the printer control electronics and drives the service station module along its travel path to its operating locations. The service module performs wiping and capping service routines while maintaining optimum spacing between the inkjet print cartridge disposed in the penholder assembly and the wiper blades and capping boots located on the module. The modular construction embodies a reliable but inexpensive field-replaceable unit that enables an operator to quickly replace it as needed due to aging or failure.

The print medium handling system functions to transport the print medium through the printer. The printing medium handling system includes tensioning means to maintain a constant back-tension in the media web from the supply side of the nip-point as the print medium is incrementally advanced past the print heads. The media handling system includes a sensor that gauges the thickness of a media currently loaded in the printer and communicates thickness data to the printer control system. The printer control system uses the thickness data to control the incremental advance of the print medium in-between successive passes of the scanning carriage. It also uses the thickness data to perform automatic adjustment of the carriage head-height position. The media handling system increases the number of nip-points (e.g., roller pairs) across the media web over prior art printers as one means to mitigate positioning inaccuracy due to deflection phenomenon. A plurality of hard aluminum drive wheels are coated at the tread surface with tungstencarbide alloy applied using a high granularity heat-sputtering process to provide a "gritted" tread surface, which further reduces deflection phenomenon. A closed-loop servomotor and encoder with quadrate-readout drives a media take-up spool and monitors the take-up roll diameter to control tension, detect faults, and signal failure.

The media drive system accurately transports and precisely positions a print medium within a print zone and optimizes the response time of a media drive train to effect accurate media advance within a limited operational window. A servomotor and reduction gearing generate the low-end torque required to overcome inertial and frictional forces presented by the media handling system that resist a rapid response time. The media drive system accommodates the longer incremental media advance predicated by the greater number of jetting nozzles disposed in the preferred higher-resolution inkjet print cartridge. At the same time, the system optimizes media advance accuracy through the use of a quadrate-readout encoder providing a granularity of about 0.00002-inch. Periodic error of the media drive train is mapped and stored as a look-up table in a non-volatile memory, enabling the printer control electronics to compensate for predicted error by referencing an error map. The media drive system delivers media advance accuracy to about 0.0001 inch for print media up to about ¼-inch thick. This advance accuracy matches or exceeds that of prior art print engines, at a similar cost-of-manufacture and accommodates the much faster print speeds and higher ink laydown rates required by the preferred high-resolution inkjet print cartridge.

The printer control system preferably employs two electronics subassemblies: the first, disposed in an off-carriage electronics bay, runs the operating system software and performs all I/O, housekeeping and print engine control functions. The second, disposed on-carriage the carriage assembly, performs data management and control operations related to transmitting image data to the print heads. The off-carriage printer control electronics connect to the media thickness sensor, a low-cost high resolution apparatus that includes a potentiometer and moment arm that sense the presence of media and can measure its thickness to a precision of about 0.0001-inch. The printer control system is responsive to analog signals generated from the media thickness sensor, as well as periodicity error data stored in its memory. The printer control system references this data to regulate the media handling system such that a print medium is accurately advanced under a constant tension for each type of media used. Media thickness data is also used to set the head-height position of the carriage penholder. The off-carriage printer control electronics stores information about the media type, roll length and media thickness in non-volatile, on-carriage memory and monitors the print medium remaining on the supply roll. It uses the stored data to calculate and record the media type and amount of media remaining on an unused portion of the roll, as well as to notify the operator of an inadequate supply for a requested print job. It also automatically recalls the media advance and head-height settings for future use, such as when any similar type of media is loaded into the printer or for reference by an operator. The printer control electronics also performs a series of checks, to detect any deficiencies in printed output, and as series of calibrations, to compensate for deficiencies that might evidence as irregularities or artifacts in the printed image. A series of different test images—such as registration targets and color charts—are printed on a preselected print medium.

The improved image sensor assembly on-board the scanning carriage captures and transmits information about the test images to the printer control electronics. This information is used to perform a series of calibrations to compensate for various conditions, including misfiring and failed jets, print-head misalignment, inconsistency in the interval spacing of encoder strip indicia, variation in dot placement accuracy for pixel locations serviced by different jetting nozzles, media advance inaccuracy, and changes in color consistency. Each of these checks and compensatory calibrations can be performed on-demand by an operator or at a scheduled interval chosen by an operator. In addition, the image sensor is capable of performing some tests and checks during printing operation, providing means for the printer control electronics to continually monitor print quality and automatically compensate for deficiencies as quickly as they are detected. This capability, in turn, provides a welcome benefit of greater latitude in performing unattended printing, since operators may have greater confidence in the quality of printed output therefrom. The image sensor is equipped with a fast, chromatically tuned (c.f. sensitive to the visible light spectra) photodiode that performs color-metric measurement of test color charts. The printer control electronics uses the color measurement data to compensate for changes in color consistency that may occur, for example, as print heads age over time and the jetting nozzles therein become worn or fatigued. These conditions cause variations in the volume of ink that is emitted from a jetting nozzle and/or the response time of a nozzle to a fire pulse that evidence as changes in color hue. Other causes of inconsistent color might relate to differences between print media of the same type caused by small variations in coating chemistry and porosity, changes in relative humidity, and so forth. The use of a fast photodiode enables the image sensor to automatically perform color-metric quality tests and undertake compensatory action for color variations from a norm or due to inconsistency. Additionally, the image sensor can be used to characterize the interaction of a particular set of process ink colors with a particular media, since the photodiode is an accurate measurement tool of chromatic constituents. This capability, in turn, allows rapid and efficiency characterization of new types of media installed in the printer, without requiring recourse to an external color-metric device or apparatus.

In summation, the improved inkjet printer taught herein incorporates a number of novel design features that augment its usefulness and operating simplicity resulting in significant advantages overall. Several of the key benefits of the present invention include eliminating critical adjustments in the field, performing automatic monitoring of—and compensation for—printing deficiencies, efficient replacement of marking system components, and rapid changeover between different sets of inks or ink types. Each of these benefits reduces the level of operator intervention required to make efficient use of the inkjet print instant. The present invention achieves these goals so that advanced, large-format digital color printers may be reliably and simply fabricated, operated and serviced—and thereby produced in high volumes at reduced cost of ownership and making such machines less expensive overall.

Other features of the invention are described below.

BRIEF DESCRIPTION OF DRAWINGS

The above mentioned features of the preferred embodiments of the present invention and the manner of attaining them will become apparent, and the invention itself will be best understood by reference to the following description of the embodiments of the invention in conjunction with the accompanying drawings, wherein.

DETAILED DESCRIPTION OF THE PREFERRED EMBODIMENTS

Figure 1A:
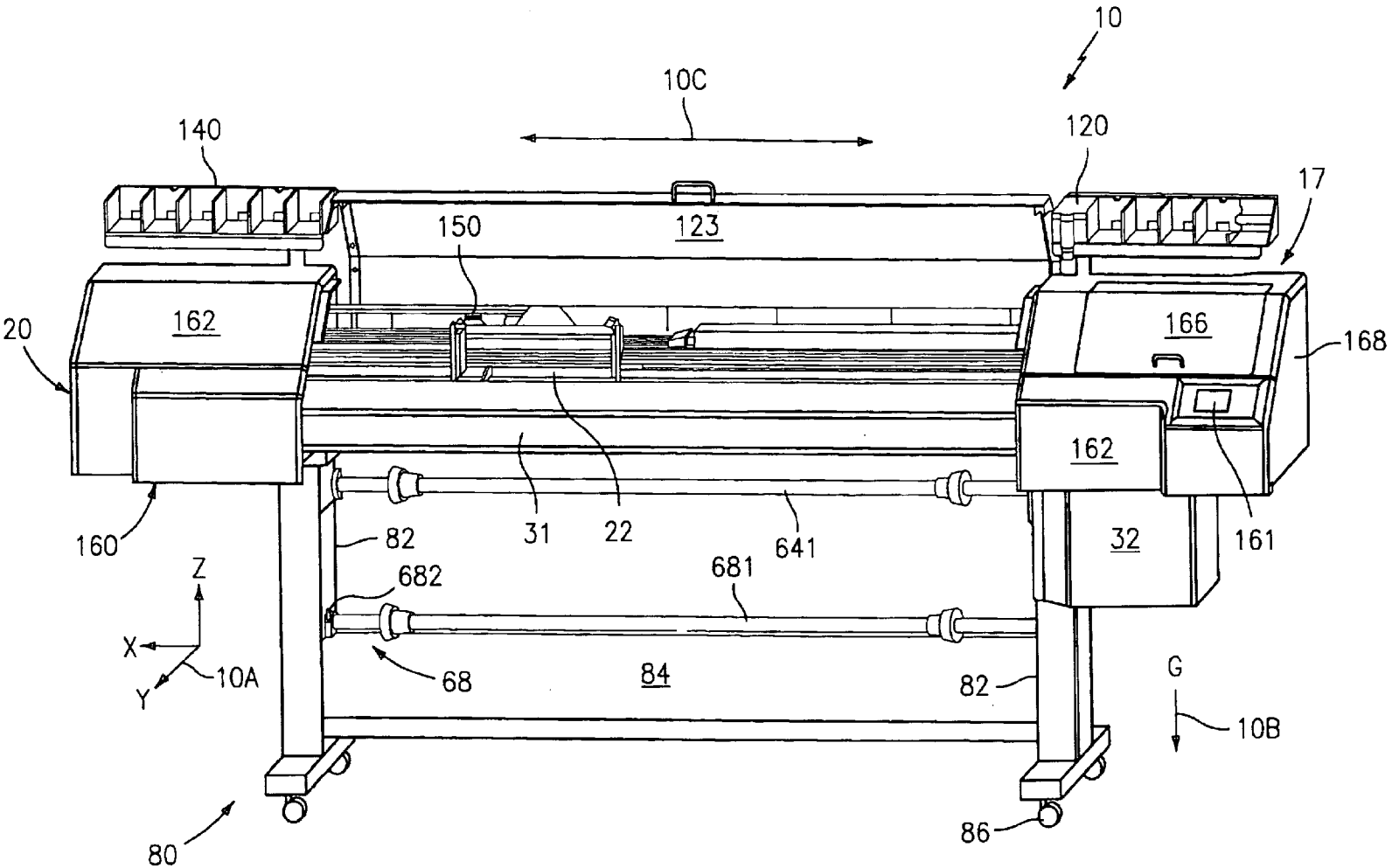
FIG. 1A is a front perspective view of a preferred embodiment of an inkjet print engine 10 depicting major assemblies, subassemblies and components including the printer, stand, carriage, ink delivery system, printing control system, and enclosures.

The reader is encourage to cross reference and review the present specification along with a number of U.S. Patents, commonly assigned to MacDermid-ColorSpan Corporation of Billerica, Mass., USA—the contents of each such application is hereby incorporated by reference in its entirety herein. These applications include the following issued U.S. Patents: U.S. Pat. No. 6,467,867 entitled "Method and Apparatus for Registration and Color Fidelity Control in a Multihead Digital Color Print Engine"; U.S. Pat. No. 6,308,626 entitled "Improved Convertible Media Dryer for a Large Format Inkjet Print Engine": U.S. Pat. No. 6,290,332 entitled "Improved Carriage Assembly for a Large Format Inkjet Print Engine": U.S. Pat. No. 6,164,766 entitled "Automatic Ink Refill System for Disposable Inkjet Cartridges"; U.S. Pat. No. 6,091,507 entitled "Method and Apparatus for Printing a Document Over a Network"; U.S. Pat. No. 5,969,729 entitled "Inkjet Printer with Artifact-reducing Drive Circuit"; U.S. Pat. No. 5,833,743 entitled "Method of Selecting an Ink Set of an Inkjet Printer"; U.S. Pat. No. 5,790,150 entitled "Method for Controlling an Inkjet Printer in a Multi-pass Printing Mode"; and U.S. Pat. No. 5,469,201 entitled "Ink Supply Line Support System for a Continuous Ink Refill System for Disposable Inkjet Cartridges". Additionally, the following U.S. patent applications are herein incorporated by reference: Ser. No. 09/252,376 entitled "Method and Apparatus for Automatically Validating Nozzle Performance in an Ink Jet Print Engine"; and Ser. No. 09/251,532 entitled "Unitary Service Station for Cleaning and Capping Inkjet Pens" all of which are commonly assigned to the present assignee.

Overview of Preferred Printer Embodiments

The present invention shall be generally described with reference to several currently preferred embodiments of the invention. The reader is invited to refer to the figures appended hereto, and the detailed descriptions that follow, although the following description fairly describes the novel features of the present invention, which is easily apprehended after review of the figures and this detailed description.

The important novel aspects of the present invention include: 1) A modular, flexible gravity-feed ink delivery system that provides continuous ink supply from an off-head ink reservoir to an inkjet print cartridge. 2) A scanning carriage assembly that partially rotates about an X-axis to provide an operator ready access for maintenance and service of an inkjet print cartridge (e.g., cleaning, priming, connecting and routing ink supply tubes, etc.) without requiring removal, replacement and positional re-calibration of the inkjet print cartridge. 3) A penholder assembly that supports three orthogonal banks of four staggered sockets in a close-packed configuration that enables the use of inexpensive metal extrusions in the fabrication of large-format rails and platens. 4) An on-head 640×480 pixel CMOS image sensor with a low-distortion, optical-quality lenses that detects unaligned and failed jetting nozzles and enables on-the-fly substitution of jetting nozzles. 5) An on-head color sensor that employs a chromatically tuned, fast photodiode to measure the color-metric performance of printed inks, thereby to perform automatic color calibration and generation of color profiles for print media (i.e., color characterization of new ink/media combinations). 6) A low-cost, high-resolution sensor for measuring media thickness thereby to enable automatic adjustment of the carriage head-height position for different media types. 7) An automatic head-height adjustment apparatus driven by servomotors and controlled by a printing control system in response to data provided by the media thickness sensor. 8) A service station assembly module that automatically adjusts for variations in carriage head-height position. 9) A high-performance, low-cost media drive system that reliably and accurately advances a print medium to accommodate high resolution printing of 1200 dpi or more; 10) A high-performance, low-cost media tensioning apparatus that provides more accurate media positioning with less potential for printing irregularities. 11) A media take-up apparatus that incorporates a closed-loop servomotor to accommodate larger accumulations of printed media on a storage roll without requiring a torque adjustment means. 12) A printing control system that incorporates advanced data compression and CAT5 LVDS (Low Voltage Differential Signal) data interface cables to accommodate the large quantities of image data necessary to service the increased resolution of the preferred inkjet print cartridge. 13) A method to identify a media type and a quantity of media available on a remaining portion of a partially used media roll that allows a print engine to print machine-readable information for later retrieval using a read-head. 14) A versatile print engine with mechanical, electrical and software control systems and assemblies adaptable to accommodate the use of either a preferred lower resolution 600 dpi inkjet print cartridges or a preferred higher resolution 1200 dpi cartridges.

Figure 1B:
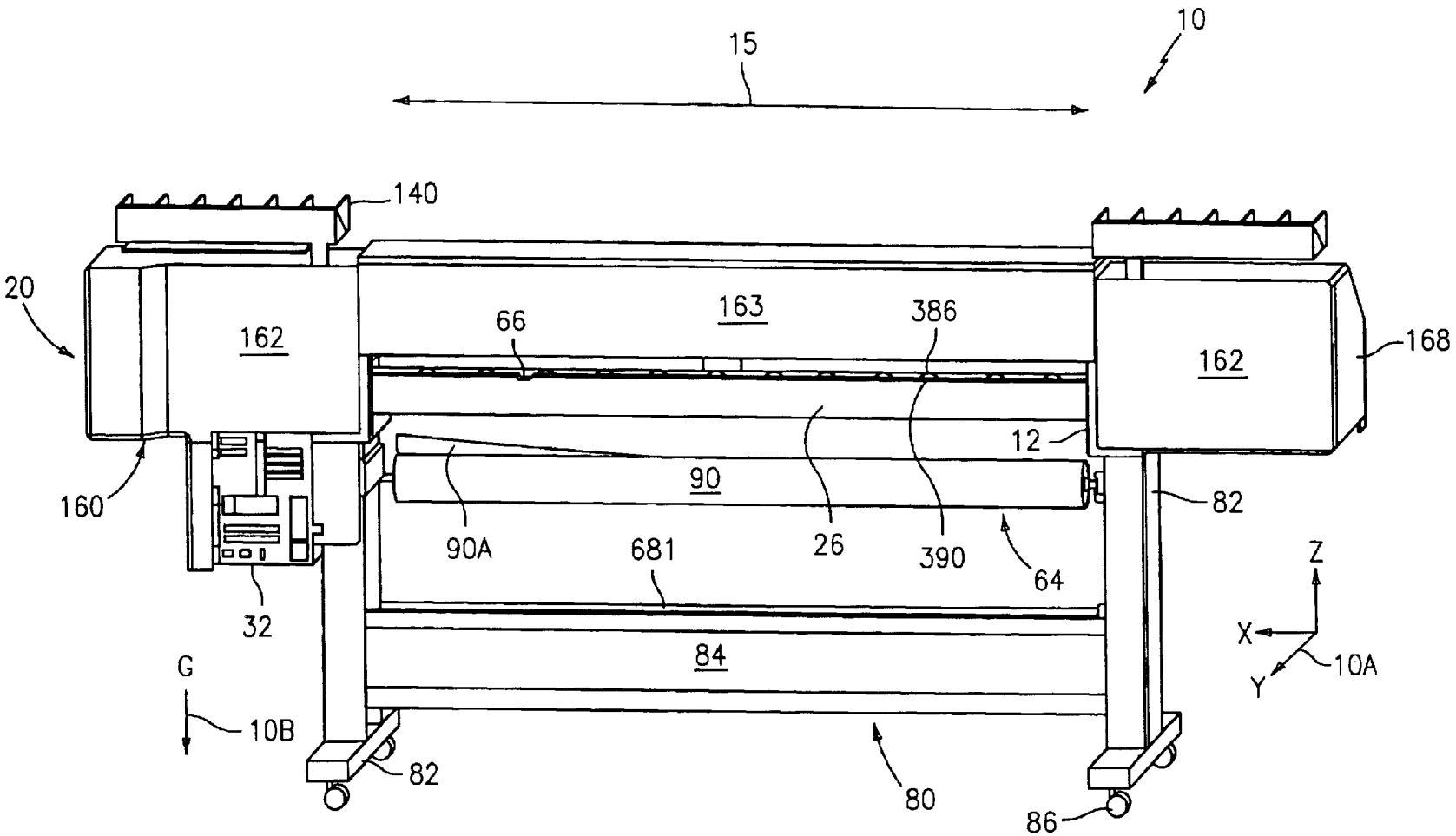
FIG. 1B is a rear perspective view of the inkjet print engine 10 of FIG. 1A including media spools, a media roll, and media roll and media thickness sensor.

FIG. 1A depicts an overall front perspective view of a preferred embodiment of print engine 10. Print engine 10 is preferably a large-format inkjet printer capable of printing high-quality, continuous-tone graphic images on 72-inch wide roll-feed media at a first preferred resolution of 600 dpi and an alternate preferred resolution of 1200 dpi. FIG. 1B is a rear perspective view of the same print engine 10 of the preferred embodiment. Print engine 10 includes various subordinate systems, assemblies and materials that include printer assembly 20, media dryer assembly 30, ink delivery system 40, media handling system 60, stand assembly 80, media roll 90, print cartridge 100 and enclosure assembly 160.

Figure 2:
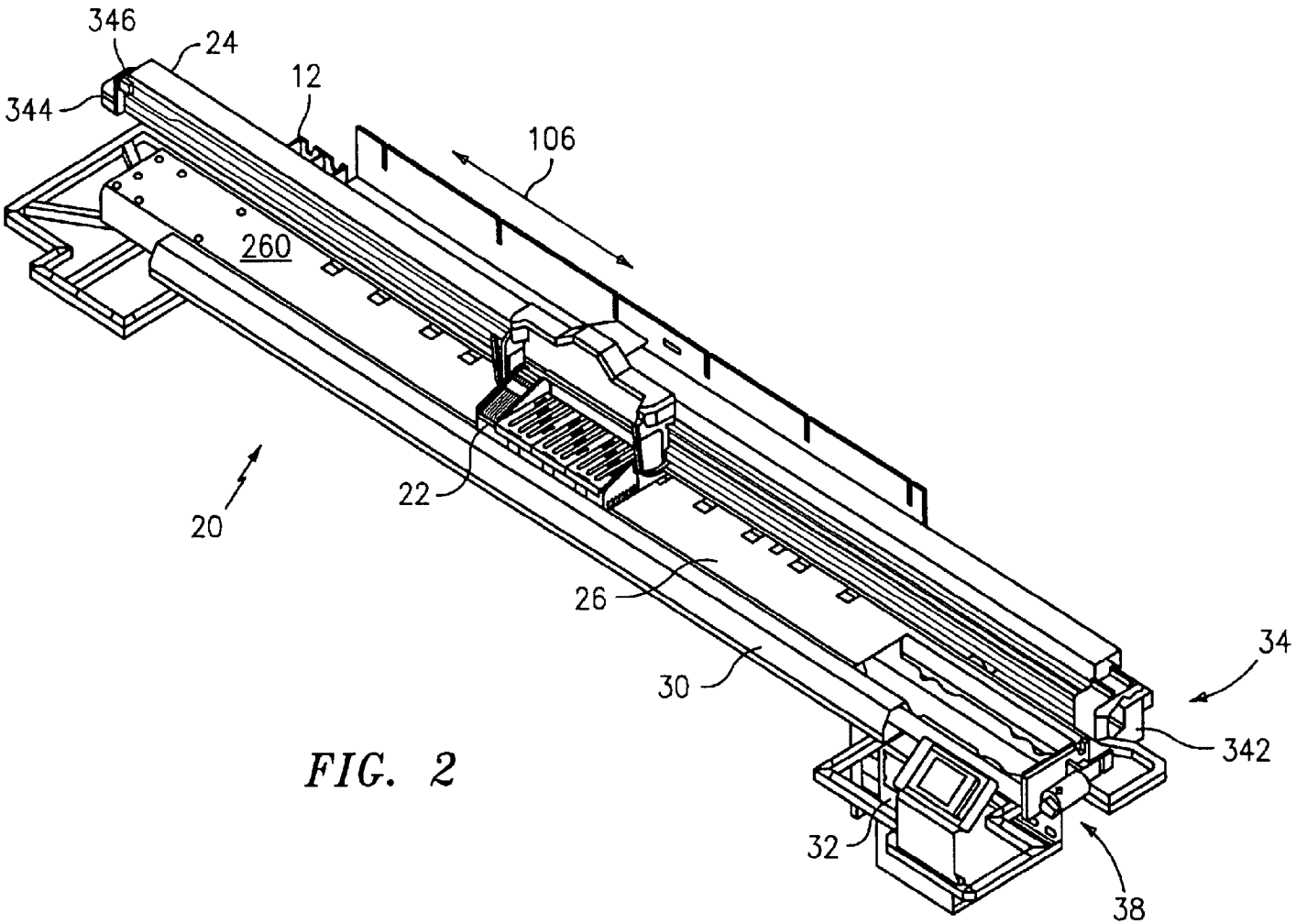
FIG. 2 is a front perspective view of a partial assembly of a preferred embodiment inkjet print engine 10, depicting the printer assembly 20 and including subordinate assemblies such as the media dryer, platen, carriage, rail, track, electronics enclosure, and chassis main supports.
Figure 3:
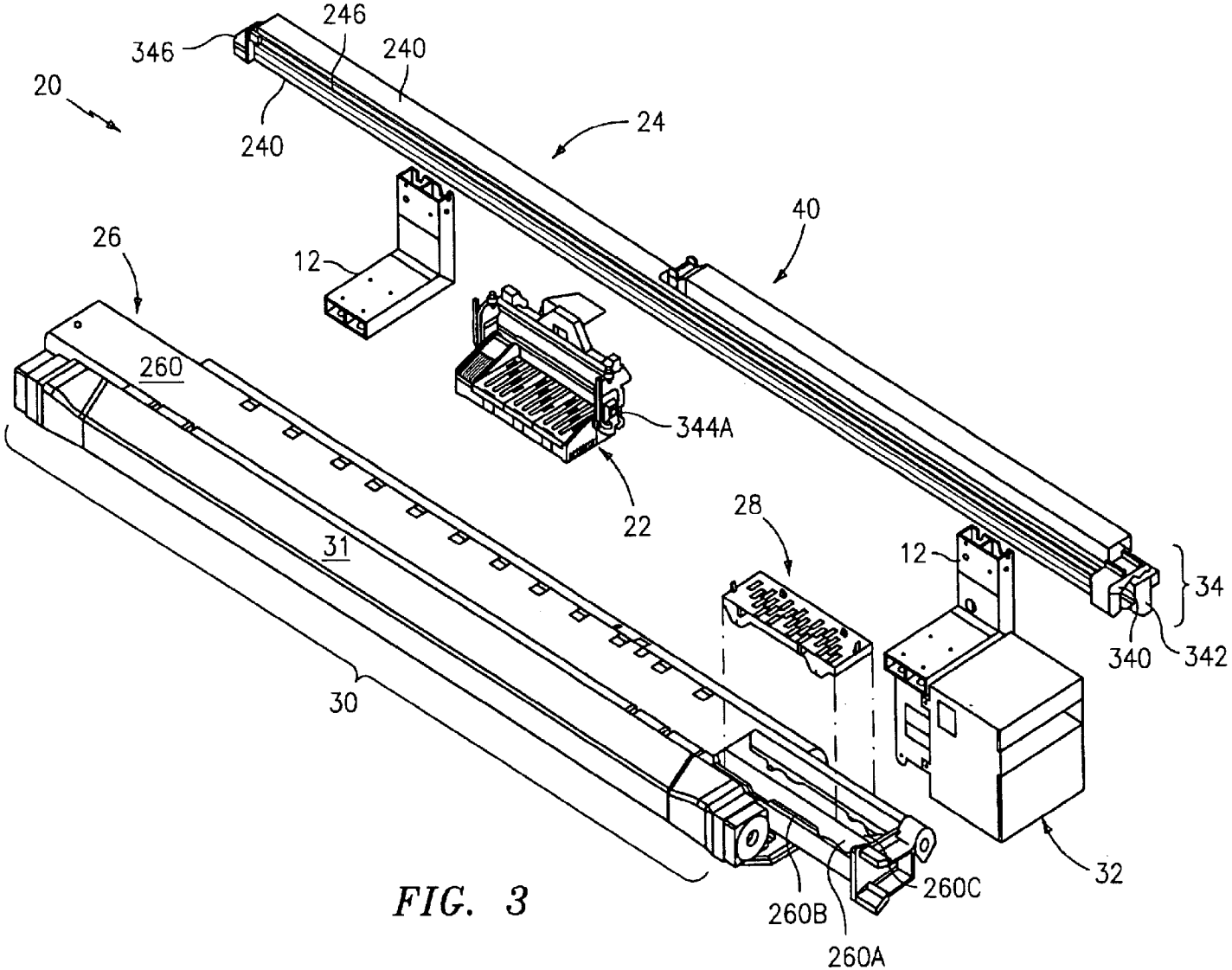
FIG. 3 is a front perspective view of a partial disassembly of a preferred embodiment of inkjet print engine 10, depicting the same or similar subordinate assemblies of printer assembly 20 shown in FIG. 2 shown here spatially separated.

FIG. 2 and FIG. 3 depict preferred printer assembly 20 includes a carriage assembly 22, rail assembly 24, platen assembly 26, service station assembly 28, media dryer assembly 30, printing control system 32, carriage drive assembly 34, and media drive assembly 38. Ink delivery system 40 (shown best in FIG. 18) includes inkjet print cartridge 100, ink supply tube 110 and ink reservoir 120. Media handling system 60 (see FIGS. 1A and 1B) includes media supply assembly 64, media sensor assembly 66, and media take-up assembly 68. Stand assembly 80 includes stand legs 82 and crossbar 84 fabricated from formed steel weldment in a free-standing configuration that supports printer assembly 20 via chassis main supports 12 (best seen in FIG. 3). Stand legs 82 include locking castors 86 for ease in moving print engine 10 and provide support for media supply assembly 64, media take-up assembly 68 and printing control system 32.

Enclosure assembly 160 includes touch-pad control panel 161, end-caps 162 and main cover 163. End caps 162 are equipped with removable end-panels 168 enabling access to internal components of print engine 10. Main cover 163 may be transparent or translucent, in part or in whole, to allow an operator to view the printing operation. Access cover 166 preferably is transparent or translucent to allow an operator to access carnage assembly 22 for service routines. Workers skilled in the art will appreciate that various structures and material types can be used to enclose or house print engine 10 and its internal assemblies and components.

To simplify the following description, print medium 90 will be referred to as "print medium 90" in most cases, but may be inclusively referred to as "media" or "medium" with appended reference number. Those skilled in the art will appreciate that a print medium can be any substance capable of receiving a printing ink including paper, film plastic, foil, cloth, vinyl, canvas, and so forth. In a further simplification, inkjet print cartridge 100 will be referred to as "inkjet print cartridge 100", but may be inclusively referred to simply as "print cartridge" or "cartridge" with appended reference number. Referring now to FIG. 1A, directional reference 10A and gravitation reference 10B indicate that print engine 10 generally operates in an orthogonal orientation relative to the X, Y and Z Cartesian coordinate axes. Carriage assembly 22 travels approximately parallel to the X-axis, print medium 90A travels approximately parallel to the Y-axis as it travels through the print zone, and the Z-axis is defined as perpendicular to both the X-axis and Y-axis. Printing operation is not theoretically restricted to these axes, but the orientation shown by directional reference 10A is provided to simplify the following description of the preferred embodiments of the present invention. Further, the preferred orientation of print engine 10 in Cartesian space enables use of gravity force as indicated by gravitational reference 10B to drive ink delivery system 40.

As shown in FIGS. 1A and 1B, when a printing operation is begun, print medium 90A is drawn from media roll 90 disposed on media supply spool 641 and inserted into print zone 15. Initial installation and loading of a print medium 90A into print engine 10 is by conventional means and will not be detailed here. Print medium 90A is temporarily halted in print zone 15 while carriage assembly 22, which contains a plurality of inkjet print cartridges 100, traverses that portion of print medium 90A proximate print zone 15 along the X-axis of travel. Simultaneously, inkjet print cartridges 100, containing a plurality of ink-emitting jet nozzles 100J, deposits droplets of colored ink, thereby printing a band or "swath" of colored dots that effect a visual image therefrom.

Referring now to FIG. 2, carriage drive assembly 34 drives carriage assembly 22 in a reciprocal scanning motion across print medium 90A, as shown by arrows 10C along rail assembly 24 by carriage drive motor 342 and carriage drive belt 344. Carriage assembly 22 is fixedly mounted to carriage drive belt 344 at convenient mounting locations 344A (best seen in FIG. 6) on trolley plate 229A, and carriage drive belt 344 is driven by carriage drive motor 342. Good acceleration, deceleration and accuracy characteristics of carriage drive motor 342 and carriage drive belt 344 are important for adequate operating performance particularly relating to print speed. Carriage drive belt 344 must be sufficiently long (approximately 245 inches) to transport carriage assembly 22 across the entire width of print media 90A as well as to access peripheral devices, such as service station 28 mounted outside of print zone 15 in, for example, maintenance station zone 17.

Workers skilled in the art will appreciate that carriage drive system 34 can be designed to efficiently drive carriage assembly 22. In the embodiment shown, carriage drive belt 344 runs in a full loop in the X-direction by way of an idler assembly 346. Carriage drive belt 344 is preferably a flat (toothless), high-torque drive (HTD) friction belt of fiberglass-reinforced Kevlar® with anti-static properties. In designing the carriage drive assembly 34 of the present invention, the inventors discovered that conventional carriage drive belt materials used in prior art print engines were inadequate for two reasons. First, urethane belts reinforced with flex-steel cord, as well as neoprene belts reinforced with fiberglass fabric, were each too massive to bridge the approximate 120-inch span required for enabling a complete range of travel for carriage assembly 22 as previously described. Both types of prior art belt material tend to sag in printing operation, resulting in unchecked oscillations during carnage travel, intermittent binding at the carriage drive pulley 340 and idler pulley 316A and rapid wear. Several different attempts were made by the inventors to compensate by design for these deficiencies without good success including using thinner (less massive) belt material and modifying the drive pulley 340 profile through successive iterations. The Kevlar® belt material of the present invention was identified and applied with good success; this material is both stronger than prior art belt materials as well as about 40% lighter. Used in conjunction with an adaptive design profile (not shown) for the carriage drive pulley 340, carriage drive belt 344 overcomes the deficiencies just described without incurring additional cost of manufacture. To the best of the inventors' knowledge, this is the first such use of carnage drive belt 344 in the art.

Figure 4A:
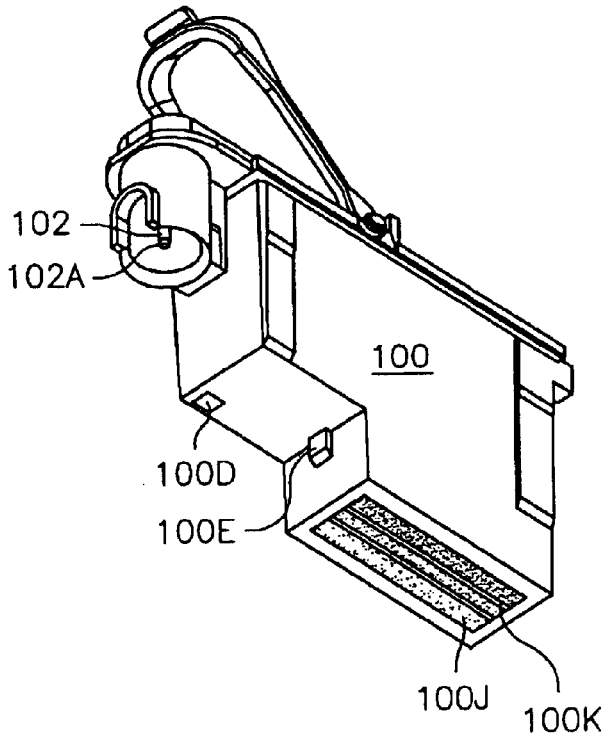
FIG. 4A is a lower perspective view of a preferred inkjet print cartridge depicting the cartridge nozzle plate 100J, jetting nozzles 100K, and external electronic interface circuit 100X.
Figure 15:
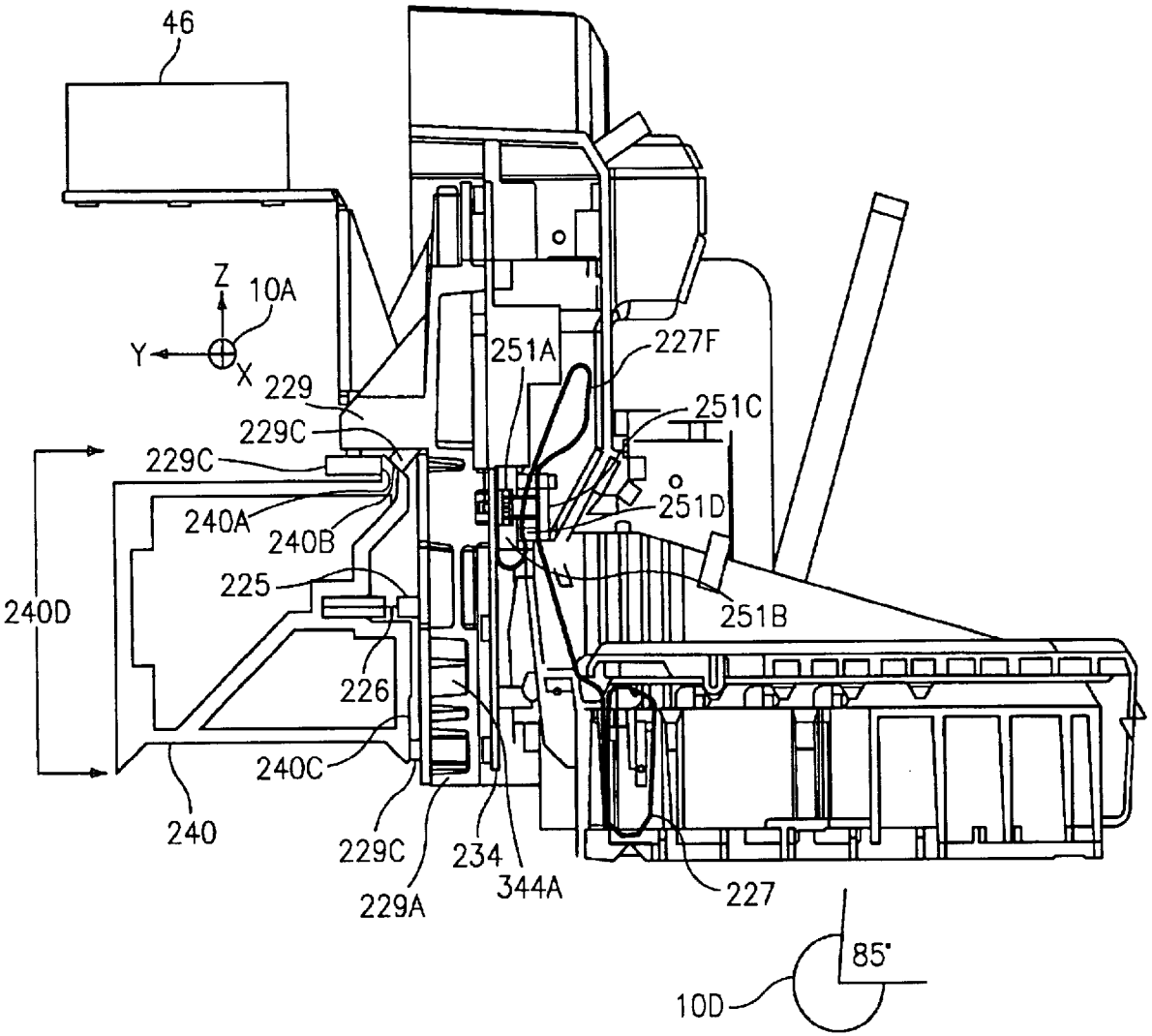
FIG. 15 is a side plan view of carriage assembly 22, depicting the service loop 227F incorporated into flex-circuit 227, which enables rotational freedom for penholder assembly 220.

Practitioners of the art also will appreciate that carriage drive system 34 can be designed to precisely control travel of carriage assembly 22. As shown in FIG. 3 and FIG. 15, encoder strip 246 is operatively disposed within rail member 240 along the entire length of travel for carriage assembly 22. Encoder strip 246 is preferably a transparent Mylar® strip which has been photographically etched, or image-set, with opaque indicia at 300 lines per inch (i.e., 600 line edges). An encoder strip reader 225 (see FIG. 15) of conventional type is mounted on carriage assembly 22, operatively positioned proximate encoder strip 246 and capable of optically detecting the line edges thereon for precisely reporting the position of carriage assembly 22 along its entire travel range. Carriage drive motor 342 is preferably a servomotor, connected to carriage 22 via carriage drive belt 344 and idler assembly 346 as previously described. With simple data manipulation of the output from encoder strip reader 225, the exact X-axis travel position of carriage assembly 22 can be known. Moreover, the accuracy of dot placement from the jetting nozzles 100K of inkjet print cartridge 100 (see FIGS. 4A and 5) can be controlled to a tolerance of +/−0.0001 inch. Said data manipulation might include adjusting the fire pulse of jetting nozzles 100K based on various measured parameters of print engine 10, thereby ensuring that ink dots may be printed in precisely controlled locations on the image. This precise positioning control helps to compensate for irregularities in the printed image, such as banding artifacts, described elsewhere in this specification.

FIG. 15 depicts an end-on view of a portion of rail member 240. Rail member 240 is preferably made of extruded steel with sufficient stiffness to prevent twisting or bending under the load of carriage assembly 22. Rail member 240 is approximately 3.5 inches wide by 3.5 inches high with extrusion walls approximately 0.25 inches thick. Preferably, rail member 240, when mounted to chassis main supports 12 (see FIG. 3), is sufficiently rigid to prevent deflection or misalignment of greater than about 0.0005 inches across a 120-inch span while supporting a mass represented by carriage assembly 22 of up to 12 lbs.

Rail member 240 includes upper tread surface 240A, 240B and lower tread surface 240C. As shown in FIG. 15, trolley wheels 229C have corresponding tread surfaces that turn on upper tread surfaces 240A, 240B and lower tread surface 240C. As will be explained, unitary rail member 240 and the attachment of carriage assembly 22 via trolley wheels 229C thereto allows movement of carriage assembly 22 only in the X-direction, and permits no rotational movement or vibration of carriage assembly 22. Upper tread surfaces 240A, 240B and lower tread surface 240C are precision-machined so as to be parallel to each other throughout the length of rail member 240. This precise parallelism prevents trolley wheels 229C from binding, galling or disengaging anywhere along the length of rail member 240. Additionally, since both upper tread surfaces 240A, 240B and lower tread surface 240C are provided on a unitary rail member 240, problems with aligning multiple components in parallel are avoided. Upper tread surfaces 240A, 240B present a V-shape, and thus provide tread surfaces disposed at an angle. Upper tread surfaces 240A, 240B accordingly provide bearing forces for trolley wheels 229C in an axial direction (i.e., positive and negative Z-axis) as well as a radial direction (i.e., positive and negative Y-axis). As depicted in FIG. 15, upper tread surfaces 240A, 240B preferably are disposed at 45 degrees to the X-Y plane. Providing both axial and radial bearing forces for trolley wheels 229C could similarly be achieved by U-shaped upper and lower tread surfaces (not depicted) and conforming surfaces on the roller tread surfaces of trolley wheels 229C, without requiring tread surfaces disposed at an angle. However, V-shaped upper tread surfaces 240A, 240B are less likely to bind or disengage from rail member 240 than are U-shaped tread surfaces, which would require parallelism between the outer walls of the U-shaped portion. Accordingly, since rail member 240 transfers bearing forces both in axial and radial directions, the print engine of the present invention need only use a single, unitary rail member 240 throughout the length of travel of carriage assembly 22.

As shown in FIG. 15, upper tread surfaces 240A, 240B and lower tread surface 240C should be located sufficient far apart to counteract moment forces about rail member 240 (i.e., about an X-axis), as indicated by offset reference 240D. Accordingly, upper tread surfaces 240A, 240B operatively engage the roller tread surfaces of trolley wheels 229C to prevent carriage assembly 22 from rotating or vibrating about an X-axis even though only a single rail member 240 is provided. Hence, rail member 240 is constructed to be about 4 inches wide not only to provide rigidity against deflection along the Z-axis, or vibration along the Y-axis, under load from carriage assembly 22 but also to provide a greater moment resistance to torsion or rotation about an X-axis. The unitary rail member 240 described avoids these problems inherent in prior art rails because it is virtually impervious to errors introduced during fabrication and possesses extraordinarily robust behavior in almost every orientation. Since only a single rail member 240 is used, there is no problem incurred from non-parallelism of tread surfaces 240A–240C. Rail member 240 further provides better service access to subordinate components of carriage assembly 22 and easier removal of carriage assembly 22 should a service operation be required.

Carriage assembly 22 includes a rigid trolley plate 229A with trolley wheels 229C that engage rail member 240 at tread surfaces 240A, 240B, 240C. Each of trolley wheels 229C is attached to carriage assembly 22 by a bolt (not shown), which serves as the wheel axle. It will be noted by practitioners of the art that a minimum of four trolley wheels 229C would be necessary to provide a sufficient number of contact points to prevent rotation or vibration about a Z-axis or about a Y-axis. If the minimum four trolley wheels 229C are used, each of the trolley wheels 229C should be significantly offset from the others. For example, a single trolley wheel 229C would be placed on one side of rail member 240, on upper tread surface 240B in between two trolley wheels 229C placed opposite the first trolley wheel 229C on upper tread surface 240A. The remaining trolley wheel 229C would be placed on lower tread surface 240C. However, it is important that carriage assembly 22 maintain as stable an orientation as possible as it is driven back and forth along rail member 240 during printing operation, particularly given the increase in print resolution made available from preferred inkjet print cartridge 100. Any rotational variation about a Z-axis, such as might be caused by vibration or shaking, tends to temporarily alter the spatial position of jetting nozzles 100K in relation to print medium 90A causing poor printing results. This type of rotational variation is particularly likely to occur as the result of the quick directional changes which carriage assembly 22 undergoes as it is transported by carriage drive belt 344 to fully exploit the faster firing rate of preferred print cartridge 100. The inventors of print engine 10 have discovered that, due to the increased mass of carriage assembly 22 resulting from the several and various design considerations described herein, using five trolley wheels 229C provides greater stability for carriage assembly 22. Accordingly, one pair of trolley wheels 229C is disposed on upper tread surface 240A of rail member 240, a second pair of trolley wheels 229C is disposed on upper tread surface 240B, and a final one of trolley wheel 229C is disposed at lower tread surface 240C.

It will be understood by those skilled in the art that the pairs of trolley wheels 229C disposed on the upper tread surfaces 240A, 240B and the single trolley wheel 229C disposed on lower tread surface 240C have a significant vertical offset 240D distanced between them. This vertical offset 240D allows trolley wheels 229C to provide a significant moment about a X-axis and helps to prevent spatial positioning errors of jetting nozzles 100K due to shaking or vibration of carriage assembly 22. Similarly, a transverse offset between opposing trolley wheels pairs 229C at tread surfaces 240A, 240B provides a significant moment about the Y-axis to prevent rotational movement or vibration of carriage assembly 22 in that direction.

It is similarly important that carriage assembly 22 should maintain a constant distance from print medium 90A and platen member 260 as printing operation proceeds. Jetting nozzles 100K are designed to place uniformly sized drops of ink on print medium 90A from a specific distance, or head-height, above the surface of a print medium 90A. If jetting nozzles 100K are too near the surface of a print medium 100K, the ink dots will not be uniformly placed which can result in the coalescing of ink drops before they are absorbed causing poor print quality. Worse, the nozzle plate 100J of inkjet print cartridge 100 might contact print medium 90A and cause unabsorbed ink to smear, ruining the printed image. Worse yet, in those circumstances where the edges of print medium 90A are lifted slightly from platen member 260, such as during periods of low ambient humidity, carriage assembly 22 can catch the edge of print medium 90A and cause an adverse machine failure commonly called a "head crash." Conversely, if jetting nozzles 100K are too distant; ink deposition may be non-uniform or may be splattered on the print medium 90A, again producing poor print quality. Moreover, because carriage assembly 22 is in motion while jetting nozzles 100K are firing, the distance between jetting nozzles 100K and print media 90A affects the location of ink dots. Consequently, carriage assembly 22 should be adequately rigid to prevent any relative movement between trolley wheels 229C and inkjet print cartridges 100. To increase stiffness between trolley wheels 229C and carriage assembly 22, bearings for trolley wheels 229C are selected to allow little or no play between trolley wheels 229C and the mounting bolts (not shown).

Figure 6:
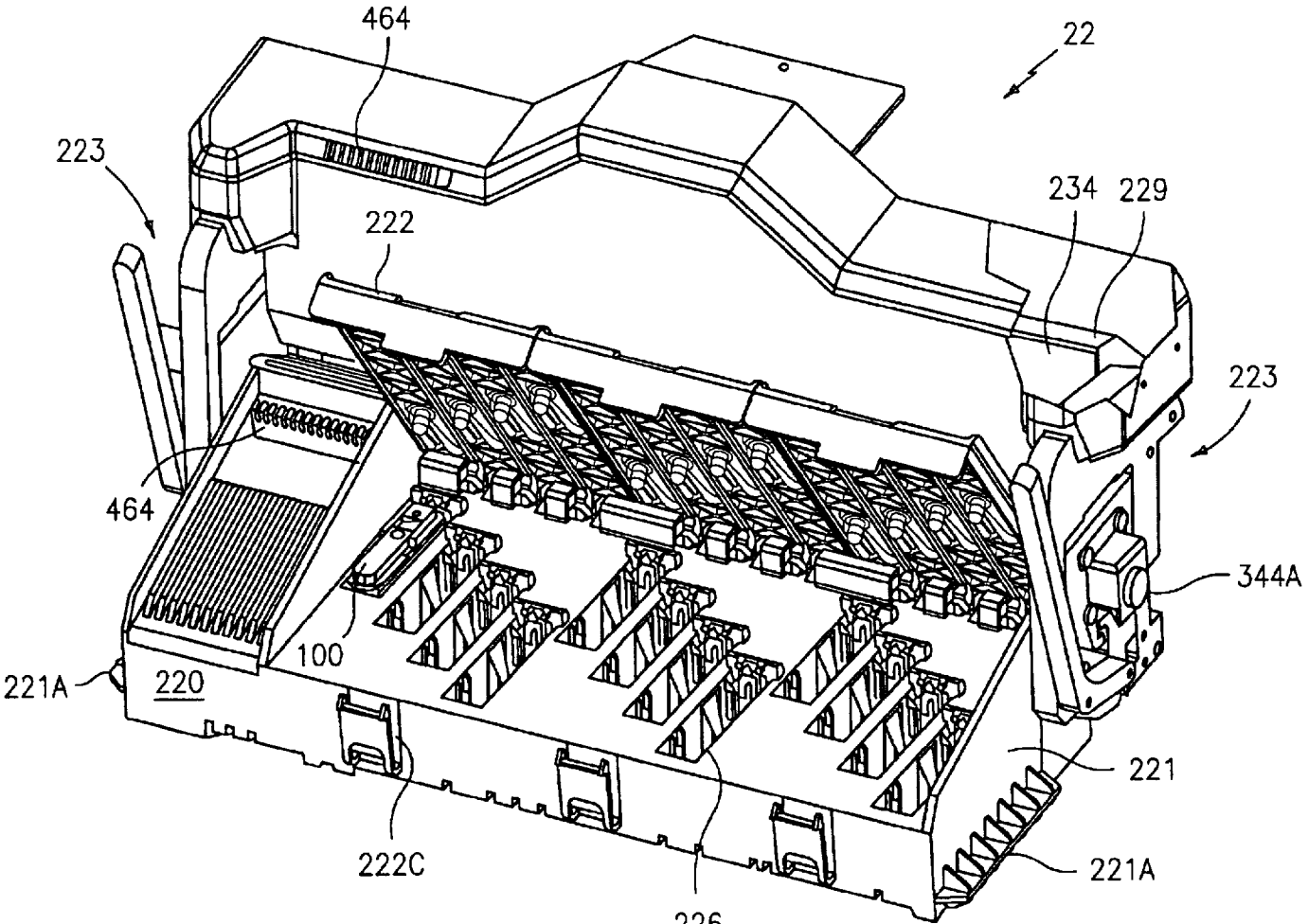
FIG. 6 is an perspective view of carriage assembly 22 illustrating the tightly packed configuration of pen sockets 226 in three orthogonal banks of four staggered sockets each with a preferred inkjet print cartridge 100 installed and indicating a routing path for a corresponding ink supply tube 110.
Figure 7:
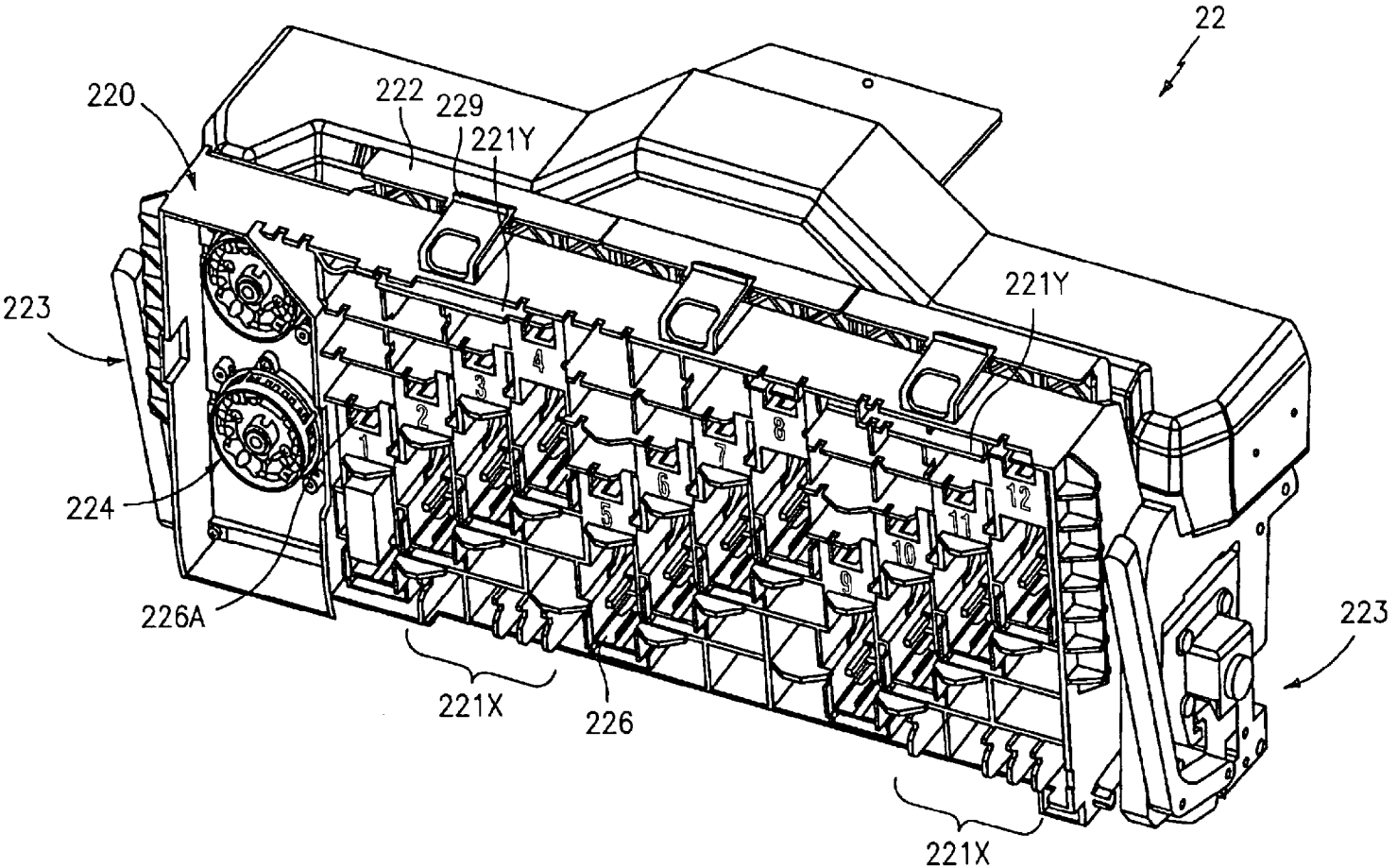
FIG. 7 is a perspective view of carriage assembly 22 similar to FIG. 6 but instead depicting penholder assembly 221 rotated into service position with a preferred inkjet print cartridge 100 installed and again indicating a routing path for a corresponding ink supply tube 110.

Referring now to FIG. 6, carriage assembly 22 is shown in perspective view. Carriage assembly 22 preferably includes twelve inkjet print cartridges 100 mounted in penholder assembly 220 in an array of three orthogonal banks of four staggered pen sockets 226. Each of preferred inkjet print cartridges 100 have two arrays or lines of jetting nozzles 100K along nozzle plate 100J (see FIG. 4A). Each of two arrays of jetting nozzles 100K presents 262 individual jetting nozzles 100K for a total of 524 jetting nozzles 100K effecting a first preferred print resolution of 600 dpi for inkjet print cartridge 100. In a second preferred inkjet print cartridge 100, all other features are similar except that each of the two arrays of jetting nozzles 100K presents 524 individual jetting nozzles for a total of 1048 jetting nozzles 100K, effecting a second preferred print resolution of 1200 dpi. This configuration and density of jetting nozzles 100K, together with firing rate of 18 kHz, produce the concomitant faster print speed and improved image quality described herein.

Additional inkjet print cartridges 100 similarly disposed in carriage assembly 22 are similarly configured, with the exception that the jetting nozzles are supplied by different ink colors. For the 12-cartridge configuration of the present invention, a "set" of cartridges 100 may include 1) Three cartridges each of four standard CMYK process colors (i.e., cyan, magenta, yellow and black inks). 2) Two cartridges each of six extended-gamut C2M2YK process colors (cyan, medium-cyan, magenta, medium-magenta, yellow and black); 3) One cartridge each of expanded-gamut C3M3YKROGB process colors (cyan, light-cyan, medium-cyan, magenta, light-magenta, medium-magenta, yellow, black, red, orange, green, blue).

Figure 5:
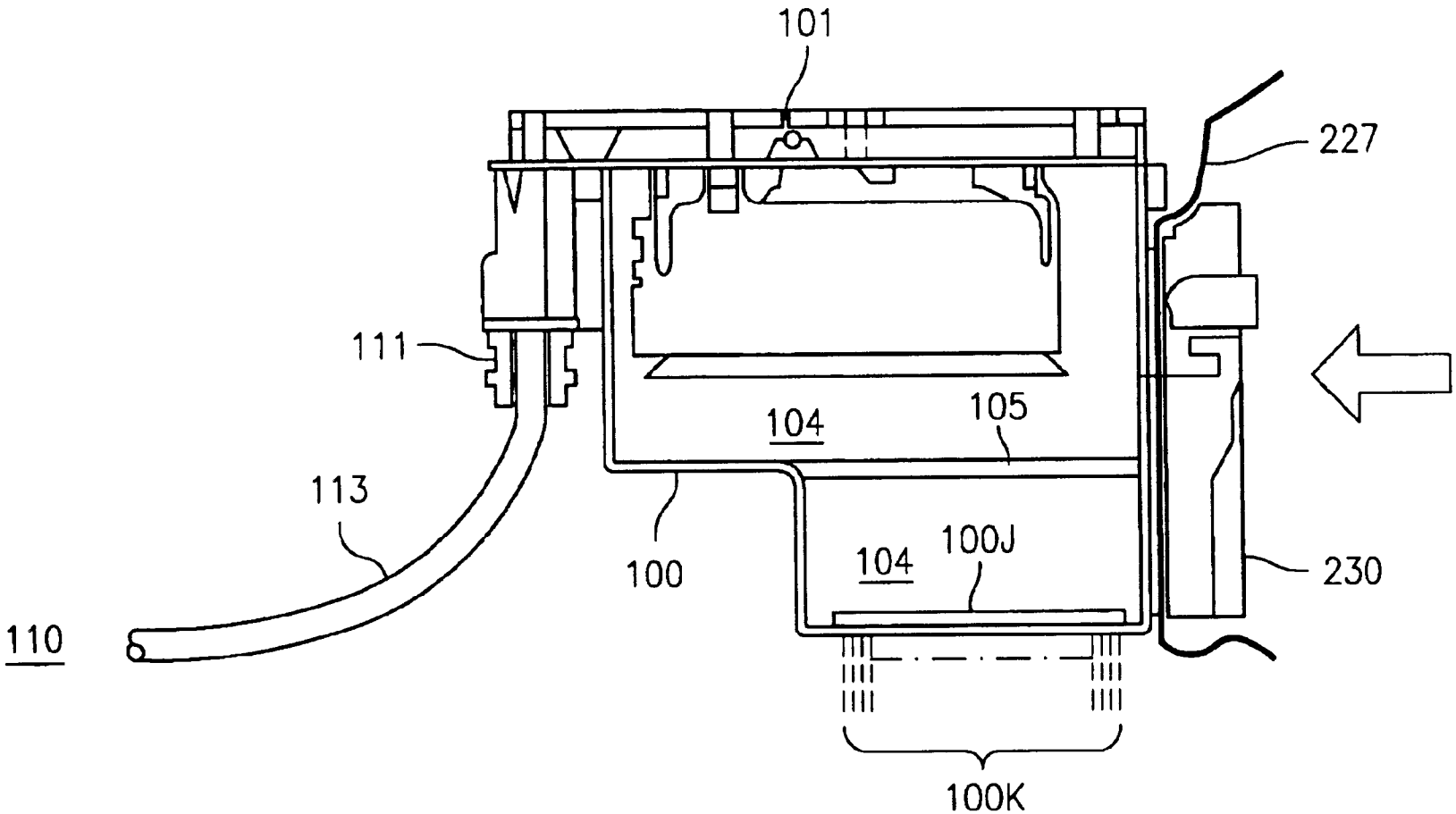
FIG. 5 is a non-scaled, cross-sectional view of preferred inkjet print cartridge 100 depicting one embodiment of a preferred fluid interconnection to an off-carriage ink supply and one embodiment of a preferred electrical interconnection to a printing control system.

Referring to FIG. 5, each of preferred inkjet print cartridge 100 includes an integrated, sealed assembly closed to atmosphere and equipped with internal cavity 104 containing an initial quantity of ink. The internal cavity 104 of preferred cartridge 100 may be equipped with two partitions separated by a filter screen 105. Inkjet print cartridge 100 includes inlet port 102 to operatively supply a second quantity of ink from an external source 120. As printing of a large-format image is performed, it occurs that one or more of preferred cartridge 100 expend a sufficient quantity of ink to exceed an operating threshold. This causes an internal mechanism (not described here) specific to the design of preferred inkjet print cartridge 100 to actuate, thus enabling a flow of ink to pass from the ink delivery system 40 into the internal cavity 104 of inkjet print cartridge 100 by force of gravity.

Figure 18:
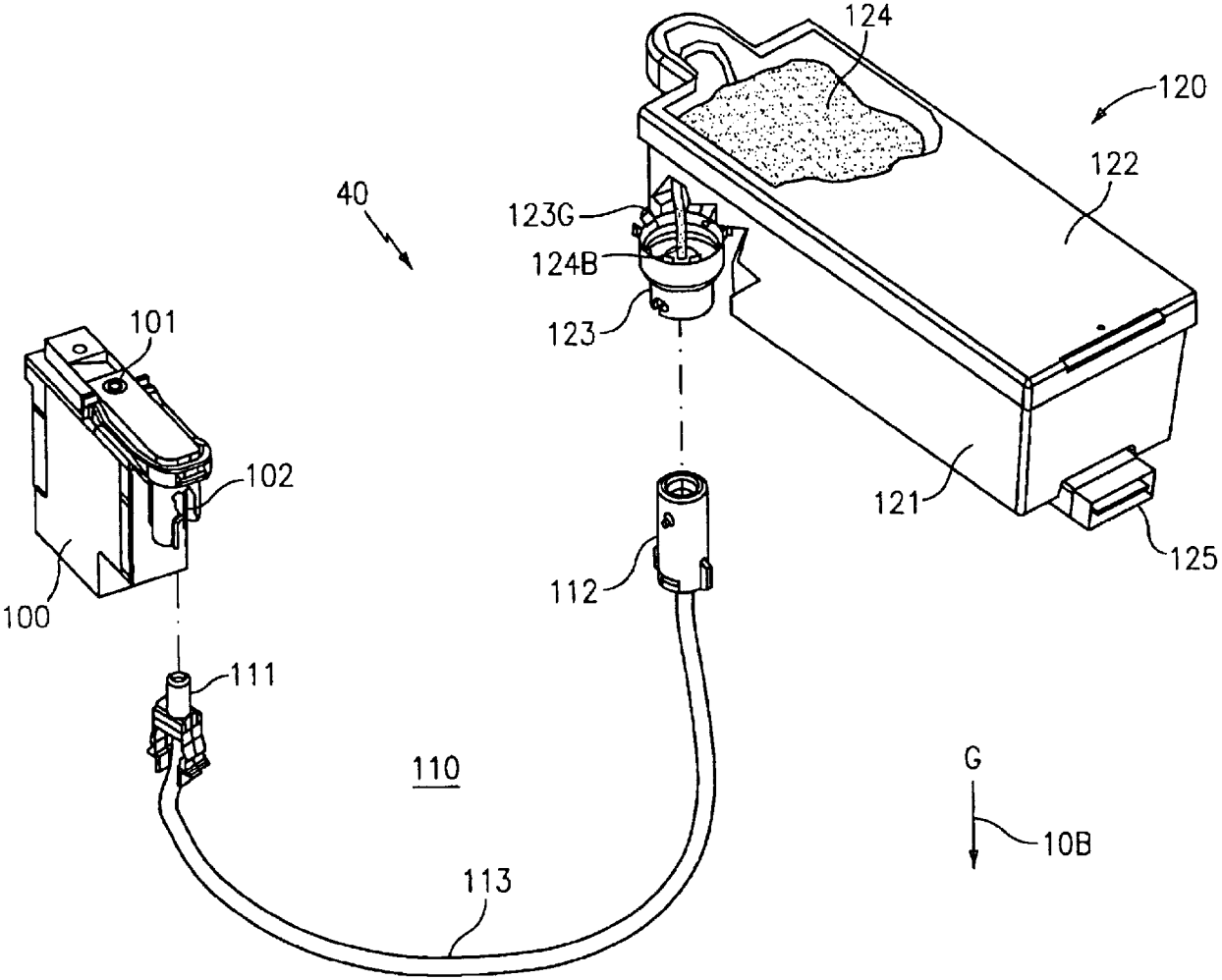
FIG. 18 is a perspective exploded view of preferred ink delivery assembly 40 of the present invention that depicts preferred inkjet print cartridge 100, ink supply tube 110 with fluid connectors 111, 112 and ink reservoir 120.

Referring now to FIG. 18, ink delivery system 40 includes a gravity-feed, sealed fluid system including inkjet print cartridge 100, ink supply tube 110, ink reservoir 120, and ink tray 140. Ink reservoir 120 is supported on a horizontal ink tray 140 (see FIG. 1A) at a height well above that of carriage assembly 22, wherein inkjet print cartridge 100 is operatively disposed. As print cartridge 100 continues to expend ink during printing operation, replenishing ink is withdrawn from ink bag 124 through ink supply tube 110. When the ink in ink bag 124 is exhausted, ink reservoir 120 is detached from ink supply tube 110, discarded, and replaced with a new ink reservoir 120. Ink supply tube 110 is equipped with quick-release fluid connectors 111, 112 with check valves that readily attach and detach from inkjet print cartridge 100 and ink reservoir 120, respectively. Ink reservoir 120 contains ink profiler 125 memory device that is detachably affixed to ink box 121. In a preferred embodiment, ink profiler 125 is read/write memory device such that printing control system 32 may modify information stored therein such as the amount of printing ink currently available for use, the color of ink, and its type (e.g., dye-based or pigment-based). Preferably, printing control system 32 may modify the information in ink profiler 125 memory device to reflect changes in the amount of printing ink available for use as printing operation is performed, such that printing control system 32 may alert the operator of print engine 10 if ink reservoir 120 is nearly out of ink.

As practitioners of the art will no doubt recognize, the ink delivery system 40 of the present invention provides a number of advantages and benefits over prior art systems such as those described, for example, in U.S. Pat. No. 6,033,064 entitled "Inkjet Printer with Off-axis Ink Supply." In particular, the benefits of preferred ink delivery system 40 include: 1) The print-head life of preferred inkjet print cartridge 100 is optimized, since cartridges are replaced only when necessary based on actual versus anticipated aging or failure of jetting nozzles. 2) A modular design enables separate replacement of system components (i.e., inkjet print cartridge 100, ink supply tube 110, ink reservoir 120) thus reducing operating costs. 3) The modular design enables rapid change-over to different inks, such as when switching between ink sets used for high-speed printing and those used for high quality printing, or when switching between ink types (e.g., dye-based or pigment-based). 4) Similarly, a modular design improves operator coordination of inkjet print cartridges 100, ink supply tubes 110, and ink reservoirs 120, resulting in fewer installation errors and increased productivity. 5) A larger off-carriage reservoir may be used (e.g., 1000 ml versus 500 ml) due to the increased longevity of preferred inkjet print cartridge 100. 6) The ink reservoir 120 includes an integral ink profiler 125 memory device, enabling each ink reservoir 120 to be removed, stored, reinstalled, replaced and disposed of along with its ink profiler 125 memory device.

Referring again to FIG. 1A, a guide-way or track assembly 150 is operatively disposed in print engine 10 that connects carriage assembly 22 with printing control system 32. Track assembly 150 contains multiple electrical cables that provide power and signal service to carriage assembly 22, as well as twelve ink supply tubes that supply ink from off-carriage ink reservoirs 120 to the print cartridges 100. Track assembly 150 as used in the present invention is similar in most respects to the apparatus taught in U.S. Pat. No. 5,469,201 entitled "Ink Supply Line Support System for a Continuous Ink Refill System for Disposable Inkjet Cartridges" which is assigned to the assignee of the present invention and is incorporated by reference herein in its entirety.

Figure 4B:
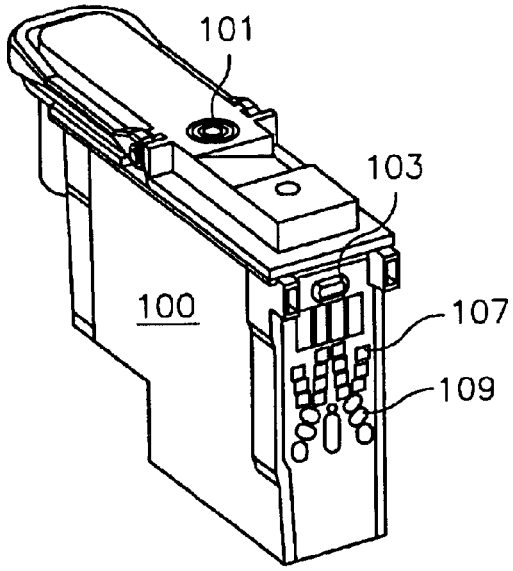
FIG. 4B is a top perspective view of the inkjet print cartridge of FIG. 4A.

As best seen in FIG. 4B, preferred inkjet print cartridge 100 presents an array of electrical contacts 107 operatively disposed on an external front surface. Electronic circuitry 109 is provided on inkjet print cartridges 100 to operatively control thermal jetting nozzles 100K by signals provided from printing control system 32. A flex-circuit 227 is provided to the outside of carriage 22 in each of pen sockets 226 that presents a corresponding array of electrical contacts that operatively interconnect the electronic circuitry 109 of inkjet print cartridge 100 with printing control system 32 via contact-to-contact connection at electrical contacts 107. Inkjet print cartridge 100 is precisely located relative to electrical contacts 107 on flex-circuit 227 within pen socket 226 in three orienting axes using a plurality of locating datum surfaces (see FIG. 10) as described in greater detail elsewhere in this specification. Two biasing spring members 222A and 226A, also described in greater detail elsewhere in this specification, are disposed in penholder cover 222 and pen socket 226, respectively, which urge inkjet print cartridge 100 datum surfaces against corresponding datum surfaces in pen socket 226. Pen socket 226 and flex-circuit 227 thus allow inkjet print cartridge 100 to be readily installed and removed, whereby simultaneous electrical connection between electronic circuitry 109 of inkjet print cartridge 100 is operatively engaged to and disengaged from printing control system 32.

Figure 29:
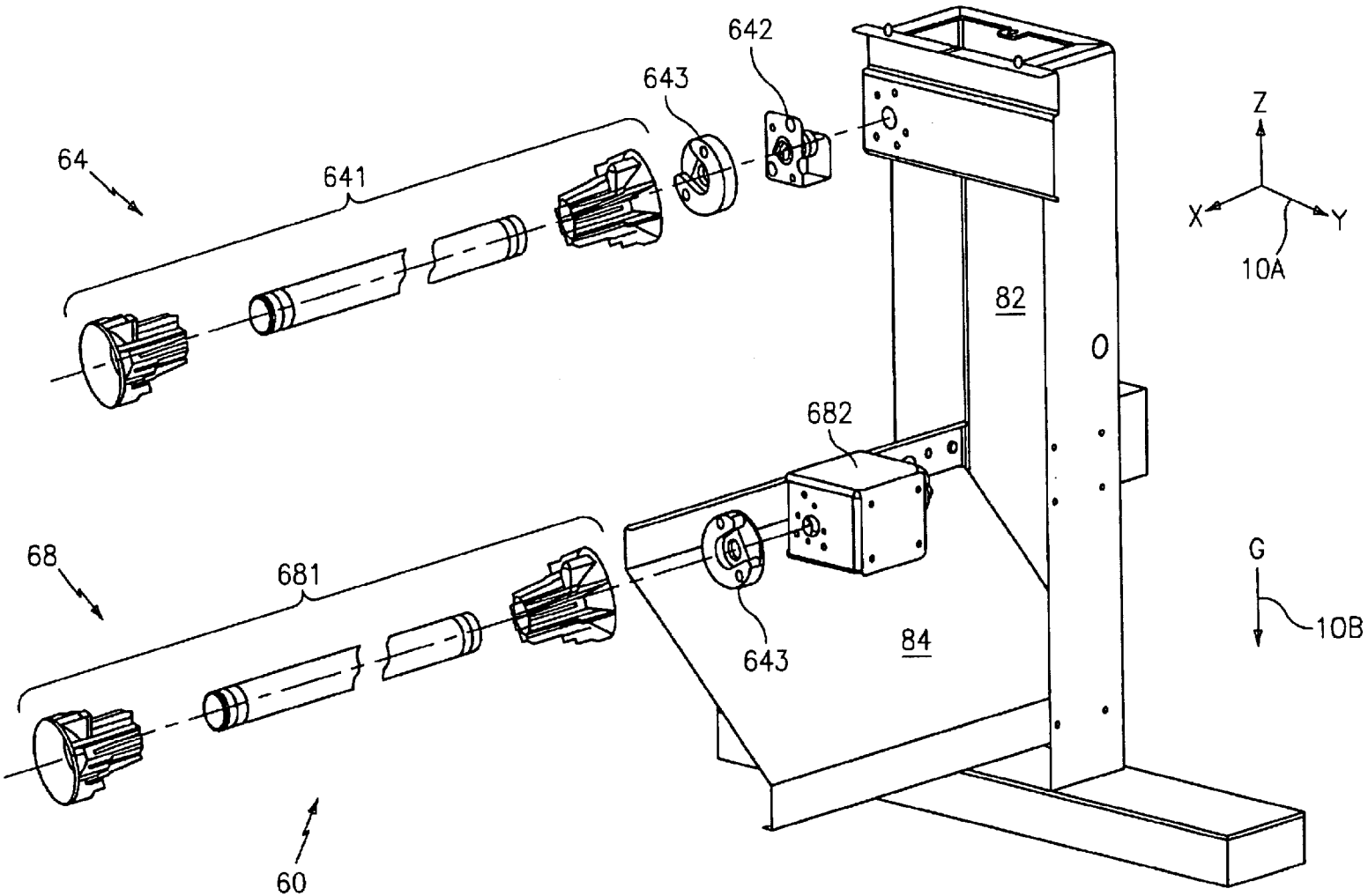
FIG. 29 is an exploded perspective view of the preferred media handling system 40 of the present invention illustrating the media supply assembly 64 and media take-up assembly 68.

As best seen in FIG. 29, preferred media handling system 60 presents media supply spool 641 operatively supporting media roll 90 (see FIG. 1B). Print medium 90A enters through an opening of print engine 10 between rail assembly 24 and platen assembly 26 and is transported incrementally through print zone 15. After an initial pass or "scan" of carriage assembly 22 in one direction, print medium 90A is incrementally advanced using media drive system 38 to a subsequent position within print zone 15. Carriage assembly 22 again traverses the print medium—this time in an opposite, or reciprocal, direction—and a subsequent swath of ink is printed. Media drive system 38 includes servomotor 381 that drives a plurality of drive rollers 386 and a corresponding plurality of pinch rollers 390 which together form a series of nip-points that operatively capture and position print medium 90A for printing operation (see FIG. 32). Servomotor 381 preferably includes an integral rotary optical encoder for position-feedback sensing of the spatial location of print medium 90A. Each of platen assembly 26, cockle guard 221A (see FIG. 6) and media take-up assembly 68 further serves to properly handle print medium 90A. As printing operation proceeds, the leading edge of the print medium 90A passes under media dryer assembly 30 (best seen in FIG. 3), which directs a continuous chaotic flow of heated air onto the surface of print medium 90A now wetted with ink on the printed portion. This flow of heated air is sufficient to completely dry print medium 90A as it passes below dryer tube 31 operatively disposed proximate print zone 15 for that purpose. When printing operation is complete, print medium 90A continues to be advanced by media drive system 38 past media dryer assembly 30 under control of printing control system 32 to ensure that the entire printed area is dried.

It will be appreciated by workers skilled in the art that printing control system 32 includes electronic circuit boards and operating software (not shown) that enable it to monitor and control all electronic sensors and components of print engine 10. Printing control system 32 employs two electronics subassemblies: a first, disposed in an off-carriage electronics bay (see FIG. 1A), runs the operating software and performs all data and signal I/O handling, housekeeping and print engine control functions. The second, print-head controller 234 (see FIG. 6), disposed on-board carriage assembly 22, performs all data management and control operations related to routing image data to inkjet print cartridges 100. Printing control system 32 directs printing operation of print engine 10 by executing program instructions integral to the operating system software stored in internal, non-volatile memory. Further, printing control system 32 dynamically controls printing operation based on monitoring the current status of a range of printing parameters and operating conditions using a plurality of sensors operatively disposed among the active subassemblies of print engine 10 to provide current operating status information. Active subassemblies of print engine 10 include carriage assembly 22, carriage drive assembly 34, media drive assembly 38, media dryer assembly 30, media take-up assembly 68, print cartridge 100 and control panel 121. Conventional means are used to interface printing control system 32 to handle interrupts and coordinate signal traffic from image sensor 224, encoder strip reader 225, media thickness sensor 66, media drive encoder 382, media take-up encoder 683, and control panel 121.

Workers skilled in the art will recognize that printing control system 32 is capable of directing routine printing operation of print engine 10 as well as orchestrating operational changes based on dynamic status updates from the various sensors, or by command of an operator using control panel 121. Practitioners will further understand that means conventional and well understood may be employed to effect operating changes based on signals transmitted from any of the sensors previously described, from printing parameter information included with image data, and from control commands selected by an operator and communicated via control panel 121. Further, it will be realized that printing parameters and control commands are referenceable data that may be stored in a memory device and later retrieved by printing control system 32 based on a set of criteria included in program instructions of the operating system software.

In a preferred embodiment, printing control system 32 includes a plurality of look-up tables stored in non-volatile internal memory that contain operating parameters for print engine 10 for each of a plurality of print media 90A. The operator of print engine 10 initially indicates to printing control system 32 which particular print medium 90A is being supplied to print engine 10. Printing control system 32 may then refer to a look-up table to retrieve operating parameters, color characteristics, or other data relating to print medium 90A such as may include the media thickness, the print medium advance increment, the quantity of media accumulated at media take-up assembly 68, and the quantity of media remaining on media supply assembly 64. This information is used by printing control system 32 to automatically adjust operating conditions of print engine 10 in preparation for printing operation such as the carriage head-height position, the media advance increment, the fire pulse of jetting nozzles 100K, and so forth. An operator of print engine 10 when characterizing a new media having characteristics that are similar to a previously characterized print medium also may select this information.

In another aspect of the present invention, characterization data of a print medium 90A—or select portions of it—may be printed on an unused portion of print medium 90A, such as the leading edge of supply roll 90, in anticipation of future continued use. Characterization data may be in the form of plain text indicating the media type (i.e., important information that may be lost after the media roll is removed from its packaging), as well as the quantity of print medium 90A remaining on media roll 90. This data may be used by an operator of print engine 10 to select the proper media type from a list displayed on an LCD portion of control panel 121 and to enter a value for the quantity of media on media roll 90 that is available for use. In a further inventive aspect, the data may be in the form of a machine-readable code, which may be read by image-sensor 224 to the same effect but without requiring operator intervention. A preferred machine-readable code includes standard barcodes current in the art such as 3 of 9 Low Density Bar Code, 3 of 9 High Density Bar Code, either with or without human readable components. Other preferred machine-readable codes include OCR-A and OCR-B codes, Line Draw, Postnet/FIMM bar code, standard 3 of 9 bar code, EAN-UPC bar code, and the like.

These inventive features, both individually and in concert, provide more precise control of critical printing parameters providing that printing operation may be more advantageously and beneficially practiced by operators in the field.

The following sections describe in further detail the various novel features of the present invention. The reader is again invited to refer to the figures appended hereto and to the detailed descriptions that follow. Elements previously designated and described will not be redundantly described; however, elements that require additional teaching of the art will be more completely described hereinafter.

Carriage Assembly

The carriage assembly of the present invention provides the following inventive features: 1) Means to optimally position up to twelve (12) inkjet print cartridge to maximize both image quality and output speed. 2) Means to precisely position and operatively interface one or more inkjet print cartridges, or "pens" within a penholder. 3) Means to allow an operator to access one or more inkjet print cartridges for cleaning, maintenance, or service operations without having to remove, reinstall the inkjet print cartridge or positional recalibrate the print head. 4) Means to automatically adjust the vertical position of the carriage assembly to position the print heads within the inkjet print cartridges an optimal distance from a printing medium to accommodate different thickness of printing media. 5) Means to automatically measure and compensate for print-head position inaccuracy, inkjet nozzle failure, and chromatic variation in the printed image quality.

As shown in FIG. 6 through FIG. 17, carriage assembly 22 includes a penholder assembly 220, a height adjuster assembly 223, an image-sensor assembly 224, an encoder-reader assembly 225, a print-head controller 234, and a trolley assembly 229.

Figure 12:
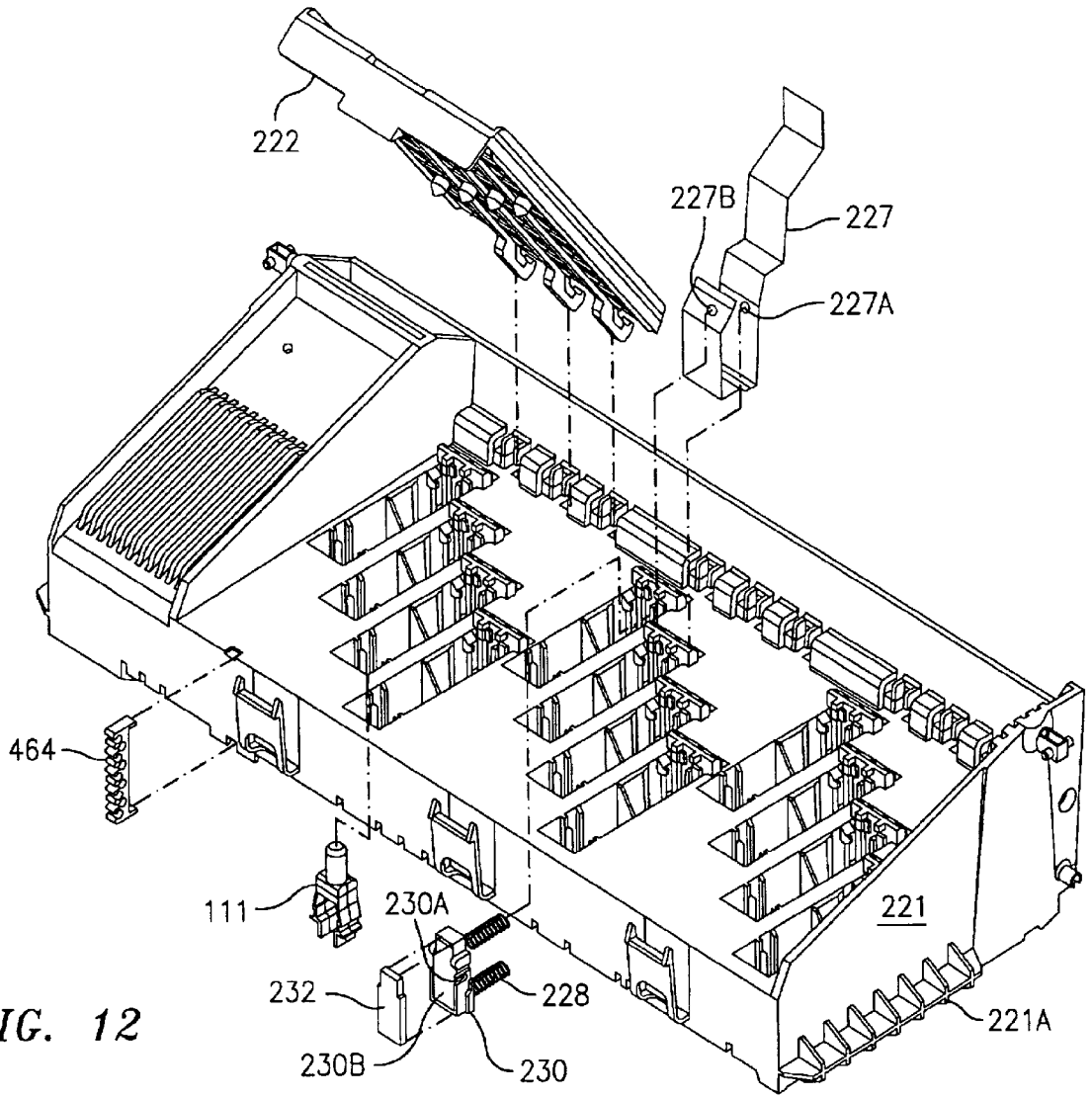
FIG. 12 is a perspective view of penholder assembly 221 depicting various component parts including penholder cover 222, a distal portion of flex-circuit 227, spring-plate 230, compression springs 228 and rubber pad 232 and showing pin journal 230A.
Figure 13:
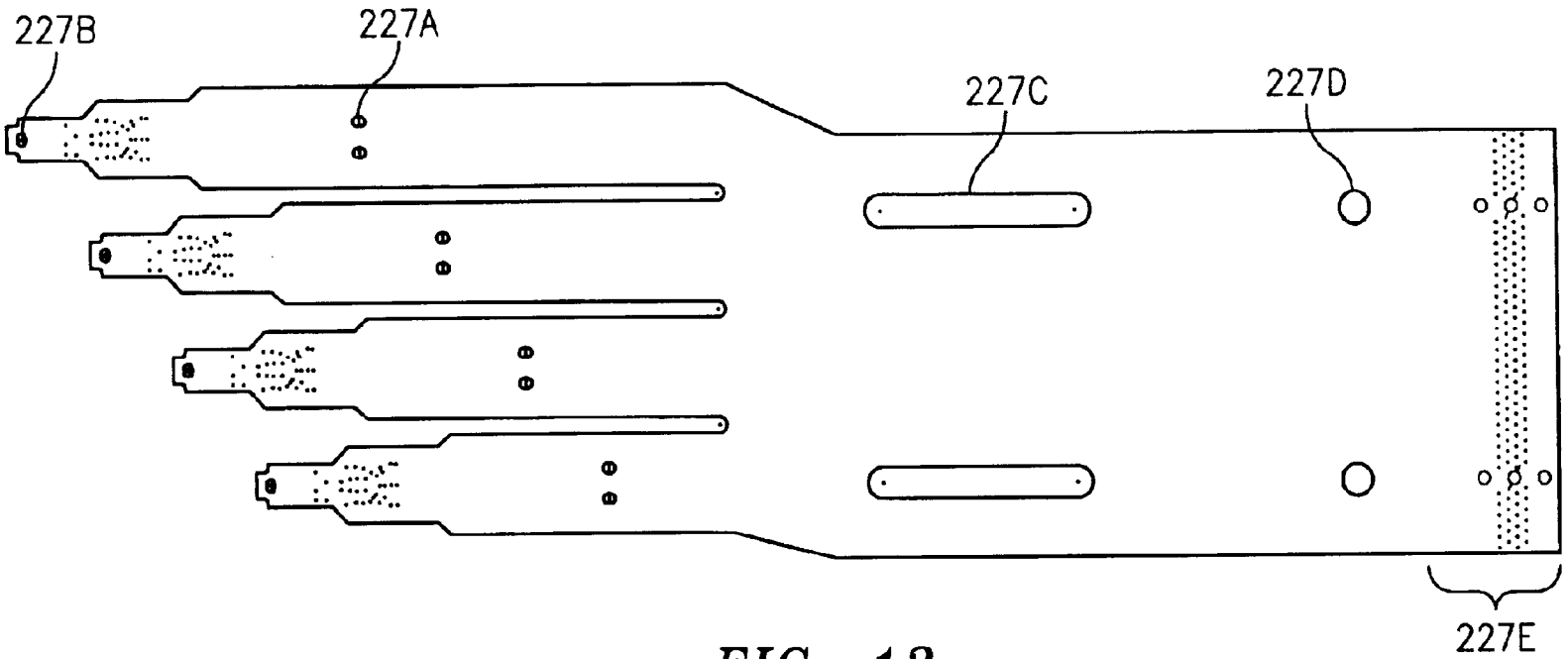
FIG. 13 is a plan view of flex-circuit 227 showing mounting apertures 227A through 227D.

Referring to FIG. 6, penholder assembly 220 incorporates a solderless assembly of parts, including a penholder base 221, penholder cover 222, flex-circuit 227, compression springs 228, spring-block 230, and rubber pad 232 (see FIG. 12). As shown, penholder assembly 220 provides twelve (12) individual print cartridge or "pen" sockets 226 that electrically and physically interface with inkjet print cartridges 100 in releasable engagement to allow an operator of print engine 10 the freedom to select different types of inks, or combinations of ink colors, for use with a given print job.

In one embodiment shown in the figures, penholder assembly 220 is configured to accept 12 inkjet print cartridges 100 in three banks of four cartridges each. This configuration provides significant advantages in reducing cost of manufacture of print engine 10, since it allows the use of low-cost, conventional extrusion technology in the fabrication of narrower platen and rail structural members than otherwise would be required in using a prior art penholder employing 12 staggered cartridge positions. The wider, 1-inch long footprint of preferred inkjet print cartridge 100 would require a printing surface on platen member 260 in excess of 12 inches wide if all print cartridges were staggered in series. This width exceeds conventional fabrication means for extruding structural members. While possible, it is also an expensive design solution. Further, a wider platen would increase the moment of carriage assembly 22 requiring a wider rail member 120 resulting in yet another increase in the cost of fabrication. Since preferred print engine 10 is a multi-pass printer, this print-head configuration causes more individual print nozzles of the same color to pass over any given pixel location.

As will be appreciated by workers skilled in the art, the more individual jetting nozzles 100K of the same color ink that pass over a given pixel location, the more opportunities there are to substitute functioning jet nozzles for failed ones using the printer's control system. This, of course, provides a benefit in maximizing the useful life of an inkjet print cartridge 100, since a relatively greater number of jets may fail on a single print cartridge 100 before it must be replaced. Using the printing control system 32 to substitute functioning jet nozzles 100K for failed ones is an effective means to maintain print quality while still maximizing the useful life of a print cartridge 100, as is known in the art. The disadvantage of this approach, however, lies in slowing the printer's output speed. At a certain point in the life of a print cartridge 100, a sufficient quantity of jetting nozzles 100K will fail so that there is no functioning jet that visits one or more pixel locations. At that point, print quality begins to degrade without means of remediation short of replacing the print cartridge or increasing the number of passes to access more functioning jets. For every increase in the number of passes the carriage must make to print a swath of ink, there is a commensurate reduction in print speed.

For some print jobs, speed takes precedence over print quality. For others, print quality takes precedence over speed. Since it's difficult to predict how long a print cartridge 100 will last, when it will fail, and how quickly, it would be useful if the printer could monitor print quality and make adjustments as necessary based on the job requirements selected by an operator. The improved image sensor assembly 224 (see FIG. 17) provides an increased sampling resolution, a larger field-of-view, and much faster data handling and processing. This enables the print engine 10 to perform print quality checks on-the-fly (i.e., during a printing run) and to substitute functioning jets for failed ones nearly as soon as they are detected. In a preferred embodiment, small test figures are printed on an unused portion of the print media 90A (e.g., along the paper edge) and read by image sensor assembly 224 as carriage assembly 22 passes over the media In a second preferred embodiment, small test figures are printed on disposable media provided for that purpose, which is thrown away when the print job is completed. When a threshold of failed jet nozzles is reached, the printing control software 32 automatically downgrades the print speed by reverting to an increased number of passes. This capability is especially useful when performing unattended printing of large jobs, such as overnight. Alternatively, an operator could direct printing control system 32 to ignore failed jet nozzles and to continue to print a job at a selected print speed. This capability, in turn, allows the operator of print engine 10 the freedom to choose between a fast print speed with reduced image quality, or good image quality at reduced print speed, based on the print job requirements.

Referring again to FIG. 15, penholder assembly 220 is capable of 85 degrees of rotational freedom, as shown by rotation reference 10D, thus providing ready access by the operator of print engine 10 to perform various service functions without requiring the removal, re-insertion, replacement, and positional re-calibration of inkjet print cartridges 100. Service functions may include, but are not limited to: replacing failed print cartridges 100; clearing clogged jetting nozzles 100K; cleaning ink build-up on the cartridge 100 nozzle plate 100J; cleaning the on-carriage image sensor assembly 224 including lenses; purging air from print cartridges 100; filling, connecting and routing ink supply tubes 110, and priming inkjet print cartridge 100. Hence, the advantages and benefits of preferred penholder assembly 220 over prior art fixed penholders will be instantly recognizable to one skilled in the art. In particular, a penholder assembly of the previous art must be removed from print engine 10 to clean fixed subassemblies, such as on-carriage image sensor 224 (if any). Also, conventional print cartridges must be removed from the penholder to clear clogged jetting nozzles, to clean the cartridge nozzle plate, to replace inkjet print cartridges, and to route ink supply tubes (if any) to off-carriage ink reservoirs. Maintenance tasks specific to a preferred embodiment of inkjet print cartridge 100, such as replacing or priming print cartridge 100 or ink supply tube 110, also would require removal of the print cartridge using a conventional penholder assembly of the previous art. All such service functions undertaken using previous art penholder assemblies would require the operator to perform positional re-calibration of inkjet print cartridges 100.

Figure 9:
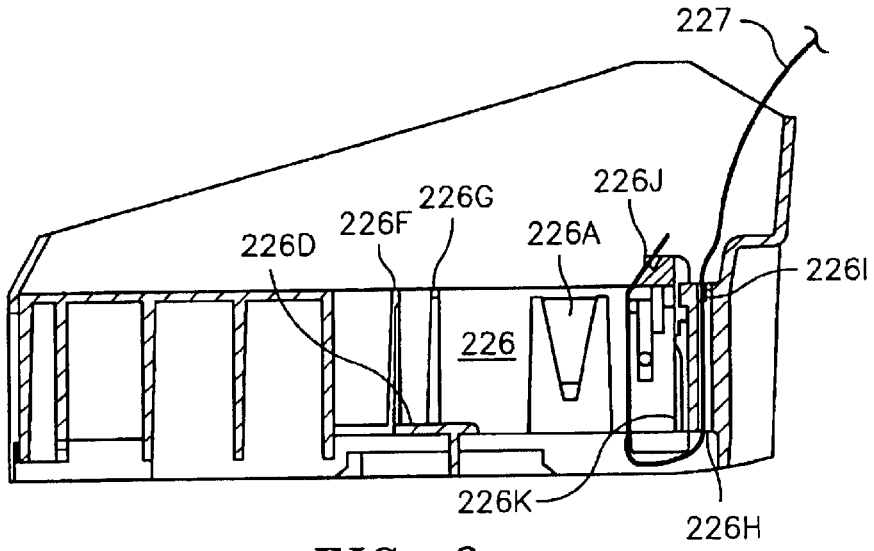
FIG. 9 is a cutaway side view of penholder assembly 221 and pen socket 226, also depicting in detail some of the structural and functional features therein and showing the routing path of a distal portion of flex-circuit 227.
Figure 14A:
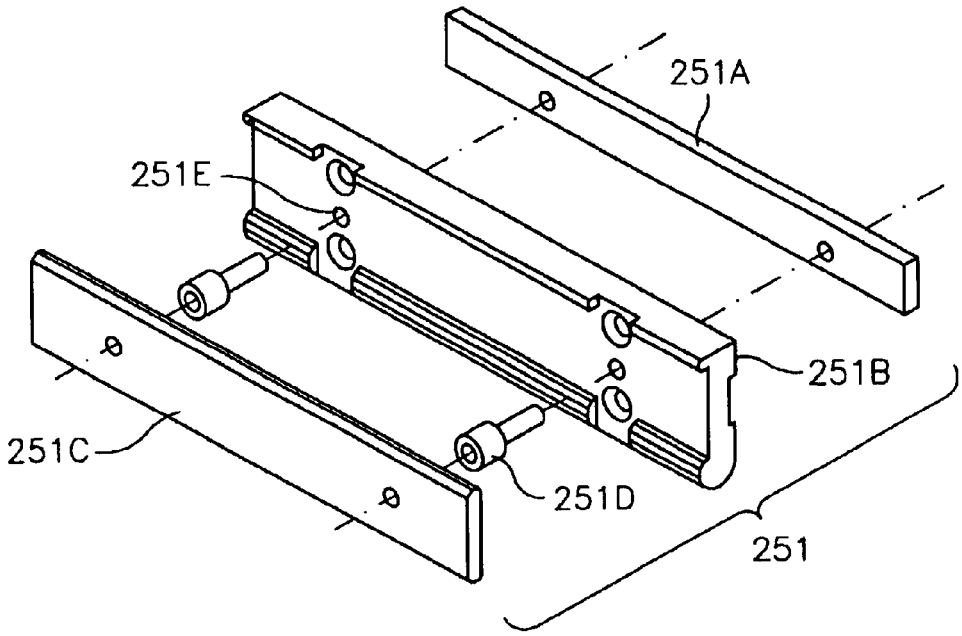
FIG. 14A is an exploded perspective view of flex-circuit mounting bracket assembly 251.

Rotating penholder assembly 221 is equipped with flex-circuits 227, routed as shown in FIG. 9 and FIG. 15, and arranged in a service loop 227F adequate to operatively accommodate the full 85 degrees of rotational freedom of penholder assembly 220, as well as vertical travel from head-height adjuster assembly 223. A similar service loop (not shown in FIG. 15 for clarity of drawing detail) is required for the flex-circuit portion 224A of image sensor assembly 224, which also accommodates the rotational freedom of penholder assembly 220. Service loop 227F is applied to flex-circuit 227 during assembly of penholder assembly 220 and operatively fixed in position using head flex bracket assembly 251, which includes foam pad 251A, head flex bracket 251B, retainer plate 251C and barrel pin 251D. Referring now to FIGS. 14A and 15, foam pad 251A is used to apply pressure between flex-circuit 227 at header portion 227E (see FIG. 13) and a corresponding flex-circuit connector (not shown) on print-head controller 234 circuit board. Flex-circuit 227 is doubled once and head flex bracket 251B is set in place to retain foam pad 251A and flex-circuit 227 to print-head controller 234 circuit board. Flex-circuit 227 is doubled again—thus applying service loop 227F—and barrel pins 251D are inserted through apertures 227C and 227D in flex-circuit 227 and aperture 251E in head flex bracket 251B. Retainer plate 251C is then set in place and the entire head flex bracket assembly 251 (FIG. 14A) is secured with conventional threaded fasteners that pass through all five components shown in FIG. 13 and FIG. 14A to engage fasten to print-head controller 234 circuit board.

Figure 14B:
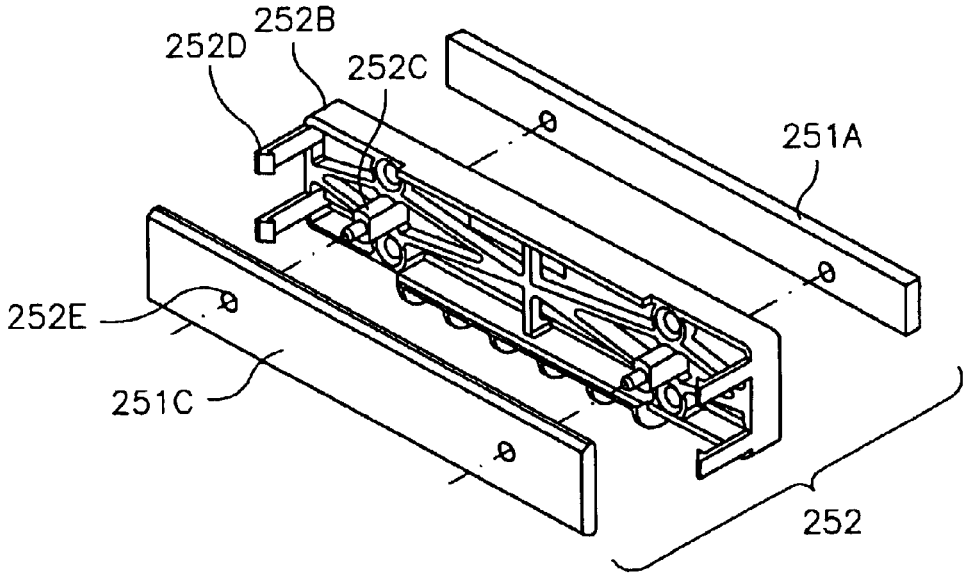
FIG. 14B is an exploded perspective view of flex-circuit mounting bracket assembly 252.

Referring now to FIG. 14B a similar service loop (not shown for clarity) is applied to the flex-circuit portion 224A of image sensor 224 (FIG. 13) using camera flex bracket assembly 252, which includes foam pad 251A, camera flex bracket 252B and retainer plate 251C. A foam pad 251A also is used to apply pressure between flex-circuit portion 224A at header portion 224B (see FIG. 17) and a corresponding flex-circuit connector (not shown) on print-head controller 234 circuit board. Flex-circuit portion 224A is doubled once and camera flex bracket 252B is set in place to retain foam pad 251A and flex-circuit portion 224A to print-head controller 234 circuit board. Flex-circuit portion 224A is doubled again and positioned between pin members 252C. Flex-circuit portion 224A is then captured by retainer plate 251C, which engages pin members 252C at apertures 252E and is held in place by clips 252D. Due to the much narrower width of flex-circuit portion 224A, the more stringent method of affixing flex-circuit 227 is not needed.

Figure 8A:
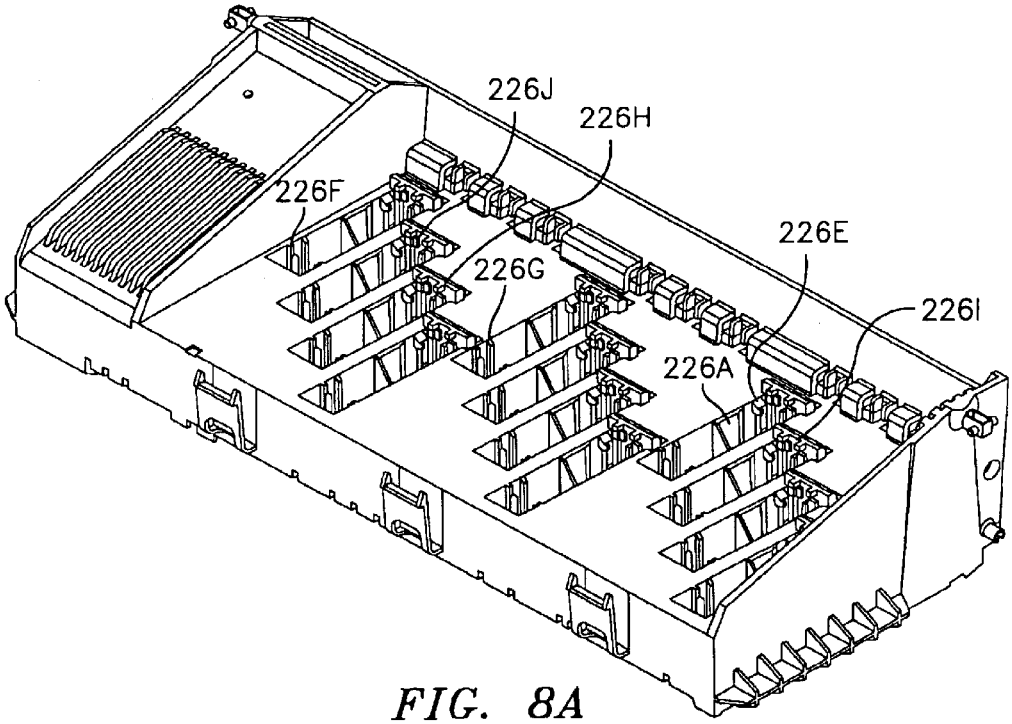
FIG. 8A is a top perspective view of penholder assembly 221 and pen sockets 226 depicting in detail some of the structural and functional elements thereof.
Figure 8B:
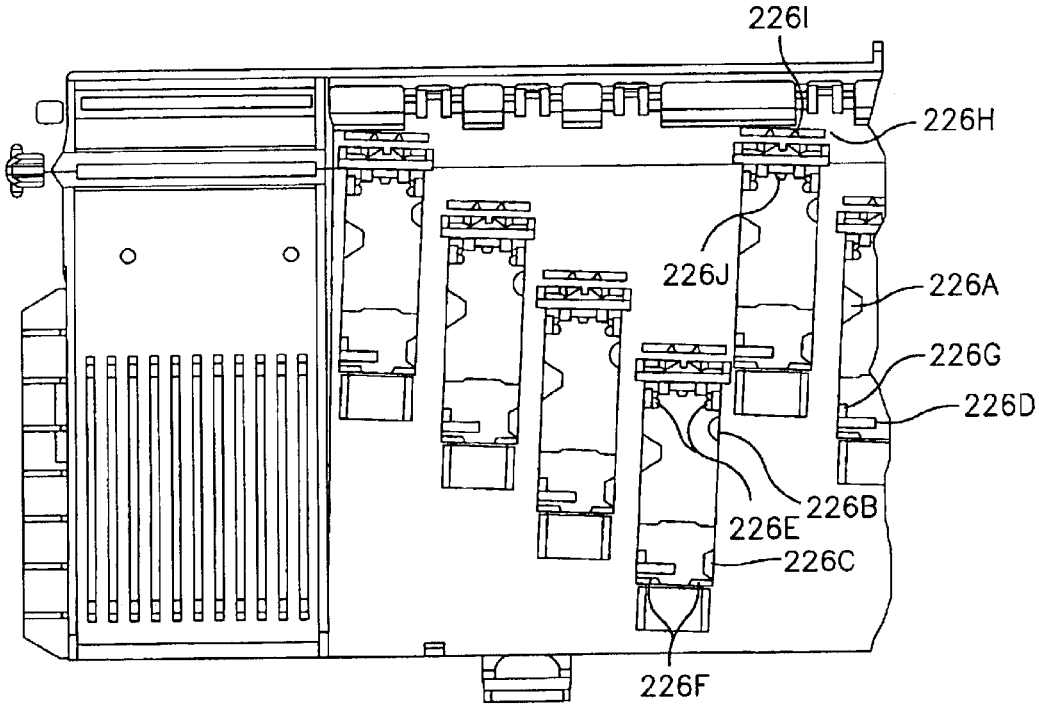
FIG. 8B is a top plan view of a portion of penholder assembly 221 and pen sockets 226 depicting in detail some of the structural and functional elements thereof.
Figure 10:
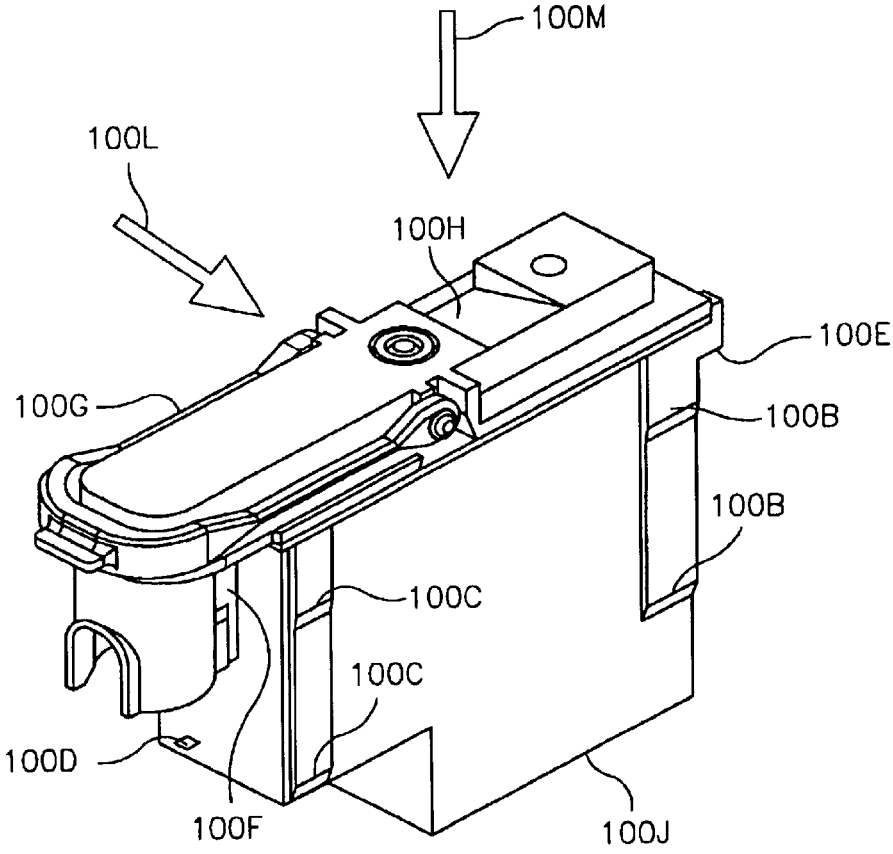
FIG. 10 is a perspective view of inkjet print cartridge 100 depicting in detail some of the structural and functional members thereof for positioning it within pen socket 227 and the fluid interconnect portion.

Part of the utility of preferred carriage assembly 22 relates directly to the ease of installing an inkjet print cartridge 100 in pen socket 226, an operation that can result in a mis-aligned inkjet print cartridge 100. To physically fix the print cartridge 100 in pen socket 226 in a known position, and to assist the accurate placement of print cartridge 100 therein, a discrete set of supporting structural features is employed. Referring now to FIGS. 8A and 8B, features 226A through 226G correspond to structural features 100A through 100G of inkjet print cartridge 100 (FIG. 10). Initial alignment for cartridge insertion is based on a simple tongue-and-groove style coupling, wherein cartridge structure at 100F forms a grooved portion and socket structure at 226F forms a tongued portion. Alignment structure 226B, 226C and 226E provide means for fixing in a predetermined position and orientation an inkjet print cartridge 100. As inkjet print cartridge 100 is inserted into pen socket 226 a side bias-force 100L is applied by socket leaf-spring 226A that urges inkjet print cartridge 100 toward a pair of precisely located datum features 226B and 226C. Datum features 226B and 226C correspond in operable communication with similarly precise structure 100B and 100C of preferred inkjet print cartridge 100. Datum feature 226D corresponds in operable communication with similarly precise cartridge structure 100D, but a vertical downward bias force 100M is applied by bias-spring 222A (FIG. 11) at cartridge structure 100H, when penholder cover 222 is set to the closed position. Penholder cover 222 presents integral bias-spring 222A situated in, and formed from, penholder cover 222. Conical end-member 222B at the distal end of bias-spring 222A, effects an interference at cartridge structure 100H, creating a downward vertical biasing force of about 5 lbs. to about 8 lbs. when penholder cover 222 is set to the closed position at clasp 222C (see FIG. 6). Simultaneously, clasp 222C acts in concert with conical end-member 222B to transmit forward (negative Y) lateral biasing force from flexure of top cover 222 to cartridge structure at 100H. In a preferred embodiment, penholder cover 222 is designed to span an entire one bank of four pen sockets 226. Hence, when penholder cover 222 is set to the closed position at clasp 222C, downward and lateral biasing forces are preferably disposed to a discrete set of four inkjet print cartridges 100 (n.b., a bank of four cartridges). In the preferred embodiments, socket leaf-spring 226A and bias-spring 222A each may be an integrally molded member, or each may be discreet components rather than an integrally molded member, or each may be a discreet component supporting an integrally molded member.

Referring now to FIG. 9 describing the means of effecting electrical inteconnection between inkjet print cartridge 100 and print-head controller 234, a distal end portion of flex-circuit 227 is threaded through aperture 226H located behind pen socket 226. It is supported by two post members 226I at apertures 227A (see FIG. 13) and returned through the main opening of pen socket 226. Flex-circuit 227 turns on and is freely supported by the bottom portion of spring-block 230 and front portion of rubber pad 232 (see FIG. 12), thereafter being affixed by hook member 226J at aperture 227B. Post members 2261 and hook members 226J cooperate to retain flex-circuit 227 during fabrication of penholder assembly 220, as well as during removal and replacement of inkjet print cartridge 100. Referring now to FIG. 12, depicting a mechanical means in support of the electrical interconnection to inkjet print cartridge 100, two compression springs 228 are affixed to integral spring mounting studs (not shown) formed on the backside of spring-block 230. Spring-block 230 has a pair of pin journals 230A formed at the sides that engage pin member portions of alignment structure 226E formed within pen socket 226 that serve as complementary fascia during assembly and self-adjustment during operation. When spring-block 230 is fitted into pen socket 226, journals 230A engage pin member portions 226E. Compression springs 228, operatively disposed within pen socket 226, freely engage sprocket back wall 226K to urge spring-block 230 into retention with pin member portions 226L at pin journals 230A. Spring-block 230 has a receiving portion 230B formed therein which receives a resilient rubber pad 232. Rubber pad 232 preferably has a set of bosses that correspond to electrical contacts on the flex-circuit 227 and similarly disposed electrical contacts of preferred inkjet print cartridge 100. In concerted action, compression springs 228, spring-block 230 and rubber pad 232 distribute biasing force against the electrical contacts of flex-circuit 227, urging mating connection with the electrical contacts of inkjet print cartridge 100. Electrical interconnection and signal communication is thereby effected between inkjet print cartridge 100 installed in, and operatively retained by, pen socket 226 and print-head controller 234, residing in carriage assembly 22.

Figure 11A:
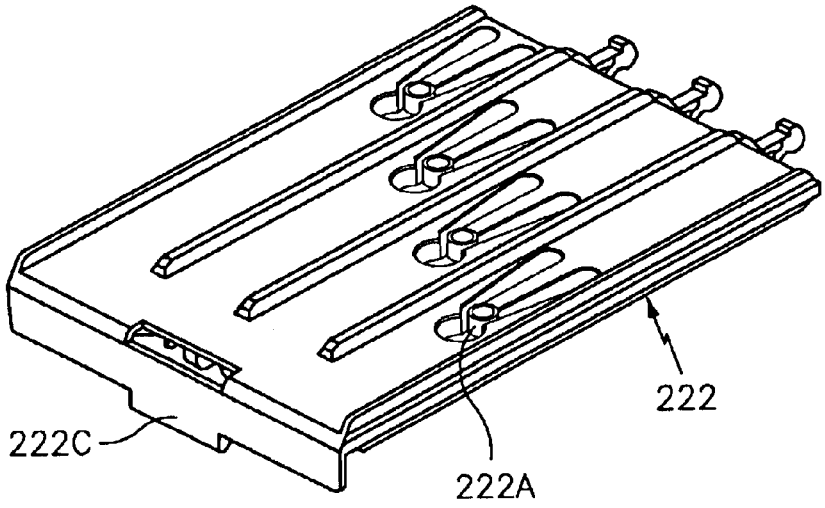
FIG. 11A is a top perspective view of penholder cover 222.
Figure 11B:
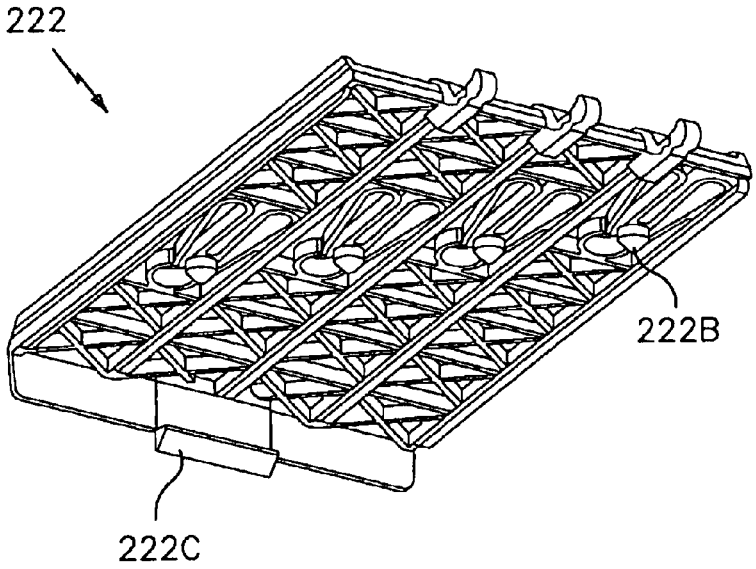
FIG. 11B is a bottom perspective view of penholder cover 222.

Referring now to FIG. 11, a first preferred embodiment of inkjet print cartridge 100 is a 600 dpi thermal inkjet print cartridge having 524 ink-emitting jet nozzles and an 18 kHz maximum firing rate. A second preferred embodiment of inkjet print cartridge 100 is a 1200 dpi thermal inkjet print cartridge very similar to the first preferred embodiment, but having instead a 9 kHz maximum firing rate. Each said first and second preferred embodiment of inkjet print cartridge 100 is capable of providing a 1-inch wide or wider strip or "swath" of printed image area in a single printing scan, or "pass" of carriage assembly 22. Each said first and second preferred embodiment of inkjet print cartridge 100 also incorporates specific elements of design and construction such that the internal hydrodynamic pressure of inkjet print cartridge 100 is not affected by carriage motion. The preferred inkjet print cartridge 100 for use with the present invention is manufactured by Hewlett-Packard Company of Palo Alto, Calif., and is known as the "Tarzan" cartridge (Model HP-80). The Hewlett-Packard HP-80 inkjet print cartridge is described in various U.S. and foreign patents, including, but not limited to, U.S. Pat. Nos. 5,278,584, 5,541,629, 5,563,642, 5,619,236, 5,638,101, 5,648,804, 5,648,805, 5,648,806 and 5,650,811, each herein incorporated by reference in its entirety.

As described and taught in the patents herein referenced and incorporated, preferred inkjet print cartridge 100 provides a 1-inch wide printing swath and 18 kHz maximum firing rate in 600 dpi print resolution. These capabilities enable a maximum printing speed several times faster than prior art 600 dpi inkjet print cartridges. For example, in the previous art a set of twelve 600 dpi inkjet print cartridges firing at a maximum rate of 8 kHz and disposed in a prior art penholder having 12 serially staggered cartridge positions might reasonably provide a maximum output speed of 240 square feet per hour in quality print mode. This conventional printing speed is attainable using 3 sets of CMYK inkjet print cartridges in a prior art penholder having 12 serial cartridge positions, further employing a multi-pass print mode wherein three passes of the carriage assembly are required to completely cover a 1-inch strip of the pixel grid. In addition, employing no jetting nozzle substitution means would be used. By comparison, preferred inkjet print cartridge 100 disposed in a penholder of the present invention, firing at a maximum rate of 18 kHz in 600 dpi print resolution, provides a maximum output speed of about 720 square feet per hour under the same conditions.

Figure 16:
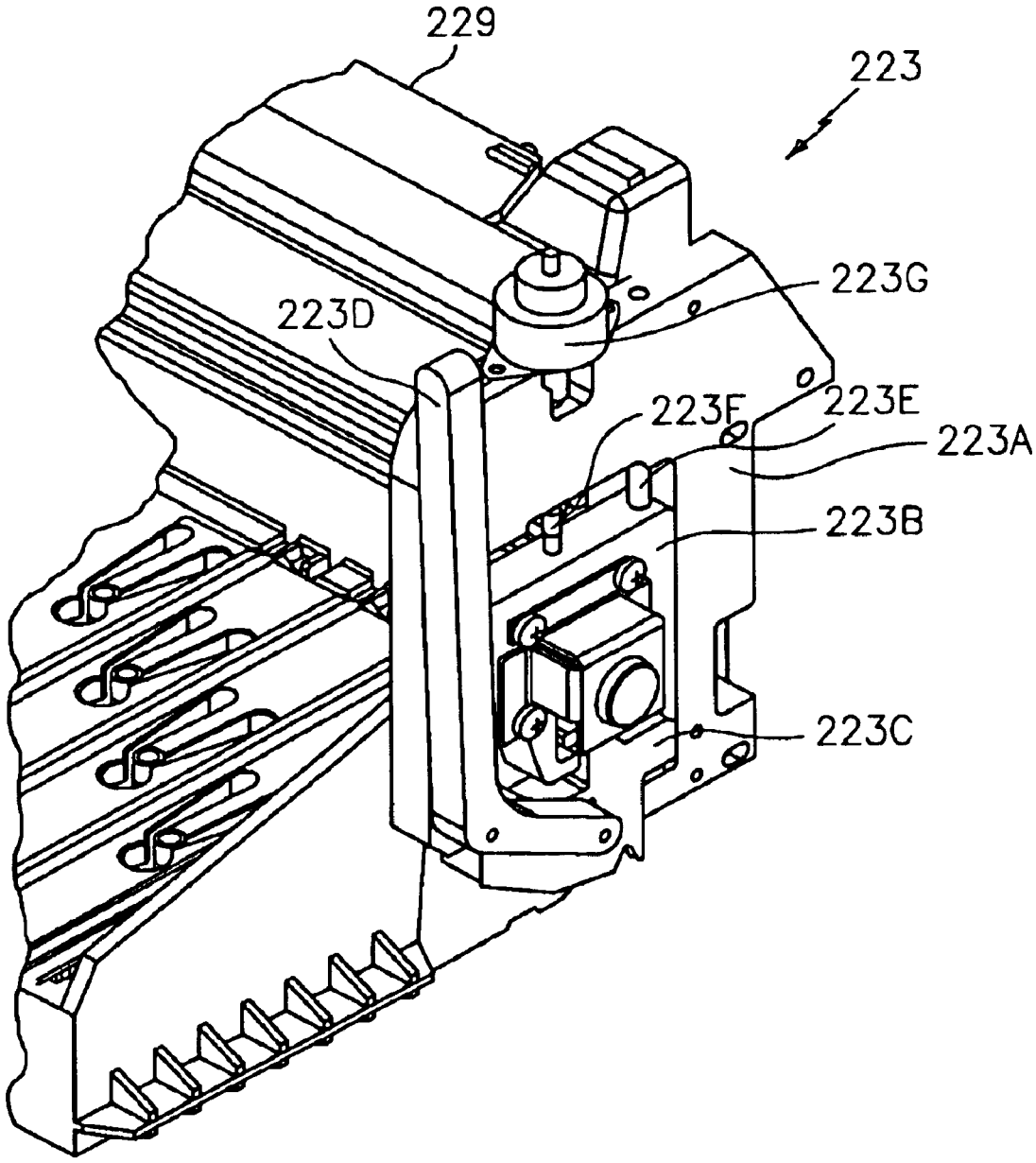
FIG. 16 is a perspective view of the head-height adjuster assembly 223 wherein penholder assembly 220 is adjustable along an axis perpendicular to the axis of travel.

Referring to FIG. 16, preferred head-height adjuster assembly 223 includes a main block 223A, transfer block 223B, release block 223C, release handle 223D, transfer shafts 223E, axial screw 223F, and stepper motor 223G. One head-height adjuster assembly 223 is disposed at each end of penholder assembly 220 and operatively couples penholder assembly 220 with trolley assembly 229 (see FIG. 15). Dual head-height adjuster assemblies 223 in concerted action provide up to 0.25 inches of vertical (X-axis) travel to allow an operator of inkjet printer 10 freedom to select different types and thickness of print media 90A to be used in print engine 10. Print media 90A might include coated paper, paper-backed fabric, posterboard, vinyl, or other such inkjet print media well known to practitioners of the art.

In operation, head-height adjustment is effected automatically when a new media is loaded into print engine 10. Media sensor assembly 66 senses the presence of a print medium 90A when it is positioned beneath sensor arm 662 (see FIG. 30) and communicates a thickness value to printing control system 32. In a preferred embodiment, printing control system 32 performs a calculation of the optimal head-height setting for the type of print medium 90A selected, the type of ink selected, and the printing speed selected, based on a preset head-height value determined from a factory calibration setting. Printing control system 32 stores in internal non-volatile memory the calculated head-height position data corresponding to a thickness—or type—of media for later referral by the operator when the same or similar media is again loaded into print engine 10. Printing control system 32 then transmits head-height position data to on-carriage print-head controller 234, which converts it to an analog control signal for energizing stepper motor 223G to turn a required number of steps. Stepper motor 223G armature drives axial screw 223F, which is operatively coupled to transfer block 223B. Transfer block 223B operatively engages and is guided by transfer shafts 223E, thus effecting translational motion of penholder assembly 220 along the Z-axis normal to axial screw 223F while stepper motor 223G remains energized, until the required head-height position is attained. Accordingly, the entire penholder assembly 220 and subordinate parts—including penholder base 221, inkjet print cartridges 100, flex-circuits 227, and image sensor assembly 224—move in unison as components of a single assembly without resulting in additional wear, stress or interference from component parts. The service loop 227F formed in flex-circuit 227 (see FIG. 15) is sufficient to accommodate the relatively small translational movement of penholder assembly 220. In the preferred embodiment, a hard-stop is operatively engaged after a total vertical (X-axis) travel of approximately 0.25 inch, although an increased travel range can be designed without departing from the teaching herein.

Referring now to FIG. 15, trolley assembly 229 incorporates trolley plate 229A, trolley wheels 229C, encoder-reader assembly 225, and print-head controller 234. In a preferred embodiment, trolley plate 229A is supported on rail member 240 via a plurality of trolley wheels 229C that operatively engage a tread surfaces 240A, 240B, 240C to restrict trolley plate 229A to one degree of freedom along the Y-axis of travel. Trolley plate 229A reciprocates on rail member 240 in response to driving force transmitted from carriage drive assembly 34 by a drive belt 344 under signal control from printing control system 32 (see FIG. 2). Head-height adjuster assemblies 223 rigidly attach to trolley plate 229A at main block 223A (FIG. 16). Penholder assembly 220 rigidly attaches to head-height adjuster assemblies 223 at transfer block 223B. Accordingly, penholder assembly 220 operatively engages trolley plate 229A via head-height adjuster assemblies 223 such that trolley plate 229A remains vertically fixed on rail member 240 while penholder assembly 220 may be raised or lowered in response to operation of head-height adjuster assembly 223. Encoder-reader assembly 225 monitors the position of carriage assembly 22 along the Y-axis of travel by sensing indicia of a high-resolution encoder strip mounted to rail member 240, thus providing position data for carriage assembly 22 to print-head controller 234.

Figure 17:
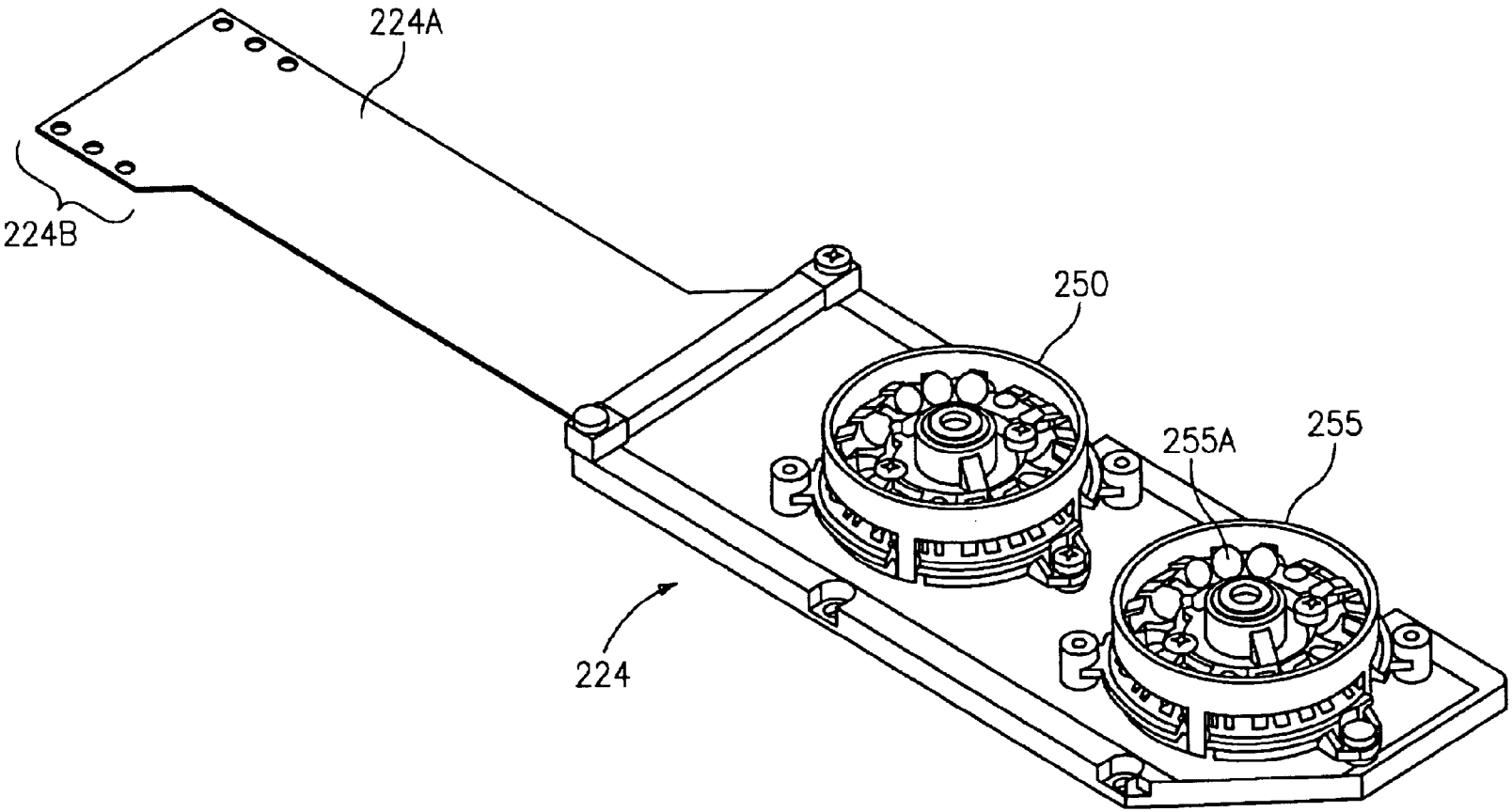
FIG. 17 is a perspective view of the improved image sensor assembly 224 wherein the apparatus disposes an image camera 250 and color-metric sensor 255 within scanning carriage assembly 22.

Referring now to FIG. 17, an on-carriage image sensor assembly 224 provides means to automatically measure and compensate for print cartridge 100 print-head position inaccuracy, jetting nozzle failure, and chromatic variation in the printed image quality. Improved image sensor assembly 224 includes image camera 250, a digital camera with a 640×480 pixel array and optical quality lens that provides a full field-of-view with low distortion. The improved image camera 250 captures and transmits information about performance test images and color sample charts to printing control system 32. This information is used to perform a series of calibrations to compensate for misfiring and failed jets, print-head misalignment, inconsistency in the interval spacing of encoder strip indicia, variation in dot placement accuracy for pixel locations serviced by different jetting nozzles, and media advance inaccuracy. Each of these performance checks and compensatory calibrations can be performed on-demand by an operator or at a scheduled interval chosen by an operator.

Image camera 250 provides several benefits over prior art image sensor systems by equipping print engine 10 of the present invention with means to more fully exploit the speed and resolution of preferred inkjet print cartridge 100. Image camera 250 is faster than prior art devices, which used a monochrome CCD camera with 244×324 pixel array. This prior art solution has proven inadequate for use in preferred print engine 10 due to its slowness and low resolution. Prior art CCD cameras have a restricted field-of-view and can obtain only 5 pixel rows of sample data when performing image quality tests such as dot placement accuracy, media advance accuracy, failed or misfiring jetting nozzles, and the like. This restriction produces a limited data set of only 3.5 pixels of sample data per colored dot at 600 DPI print resolution. Consequently, performing printer calibration routines using the small data sample was a slow process and resulted in significant delays in preparing a print engine for high-quality printing. The improved image camera 250 employs a fast CMOS device that provides 7.5 pixels of sample data per dot at 600 dpi and 15 pixels per dot at 1200 dpi print resolution for much faster calibration of print engine performance. The increased resolution allows preferred print engine 10 to perform some print quality tests on-the-fly and to correct for deficiencies and errors as quickly as they are detected.

Image sensor assembly 224 includes color-metric sensor 255, a high-speed chromatically-tuned photodiode used to monitor and correct for variations in color accuracy and consistency. Color-metric sensor 255 is a color measurement device similar to stand-alone equipment often used in color service bureau's to check the color accuracy of printed materials. Used as an on-board color measurement device, improved color-metric sensor 255 leverages the processing power and internal memory of printing control system 32 to perform color calibration (e.g., needed during start-up and when new inks or media are loaded into the printer), color correction and color characterization. In operation, preferred print engine 10 prints a number of standard color charts containing an array of printed colors of various hues. After the color charts are dry, preferred print engine 10 drives carriage assembly 22 through a sequence of incremental motions, wherein color-metric sensor 255 illuminates each color sample in a color chart with colored light from red, green and blue light-emitting diodes 255A. Color-metric sensor 255 acquires the sample color data and transmits it to printing control system 32, where it is used to correct for measured deficiencies or inconsistency in color accuracy. One benefit of an on-board color-metric sensor 255 is in providing the ability to perform fast, automatic color characterizations and transform data for new types of media for use in preferred print engine 10. This eliminates a time-consuming and tedious task as performed by an operator of prior art print engines.

Color metric sensor 255 eliminates the need for an off-board or stand-alone color measurement device. Further, preferred image camera 250 is capable of performing some tests and checks during printing operation, providing means for the printing control system 32 to continually monitor print quality and automatically compensate for deficiencies as quickly as they are detected. This capability, in turn, provides a welcome benefit of greater latitude in performing unattended printing, since an operator of preferred print engine 10 might enjoy greater confidence in the quality of printed output therefrom. Additionally, the image sensor can be used to characterize the interaction of a particular set of process ink colors with a particular media, since the photodiode is an accurate measurement tool of chromatic constituents. This capability, in turn, allows rapid and efficiency characterization of new types of media installed in the printer, without requiring recourse to an external color-metric device or apparatus.

Ink-Delivery Assembly

The ink delivery assembly of the present invention provides the following inventive features: 1) Means to continuously resupply ink during printing operation from an off-carriage ink reservoir 120 to a preferred inkjet print cartridge 100 to maximize the useful life of the print cartridge. 2) Means to separately replace individual components of an ink delivery assembly—including inkjet print cartridge 100, ink supply tube 110, and ink reservoir 120—to maximize the useful life of those components. 3) Means to enable an operator to quickly and easily change from one set of inks, or a combination of process ink colors, or one or more ink types, to another. 4) Means to advantageously record and report the operating status of an inkjet print cartridge prior to use, including such data as ink color, ink usage, failed jet nozzles, and so forth. 5) Means to record and store data relating to various operating parameters of an ink delivery system, such as ink type, ink color, and quantity remaining in a roving non-volatile memory.

FIGS. 18 through 25 depict an exemplary ink delivery system 40 that can be used with the large-format inkjet print engine 10 of the present invention. As shown, ink delivery assembly 40 includes a gravity-feed, sealed fluid system including inkjet print cartridge 100, ink supply tube 110 and ink reservoir 120. Preferred inkjet print cartridge 100 (FIG. 5) is an integrated, sealed assembly closed to atmosphere and filled with a first quantity of ink (not shown). Inkjet print cartridge 100 includes inlet port 102 to operatively supply a second quantity of ink from an external source 120, primer port 101 to establish or re-establish fluid communication (prime) from the external ink source 120, and cartridge memory 103 (see FIG. 4B) to record various data specific to a given one print cartridge 100 in non-volatile memory. The preferred embodiments of inkjet print cartridge 100 incorporates these specific elements of design and construction, in addition to others as described herein and elsewhere in this specification.

Figure 19C:
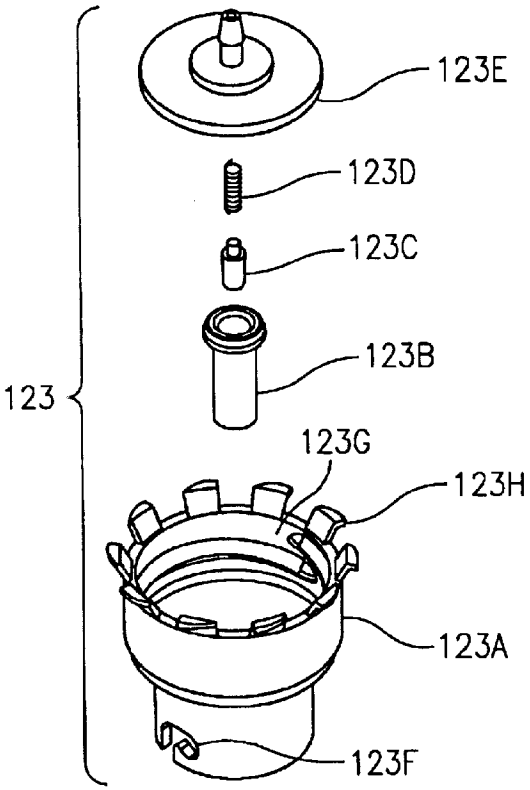
FIG. 19C is an exploded view that depicts the internal components of the exemplary ink bag connector 123 disposed on one embodiment of preferred ink reservoir 120 assembly.
Figure 19B:
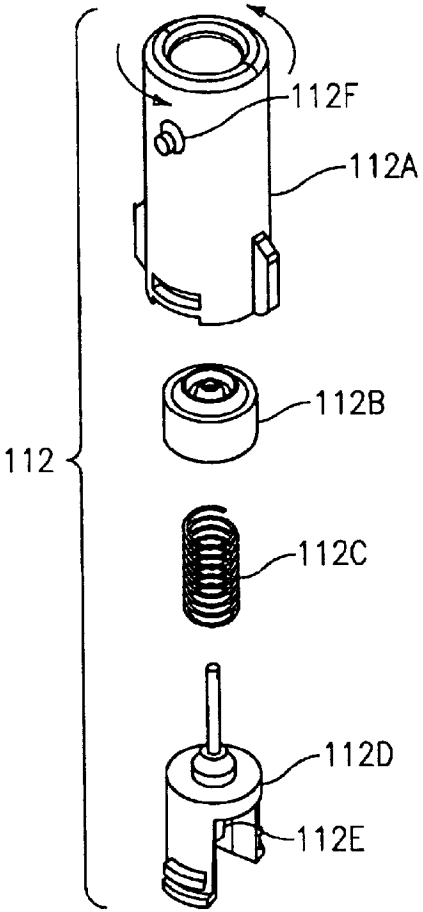
FIGS. 19A and 19B are exploded views that depict the internal components of the exemplary fluid connectors 111, 112 disposed on the ink supply tube 110 assembly.
Figure 19A:
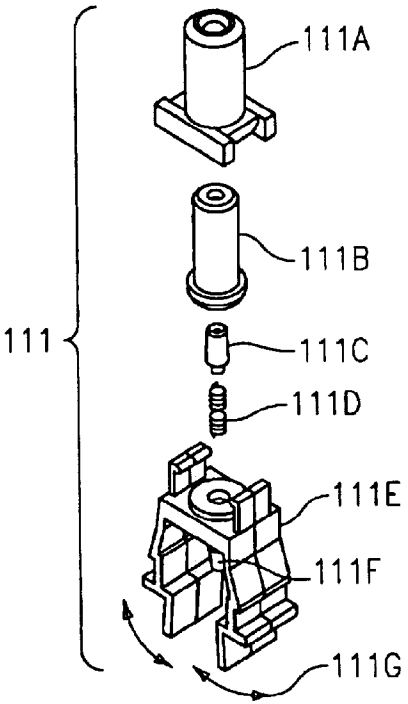

Ink supply tube 110 includes print cartridge fluid connector 111, ink reservoir connector 112, and ink tube 113. Referring now to FIG. 19A, print cartridge fluid connector 111 is an unbound assemblage of parts including seal housing 111A, ink seal 111B, seal plug 111C, plug spring 111D and latching clip 111E. Preferably, tube fixture 111F is a formed member of latching clip 111E. Referring now to FIG. 19B, ink reservoir connector 112 is an unbound assemblage of parts including housing 112A, ink seal 112B, seal spring 112C and tube valve 112D. Preferably, tube fixture 112E is a formed member of tube valve 112D. Preferably, ink tube 113 is poly-vinyl tubing hermetically connected to tube fixtures 111F and 112E. Preferably, tube fixture 111F is a formed member of latching clip 111E. Referring now to FIG. 19C, ink bag connector 123 is an unbound assemblage of parts including housing 123A, ink seal 123B, seal plug 123C, plug spring 123D, and fixture plate 123E.

Figure 23:
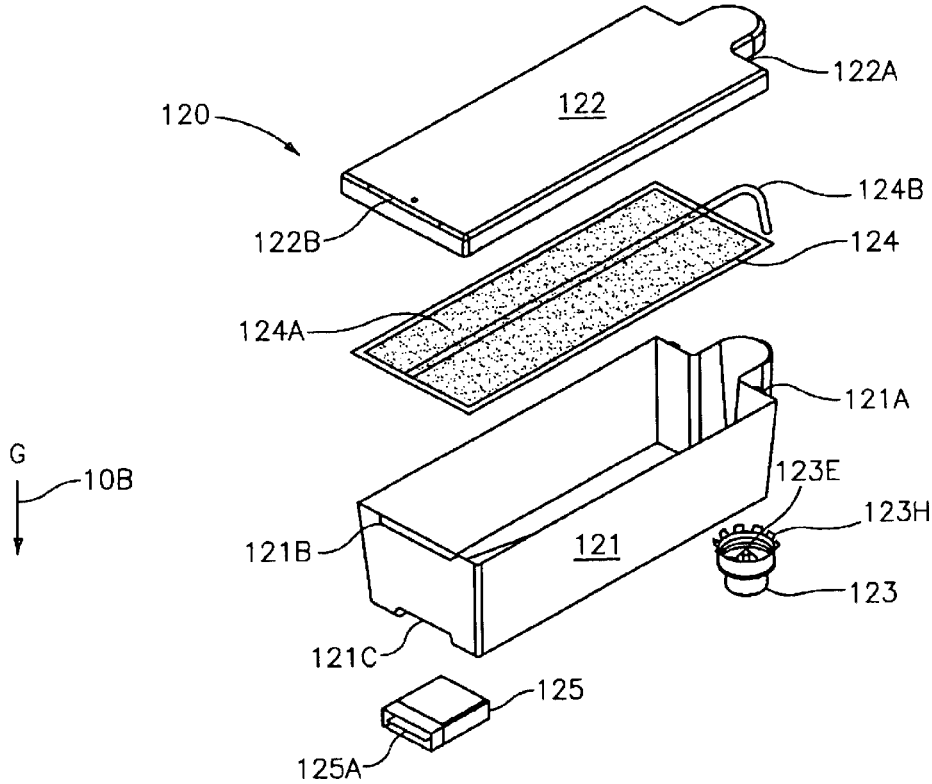
FIG. 23 is an exploded perspective view of an exemplary ink reservoir 120 that depicts the ink box 121, top cover 122, ink bag connector 123, ink bag 124 and ink profiler 125 memory device.

Referring now to FIGS. 18 and 23, ink reservoir 120 is a bound assemblage of parts including ink box 121, top cover 122, ink bag connector 123, ink bag 124, and ink profiler 125 memory device. Ink box 121 is preferably a hard-shell plastic case containing and supporting ink bag 124 and fully enclosed by top cover 122. Ink bag 124 is preferably composed of pliable, high-barrier polyethylene film filled with a volume of ink constituting a second quantity of ink to supply inkjet print cartridge 100. Ink bag 124 reposes in fluid communication with ink bag connector 123 via bag fitting 124A, ink tube 124B and fixture plate 123E. In assembly, ink bag 124 is placed in ink box 121 and filled with ink via ink tube 124B, which is then hermetically connected to ink bag connector 123 at fixture plate 123E. Ink bag connector 123 includes internal threads 123G and locking tabs 123H that operatively engage corresponding features of ink box 121 to permanently affix ink bag connector 123 to ink box 121. Top cover 122 includes cover slots 122A and 122B that are fitted onto corresponding box tabs 121A and 121B to secure ink bag 124 inside ink box 121 and the assembly is sealed with adhesive or similar means. Ink profiler 125 memory device is detachably affixed to receiving portion 121C.

In operation, when the ink delivery assembly 40 of the present invention is first installed in print engine 10, the operator undertakes a series of operations to prepare it for use. For example, in an exemplary embodiment, the operator installs a set of inkjet print cartridges 100 in pen sockets 226 of penholder assembly 220 (see FIG. 6). A "set" of inkjet print cartridges as defined elsewhere in this specification may comprise as few as four and as many as twelve cartridges. In a preferred embodiment, inkjet print cartridge 100 is installed simply by loosely locating it within pen socket 226 and pressing downward until it stops, indicating by tactile feedback that the cartridge has been seated in its socket. In another preferred embodiment, penholder assembly 220 may include a spring-actuated latch or detent (not shown) that activates when cartridge 100 is properly installed in pen socket 226 and provides a tactile or audible indication to the operator. Color-coded labels on inkjet print cartridge 100 and on penholder assembly 220 ensure the proper color of print cartridge 100 is inserted into the correct pen socket 226 location. In a preferred first embodiment, the operator receives inkjet print cartridges 100 filled with ink and ready for use in print engine 10. In another embodiment, the operator receives empty inkjet print cartridges that are primed with ink prior to use by means described in detail elsewhere in this specification. Such may be the case as when, for example, an inkjet print cartridge 100 fails in operation and has to be replaced.

Figure 20:
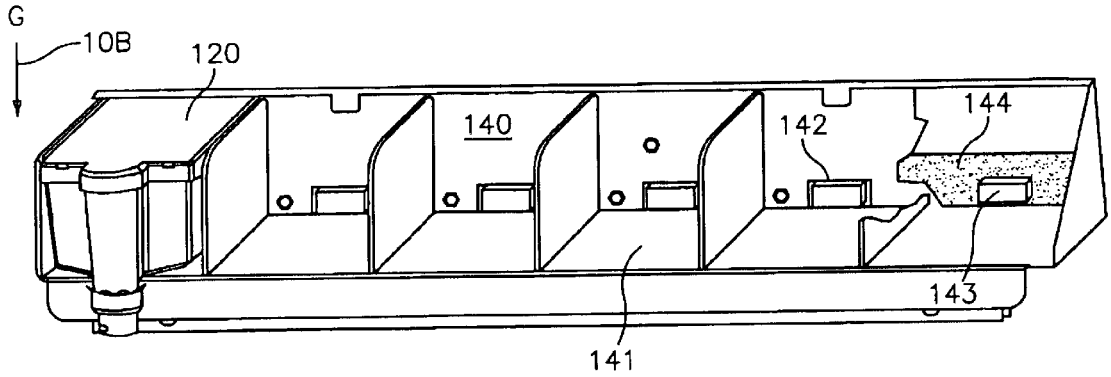
FIG. 20 is a perspective view of preferred ink reservoir 120 installed on an exemplary ink tray 140 with a cutaway view that depicts a memory bus board 144 and slot connectors 143 for receiving an ink profiler 125 memory device detachably affixed to ink reservoir 120.

Referring now to FIG. 20, once a set of inkjet print cartridges 100 are installed in penholder assembly 220, the operator turns to the next step in preparing ink delivery assembly 40 for use; namely, installing a corresponding set of ink reservoirs 120 in an ink tray 140. In a preferred first embodiment, the operator installs ink reservoir 120 in ink tray 140 simply by placing it in its respective tray location 141 and pressing backwards until it stops. As shown in FIG. 18, ink reservoir 120 is equipped with ink profiler 125, which is detachably affixed to ink box 121. Referring again to FIG. 20, as ink reservoir 120 is pressed backwards by an operator, ink profiler 125 passes through tray aperture 142 and connector tang 125A is urged against and inserted into matching slot connector 143 on memory bus board 144. Color-coded labels on ink reservoir 120 and on ink tray 140 ensure the proper color ink reservoir 120 is placed in its respective tray location 141 in ink tray 140. In a preferred embodiment, the operator receives ink reservoir 120 filled with ink and ready for use in print engine 10.

Figure 21B:
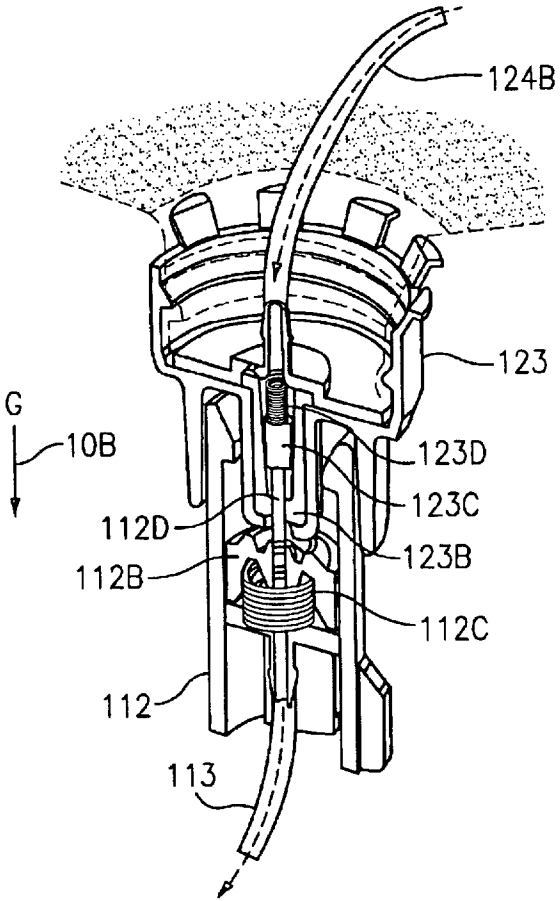
FIG. 21B is a cutaway side view of the ink bag connector 123 and its mating ink supply tube connector 112 that depicts the connectors in the engaged position and the displacement of internal components thereof.
Figure 21A:
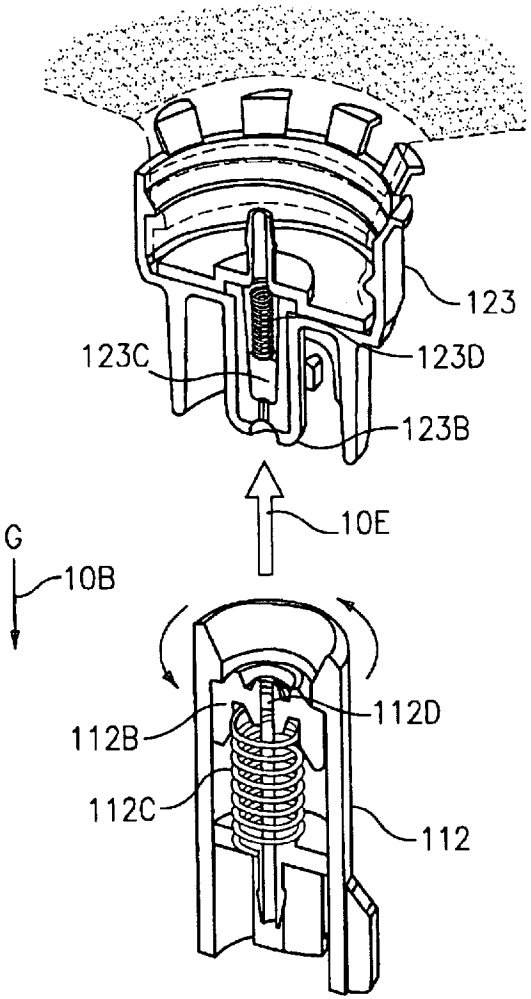
FIG. 21A is a cutaway side view of the ink bag connector 123 and its mating ink supply tube connector 112 that depicts the connectors in the unengaged position.

Referring now to FIGS. 21A and 21B, the operator turns to the next step in preparing ink delivery assembly 40; namely, installing the corresponding set of ink supply tubes 110. In a preferred embodiment, the operator receives ink supply tube 110 empty of ink and without designation as to color. Hence, any previously unused ink supply tube 110 may be employed to establish fluid connection between any ink reservoir 120 and any inkjet print cartridge 100. In this embodiment, the operator detachably connects ink supply tube 110 to ink reservoir 120 by first aligning pin portion 112F of ink reservoir connector 112 to slot portion 123F of ink bag connector 123 (see FIG. 19C). Fluid connector 112 is inserted into the ink bag connector 123 as indicated by arrow 10E with sufficient force to overcome the resistance of internal springs. Fluid connector 112 is then rotated counterclockwise to lock it into place. As shown in FIGS. 21A and 21B, this action displaces ink seal 112B and compresses seal spring 112C to expose the shaft portion of tube valve 112D, which penetrates ink seal 123B, displaces seal plug 123C and compresses plug spring 123D. Tube valve 112D is a hollow member with a pair of apertures formed through the shaft walls which allow ink to flow from ink bag 124 via ink tube 124B through ink bag connector 123 and ink reservoir connector 112 and into ink tube 113.

Figure 24:
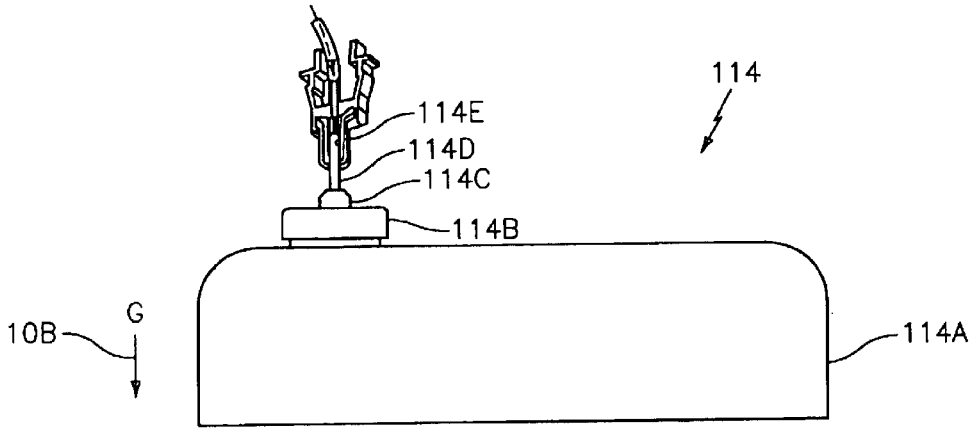
FIG. 24 is a perspective view of one embodiment of preferred primer basin 114 and fluid connector 111 shown in the engaged position for priming operation of ink supply tube 110.

Referring now to FIG. 24, the operator turns to the next step in preparing ink delivery assembly 40; namely, purging ink supply tubes 110 of air and simultaneously filling them with ink. In a preferred first embodiment, print engine 10 includes purge basin 114 disposed at maintenance location 17 (see FIG. 1A). Purge basin 114 includes a hard-shell plastic container 114A that is open to atmosphere and enclosed by cap 114B having a formed aperture 114C and needle valve 114D. In this embodiment, the operator detachably connects ink supply tube 110 to purge basin 114 by pressing the free end of print cartridge fluid connector 111 onto needle valve 114D. This action causes needle valve 114D to penetrate ink seal 111B, displace seal plug 111C and compress plug spring 111D. Needle valve 114D is a hollow member with a pair of apertures 114E formed through the shaft wall that allows air entrapped in ink tube 113 to flow into plastic container 114A, and hence to atmosphere via aperture 114C in cap 114B. Ink from ink bag 124 is impelled by gravity through ink tube 113, by consequent action thereby purging entrapped air to atmosphere and simultaneously filling ink tube 113 with ink.

Once ink tube 113 is completely filled with ink, the operator simply removes print cartridge fluid connector 111 from purge basin 114, causing ink supply tube 110 instantly to reseal by reverse action of print cartridge fluid connector 111. The operator may then apply color-coded labels provided with ink supply tubes 110 to designate the color and type of ink in ink tube 113. Plastic container 114A captures any waste ink that might escape ink supply tube 110 and pass through needle valve 114D during the purging and filling operation just described. Preferably, the volume of plastic container 114A is sufficient to accommodate many such purge-and-fill operations without requiring removal and disposal or emptying of purge basin 114 by the operator of print engine 10.

In a preferred second embodiment, purge basin 114 is a freestanding assembly that incorporates a plastic bottle (not shown) having approximately the same volume as plastic container 114A and similar in embodiment except that it is a stand-alone unit. This embodiment provides convenient means for the operator to purge-and-fill ink supply tubes 110 that are currently installed and captured by tube routing connectors 464 at various locations on print engine 10 (see FIG. 6). As will be immediately apparent, this second preferred embodiment will perform in exactly the same way as the first preferred embodiment just described, except for the minor differences noted.

Figure 22B:
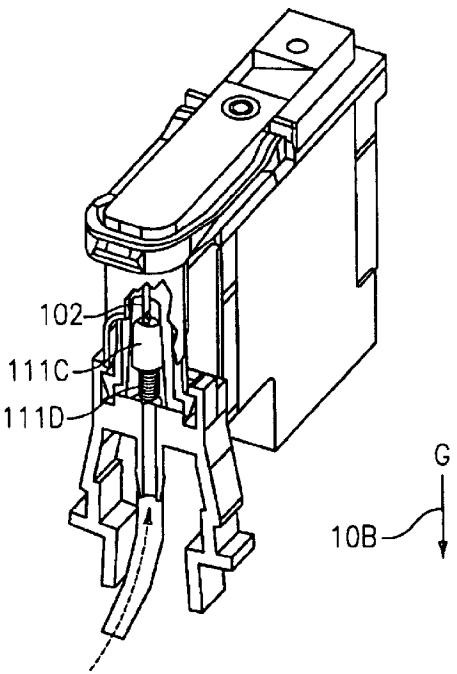
FIG. 22B is a cutaway view of the ink inlet port 102 of the inkjet print cartridge 100 and a cutaway side view of its mating fluid connector 111 that depicts the connector in the engaged position and the displacement of internal components thereof.
Figure 22A:
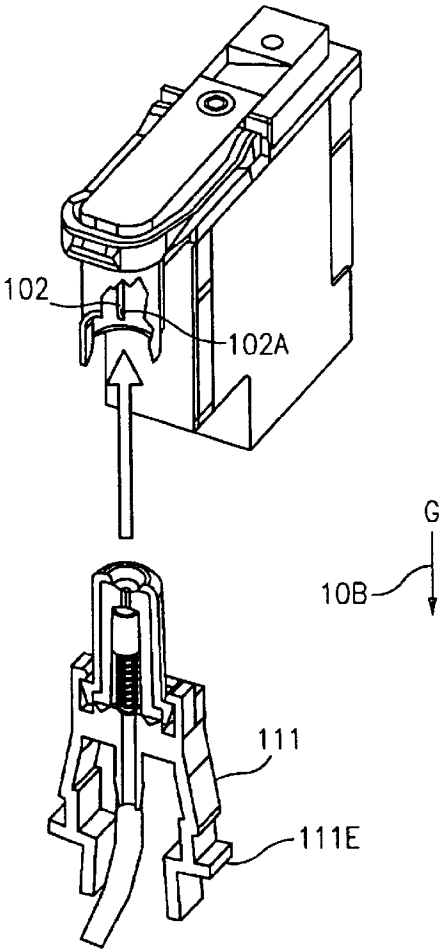
FIG. 22A is a cutaway view of the ink inlet port 102 of the inkjet print cartridge 100 and a cutaway side view of its mating fluid connector 111 that depicts the connector in the unengaged position.

Referring now to FIGS. 22A and 22B, the operator turns to the next step in preparing ink delivery assembly 40 for use; namely, fluid connection between ink reservoir 120 and inkjet print cartridge 100. In a preferred first embodiment, carriage assembly 20 includes penholder assembly 220 (see FIG. 7). Penholder assembly 220 articulates through 85 degrees of rotation, permitting the operator ready access to the underside of penholder base 221. In this preferred embodiment, the operator connects ink supply tube 110 to inkjet print cartridge 100 by coupling print cartridge fluid connector 111 onto print cartridge inlet port 102. This action causes inlet port 102 to penetrate ink seal 111B, displace seal plug 111C and compress plug spring 111D. Inlet port 102 is a hollow member with a pair of apertures 102A formed through the shaft wall that provide means for ink in ink tube 113 to flow into the interior of inkjet print cartridge 100. Latching clip 111E detachably engages corresponding features of pen socket 226 (see FIG. 7) at location 226A to hold print cartridge fluid connector 111 in fixed position and to maintain on-going fluid communication with inkjet print cartridge 100.

As will be appreciated by those skilled in the art, inkjet print cartridge 100 may require a manual priming operation from time-to-time to draw ink from ink supply tubes 110 into inkjet print cartridge 100, thereby to re-establish fluid communication between inkjet print cartridge 100 and ink reservoir 120. This requirement may result from a number of circumstances. For example, leaving print engine 10 idle for long periods resulting in evaporation of volatile constituents within ink supply tube 113, gas exchange over time between ink delivery assembly 40 and the surrounding atmosphere, rapid changes in atmospheric pressure, and the like. Hence, a primer pump 130 is provided with print engine 10 for use by the operator to re-establish fluid communication in ink delivery assembly 40, as necessary.

Figure 25:
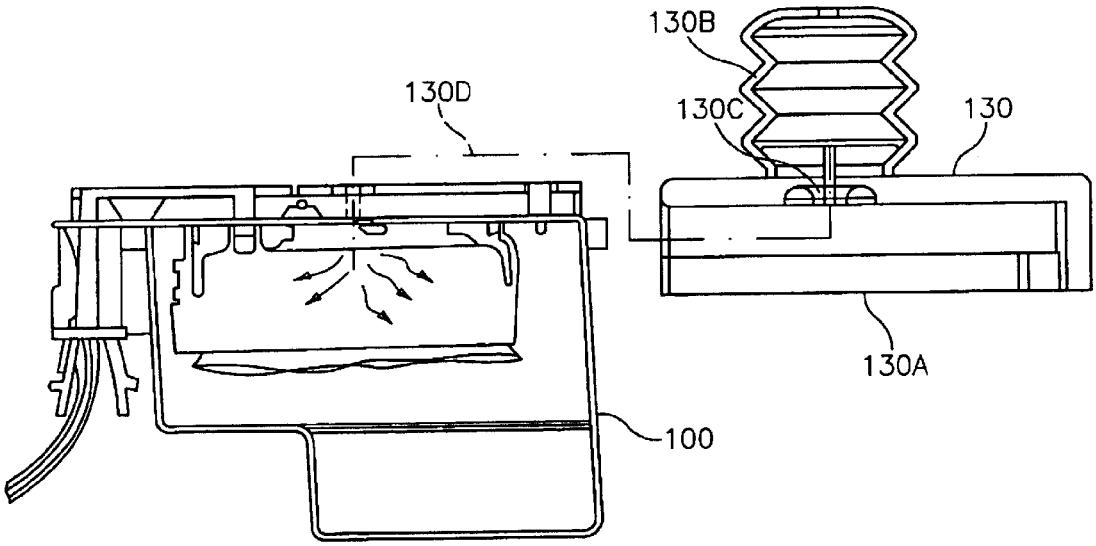
FIG. 25 is a cutaway view of preferred inkjet print cartridge 100 and cutaway view of a manual cartridge primer 130 shown in the unengaged position.

Referring now to FIG. 25, a preferred embodiment of primer pump 130 includes a manual primer pump including a cartridge collar 130A and pneumatic pump 130B. This simple two-part construction provides a primer pump that is both reliable and inexpensive. Cartridge collar 130A detachably engages inkjet print cartridge 100 by sliding over an upper portion of print cartridge 100. Pneumatic pump 130B is preferably a bellows-type rubber boot that encloses a small volume of air sufficient to activate an internal mechanism (not described) in inkjet print cartridge 100 to draw ink. Preferably, pneumatic pump 130B is permanently affixed to cartridge collar 130 by aperture bushing 130C that is press-fit into a receiving orifice of pneumatic pump 130B. When cartridge collar 130 is fully engaged with inkjet print cartridge 100, pneumatic pump 130B and aperture bushing 130C are operatively positioned along an axis intersecting primer port 101 indicated by dotted line 130D. By compressing pneumatic pump 130B a volume of air is forced into inkjet print cartridge 100, which activates an internal mechanism to draw ink from ink supply tube 110 into an internal cavity within inkjet print cartridge 100 that contains a first quantity of ink, as previously described.

Referring once again to FIG. 18, in the preferred embodiment of ink delivery assembly 40, inkjet print cartridge 100, ink supply tube 110, and ink reservoir 120 may be removed and replaced separately. Hence, when a new or replacement component is needed, the operator can install each such component in much the same way as described above. Alternatively, these components can be replaced as a single unit.

Service Station Assembly

The service station assembly of the present invention provides the following inventive features: 1) Means to automatically accommodate variations in the head height position of preferred carriage assembly 28 without requiring operator intervention. 2) Means compliantly performs wiping and capping service routines while maintaining optimum spacing between a preferred inkjet print cartridge 100 disposed in the penholder assembly.

Figure 26:
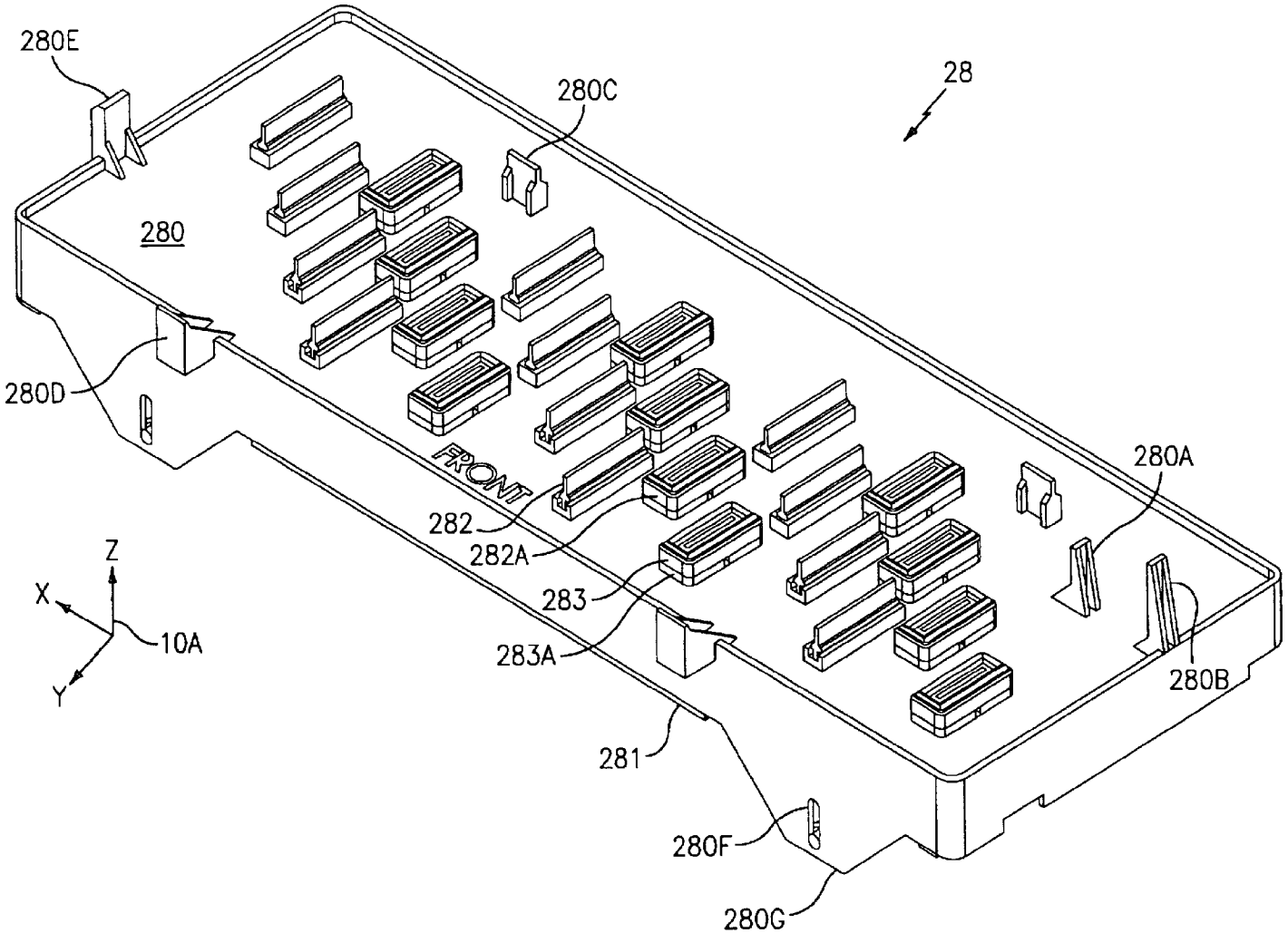
FIG. 26 is a perspective view of preferred service station assembly 28 of the present invention depicting the unitary module design and tightly packed configuration of wiper blades and capping boots in three orthogonal banks of four staggered components each corresponding to a similar configuration for penholder assembly 220.
Figure 27:
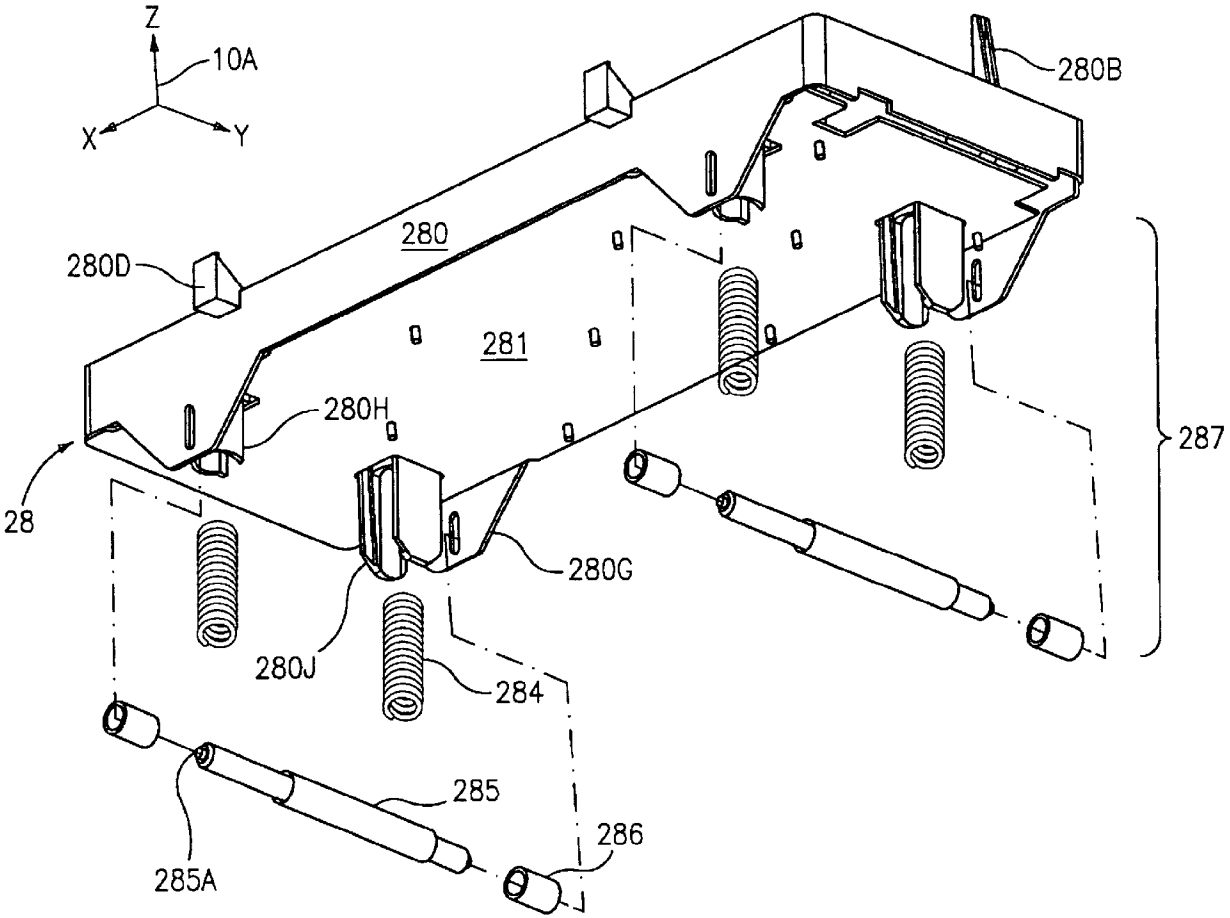
FIG. 27 is a lower perspective exploded view of preferred service station assembly 28 depicting the cam roller 287 components and the integral mounting features of the base frame 280 for the cam rollers 287.

The present invention is described primarily with reference to FIG. 26 and FIG. 27, wherein a perspective view of a preferred embodiment of service station assembly 28 is depicted. As shown, service station 28 is designed to accommodate the novel configuration of carriage assembly 22 and penholder assembly 220 (FIG. 6) embodied in three orthogonal banks of four staggered inkjet print cartridges 100 each. As shown in FIGS. 26 and 27, service station assembly 28 preferably includes a solderless assembly with a minimum of moving parts including base frame 280, stiffener plate 281, wiper blade 282, capping boot 283, cam spring 284, cam shaft 285, and roller bearing 286. Base plate 280 is preferably a formed-resin member including wiping actuator 280A, capping actuator 280B, two pairs of positioning tabs 280C and 280D, and return actuator 280E. Cam roller 287 is an unbound assemblage of parts including cam springs 284, cam shaft 285, and roller bearings 286. Cam springs 284 are operatively disposed in spring wells 280H and 280J, which together with shaft 285 and roller bearings 286 are captured without fasteners by shaft pin 285A residing in fitting slot 280F in frame tab 280G.

Referring now to FIG. 3, service station assembly 28 is operatively disposed in printer assembly 20 proximate a printing zone 15 (see FIG. 1B). Service station assembly 28 preferably resides in tray well 260A conveniently located at one end of platen assembly 26 (see FIG. 3), or maintenance station 17 (see FIG. 1A), for ready access by the operator of print engine 10. Tray well 260A is sized appropriately to permit limited travel along the X- and Z-axes and to restrict travel along the Y-axis. Platen member 260 preferably includes at least two internal cam guides 260B and 260C (best seen in FIG. 3), which are internal structural walls formed during extrusion of platen member 260 and subsequently machined with complex surface geometry as shown in FIGS. 28A through 28D. Service station assembly 28 resides in tray well 260A detachably coupled to cam guides 260B and 260C via cam rollers 287. Thus, the elevation (Z-axis) and lateral (Y-axis) position of service station 28 is fixed by at least two primary datum surfaces of platen member 260 at several positions along the complex geometry of cam guides 260B and 260C. This ensures the proper vertical and horizontal alignments of service station 28 relative to carriage assembly 22. Additionally, when service station 28 is installed in tray well 260A, a space allowance above service station assembly 28 ensures carriage assembly 22 can mechanically actuate service station 28, as well as reciprocate in place to wipe debris and ink from orifice plate during the wiping service routine.

Inherent in this design, the automatic head-height adjuster assembly 223 of carriage assembly 22 requires compliance by service station assembly 28 to accommodate variations in the vertical position of penholder assembly 220 at the time a wiping or capping service routine is performed. Hence, the present invention had to solve problems associated with, among other things, service location tolerances, wiping pressures, capping pressures, ink evaporation rates, and the like. In addition, the present invention had to account for fundamental design criteria such as the tolerance stack-up budget for all related components.

By way of example, concerns with regard to the maximum allowable number of non-critical alignments led to one preferred embodiment wherein the design of every component remains within a tolerance budget. In this way, it was discovered that the potential for critical misalignment could be reduced or eliminated, since the opportunity to introduce variations in alignments between co-operating assemblies during fabrication of component parts could be eliminated and/or reduced.

Also by way of example, a variety of experimental spring force measurements that apply to wiping as few as four, or as many as 12, inkjet print cartridges 100 in a single service operation inspired the development of various novel solutions incorporated in the present invention. In designing an embodiment of a service station 28 that compliantly adapts to variations in the carriage head-height position, a number of different design solutions are possible. For example, it is possible to program the control system to always drive the carriage to a known location before it accesses the maintenance station for service or when parking the heads. However, while this solution is inexpensive to implement it would slow the print engine output speed considerably.

Thus, in a preferred embodiment, carriage assembly 22 transmits a driving force to service station 28 by engaging more than one actuating member (c.f., actuators 280A and 280B) to effect a complex axial and vertical lateral motion of service station 28 in concert with action of carriage assembly 22. Also in a preferred embodiment, two cam rollers 287 engage cam guides 260B and 260C to guide service station assembly 28 to four distinct locations (see FIGS. 28A through 28D) in effecting wiping and capping service routines: a home location, a wiping location, a clearance location, and a capping location.

Referring now to FIG. 26, service station assembly 28 supports formed-resin wiper blades 282 operatively disposed in blade channels 282A and capping boots 283 operatively disposed in boot mounts 283A of base frame 280. As is known in the art, service station assembly 28 operates to perform wiping and capping service routines of the nozzle plate 100J of preferred inkjet print cartridge 100 (see FIG. 4A) to ensure the jetting nozzles 100K operate properly and perform within specification. Wiping service is performed as wiper blades 282 pass across nozzle plate 100J of print cartridge 100, thereby removing any debris or residual ink therefrom. Capping service is performed as capping boots 283 are urged into sealing contact with nozzle plates 100J, thereby enclosing and protecting the jetting nozzles 100K and preventing ink from plugging the jet nozzles 100K through drying or contamination. The locations and operable dispositions of wiper blades 282 and capping boots 283 are preferably configured to match the configuration of inkjet print cartridges 100 residing in preferred penholder assembly 220. In a preferred embodiment, the service station includes a unitary design and tightly packed configuration of wiper blades 282 and capping boots 283 in three orthogonal banks of four staggered components each.

Figure 28A:
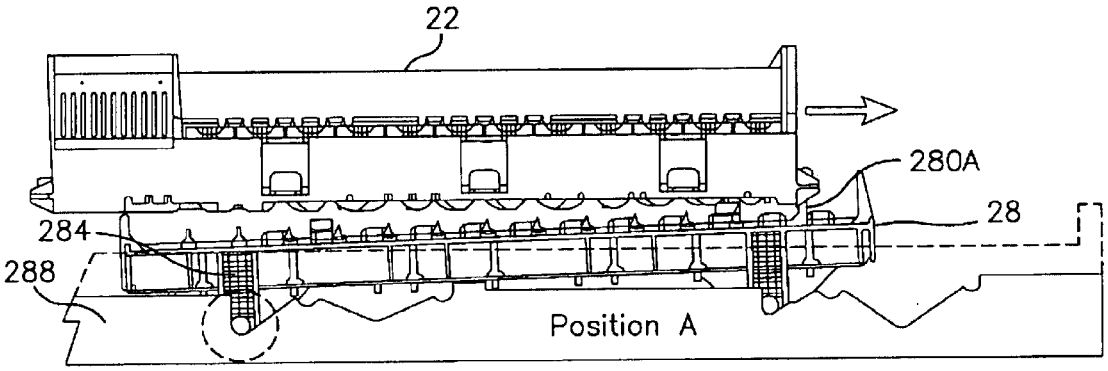
FIGS. 28A through 28D are a time-series of frontal views depicting the interaction of preferred carriage assembly 22 and preferred service station assembly 28 during service operation.

Service station 28 functions to perform wiping and capping service routines by passively receiving driving force from carriage assembly 22, which visits the maintenance station 17 location at intervals under control of printing control system 32. Referring now to FIGS. 28A through 28D, a time-series of elevation side views depicts the complex surface geometry of cam guides 260B and 260C and the operating positions of service station 28 during wiping and capping service routines. Referring now to FIG. 28A, penholder assembly 220 travels in a negative-X direction under control of printing control system 32 during a maintenance interval. Service station assembly 28 resides in its initial home position, with cam rollers 287 at rest in locations 288 and articulated −1.5 degrees counterclockwise (CCW) to the horizontal plane. As carriage assembly 22 proceeds into the maintenance station 17, the exterior wall of penholder assembly 220 engages wiping actuator 280A, thereby transmitting driving force from carriage assembly 22 to service station assembly 28.

Figure 28B:
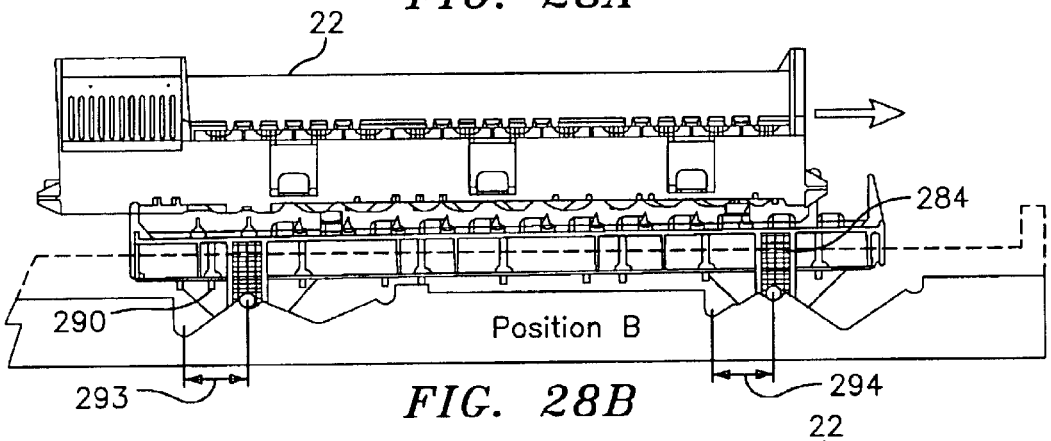

As shown in the next diagram, FIG. 28B, service station assembly 28 is driven from its home position to its wiping position along the slope angles of cam guides 260B and 260C at locations 293 and 294. Travel along cam guides 260B and 260C is effected and guided by cam rollers 287, which, compliantly with the complex surface geometry thereof, displaces and elevates service station assembly 28 to a new rest position at locations 290. The difference in the slope angles of cam guides 260B and 260C at locations 293 and 294 also effects a slight clockwise articulation of service station 28 of approximately +1.5 degrees to a position normal to the horizontal plane as service station 28 comes to rest at locations 290. At the same time, two pairs of lateral and elevation datum features, namely positioning tabs 280C and 280D, operatively engage with receiving members 221X and 221Y disposed in penholder assembly 220 (see FIG. 7). These datum features, tabs 280C and 280D, so engaged, effect optimal lateral positioning and elevation spacing between penholder assembly 220 and service station assembly 28 so that an operationally efficient and accurate wiping service routine may be performed. In particular, the elevation of penholder assembly 220 in relation to service station 28 is such that a small area of interference is created between the uppermost portion of wiper blades 282 and the lowermost portion of inkjet print cartridges 100.

It will be appreciated that cam springs 284 serve multiple purposes: 1) They automatically adjust the elevation of service station assembly 28 to compensate for variations in the carnage head-height position. 2) They maintain optimum spacing between the nozzle plates 100J of inkjet print cartridges 100 disposed in penholder assembly 200 and wiper blades 282 residing on service station assembly 28 by retaining positioning tabs 280C and 280D into receiving members 221X and 221Y. 3) They accommodate slight differences in the complex geometry of cam guides 260B and 260C.

Referring now to FIG. 26, positioning tabs 280C and 280D present top-edge blade portions that permit low-friction sliding engagement with slot portions of receiving members 221X and 221Y (see FIG. 7) across an operational carriage wiping travel of approximately 1-inch. Thus, in the wiping location, service station 28 is held suspended between receiving members 221X and 221Y of penholder assembly 220 and cam rollers 287, allowing carriage assembly 22 to perform the actual wiping service routine by reciprocating motion of approximately +/−0.5 inches. This action causes nozzle plates 100J of inkjet print cartridges 100 to pass through the areas of interference with wiper blades 282, which are composed of resin-based material, such as latex rubber, that permit the blades to yield slightly and wipe the nozzle plate free of debris and residual ink. In a preferred embodiment of wiper blade 282, the top portion presents a thin flat surface with corresponding shoulders that serve as separate wiping edges. Hence, the wiping service routine may be performed in either the positive-X or negative-X directions, or both, and thus may be efficiently performed by the reciprocating motion of carriage assembly 22. The minimum number of reciprocating cycles of carriage assembly 22 needed to completely clean nozzle plates 100J is used to advantageously restrict the time required to perform a wiping service routine. As will be understood by those skilled in the art, the geometry of the notches in cam guides 260B and 260C at locations 290 is sufficient to hold captive service station 28 in spring-loaded suspension against carriage assembly 22 during the reciprocating cycles of carriage assembly 22.

Figure 28C:
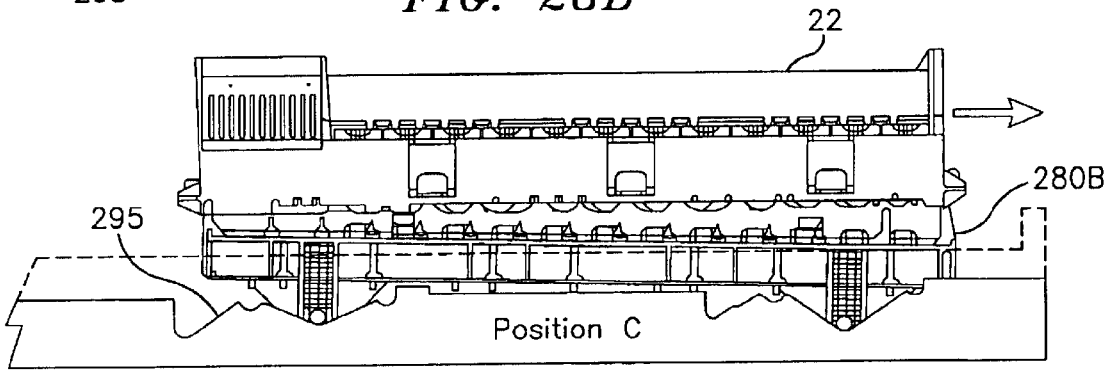

As shown in the next diagram, FIG. 28C, service station assembly 28 is driven from its wiping location to its clearance location along the slope angles of cam guides 260B and 260C at locations 295. As before, travel along cam guides 260B and 260C is effected and guided by cam rollers 287, compliantly with the complex surface geometry shown, displacing and lowering service station assembly 28 to a new rest position at locations 295. The difference in the slope angles of cam guides 260B and 260C at locations 295 also effects a slight clockwise articulation of service station 28 of approximately +1.5 degrees normal to the horizontal plane. This articulation provides clearance between penholder assembly 220 and wiping actuator 280A, thereby permitting penholder assembly 220 to pass over wiping actuator 280A and instead engage capping actuator 280B. At the same time, positioning tabs 280C and 280D also are cleared from engagement with receiving members 221X and 221Y in penholder assembly 220.

Figure 28D:
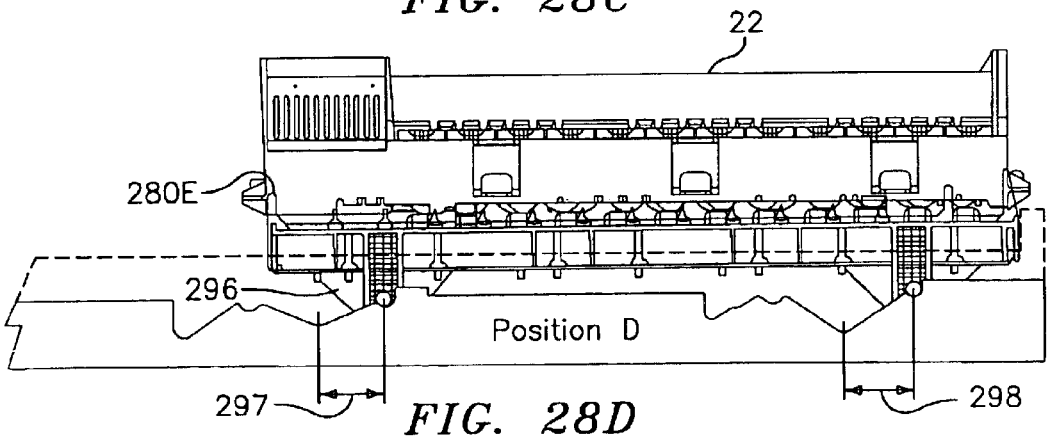

As shown in the next diagram, FIG. 28D, carriage assembly 22 proceeds along its line of travel causing the exterior wall of penholder assembly 220 to operatively engage capping actuator 280B, again transmitting driving force from carriage assembly 22 to service station assembly 28. Service station assembly 28 is driven from its clearance location to its capping location along the slope angles of cam guides 260B and 260C at locations 297 and 298 to a new rest position at locations 296. The difference in the slope angles of cam guides 260B and 260C at locations 297 and 298 also effects a slight counter-clockwise (CCW) articulation of service station 28 of approximately −1.5 degrees to a position normal to the horizontal plane as service station 28 comes to rest at locations 296. At the same time, the higher elevation of locations 296 brings capping boots 283 of service station 28 into engagement with nozzles plates 100J of inkjet print cartridges 100, thus effecting capping service routine.

When next carriage assembly 22 is needed for printing operation, it proceeds in reverse direction (positive-X) away from maintenance station 17 and toward printing zone 15, thereby engaging return actuator 280E and returning service station 28 to its home location by the reverse path.

Media Handling System

The media handling system of the present invention provides the following inventive features: 1) Means to control web-tension across the supply portion of a print medium 90A. Means to measure media thickness and communicate thickness data to the printing control system 32 to perform automatic adjustment of the carriage head-height position. 2) Means to record in non-volatile memory the measured media thickness and to automatically recall the carriage head-height position adjustment for any similar type of media. 3) Means to measure the amount of a print medium 90A used and to store in non-volatile memory a record of the remaining portion of a print medium 90A available on a media roll 90. 4) Means to record on the unused portion of a media roll 90 a record of the remaining print medium 90A available, as well as the media type and other useful information, for future reference by an operator. 5) Means to avoid head-strike conditions due to differences in media thickness, low ambient humidity resulting in media curl, and other conditions.

In the preferred embodiments, the media handling system of the present invention provides media thickness sensing to about 0.0005 inch for print media up to about ¼-inch thick using a high resolution, low-cost media sensor assembly 66. Media thickness data is used by printing control system 32 to automatically adjust the head-height position of penholder assembly 220 above a print medium 90A to optimize the jetting distance between the jetting nozzles 100K and the print medium 90A. Adjusting the head-height position simultaneously serves to avoid head strikes due to differences in media thickness from one print job to the next. The head-height setting for a given media type is stored in non-volatile memory internal to the printing control system 32, where it can be automatically recalled when a print medium 90A is used again. Alternatively, an operator may select stored head-height settings for use in characterizing a new media in the print engine 10.

In addition to automatic head-height adjustment, the printing control system 32 uses media thickness data to control operation of the media handling system so that a print medium 90A is advanced accurately under a constant tension. This is accomplished through the use of a media supply assembly 64 equipped with a mechanical slip-clutch that provides constant tension on the supply side of the media web for more accurate advances. In addition, a closed-loop servomotor with encoder drives media take-up spool 681 and estimates the diameter of the media take-up spool 681 roll diameter to control tension, detect faults and signal failure. Both media spools 641, 681 use steel extrusion to support the required weight of media roll 90 without bending or torsion. Each media spool 641, 681 supports media rolls 90 with either 2-inch or 3-inch inner cores to a maximum diameter of 7 inches and a maximum weight of 60 lbs. The printing control system 32 maintains information about the type of print medium 90A, the roll length, and the media thickness in on-board memory and monitors the amount of a print medium 90A remaining on the media supply roll 90. It uses this data to notify the operator that an inadequate supply of media is available for a requested print job and to record the type of print medium 90A and the amount of media remaining on an unused portion of the roll. This is useful for an operator of print engine 10, since specific information about a media roll 90 is often lost when the packaging is discarded and since it obviously more efficient to use a partial roll of media that is adequate for the intended print job.

Figure 30:
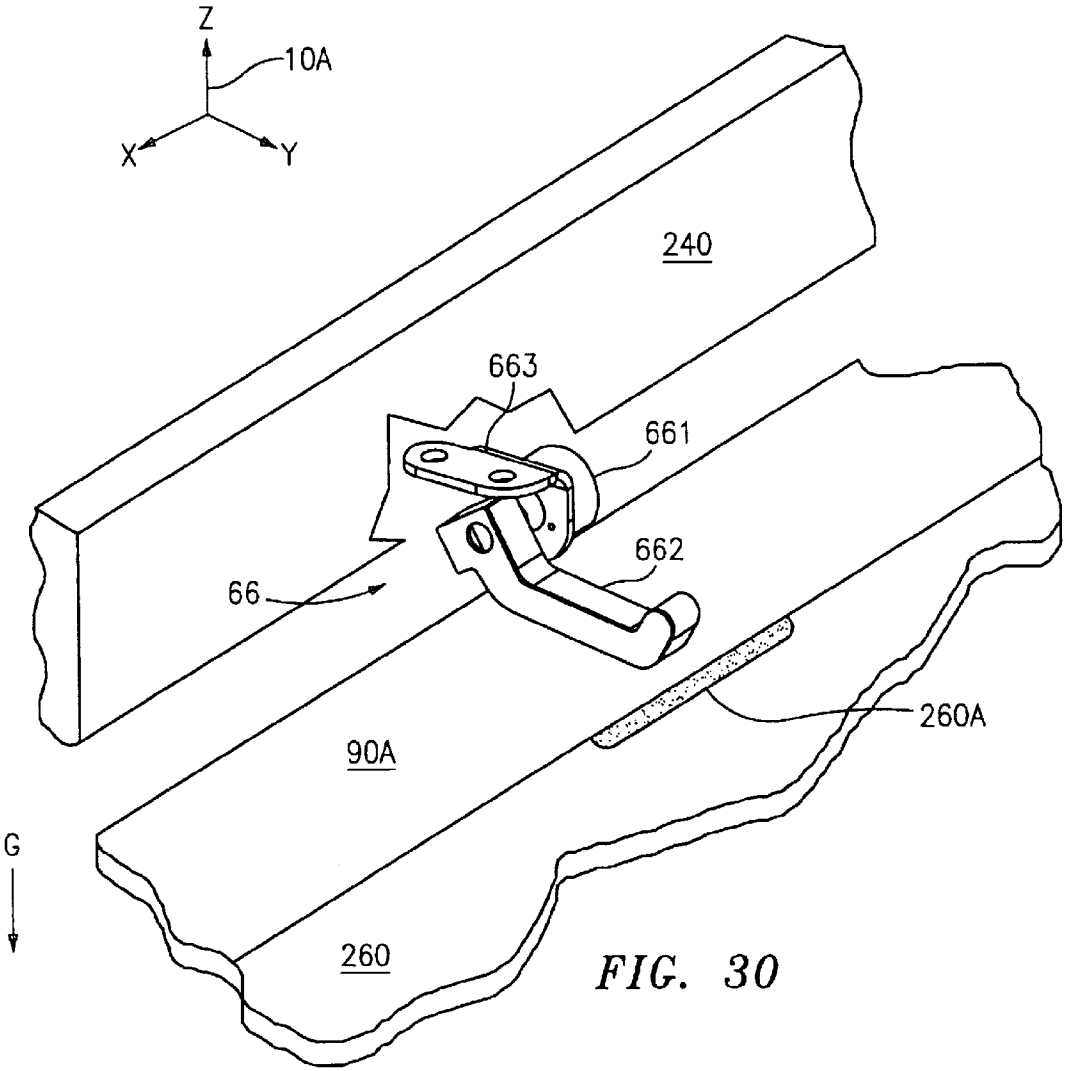
FIG. 30 is a perspective cutaway view of preferred media thickness sensor 66 at its mounting location on rail member 240 and depicting the media 90A and platen member 260.

As shown in FIG. 29 and FIG. 30, the media handling system 60 includes media supply assembly 64, media sensor assembly 66 and media take-up assembly 68. Media supply assembly 64 includes supply spool 641 in operable communication with slip-clutch 642. Media take-up assembly 68 includes take-up spool 681 in operable communication with closed loop servomotor 682. Media sensor assembly 66 includes a high-resolution potentiometer 661, sensor arm 662 and mounting bracket 663 in operable communication with a print medium 90A supplied from media roll 90.

Media handling system 60 begins with media supply spool 641 operatively supporting print media roll 90 (see FIG. 1B). A print medium 90A suitable for use in print engine 10, such as coated paper or fabric, is mounted on media supply spool 641. Its free end is inserted into print zone 15, where it encounters a plurality of drive rollers 386 and corresponding pinch rollers 390 forming a nip point (see FIG. 32). At the same time, as shown in FIG. 30, print medium 90A also encounters sensor arm 662 of media sensor assembly 66, which is raised from its resting position on platen member 260 as the print medium 90A passes under it. Drive rollers 386 are rotated by media drive system 38 which drives print medium 90A into print zone 17 where it is detected by image sensor 224 of carriage assembly 22 and halted in place on the platen member 260 ready for printing operation.

Media drive motor 381 is preferably a high-speed servomotor with an integral rotary optical encoder 382 for position-feedback sensing. The rotary optical encoder 382 provides a resolution of 1000 positions per revolution of the servomotor armature and provides quadrate read-out of the rotary encoder disk, which increases position feedback resolution to 4000 positions per revolution (1000 PPR×4=4000 PPR). Thus, media drive motor 381 provides accurate mechanical positioning of print medium 90A in much the same way as a "stepper" motor. That is, the servomotor produces a known angular rotation by "stepping" from one angular position to another a known number of positional advances as determined from the integral rotary optical encoder 382. By stepping media drive motor 381 a predetermined number of steps using a servomotor, print medium 90A can be accurately advanced a known distance. Moreover, the higher-speed servomotor 381 advances print medium 90A at a much faster rate than conventional stepper motors can achieve.

Referring now to FIG. 3, after a printing operation commences, a portion of print medium 90A passes under media dryer assembly 30 and drying is performed by directing a chaotic flow of heated air over the surface of the printed portion, as is known in the art. An example of prior art in current use is disclose in U.S. patent application Ser. No. 09/251,351 entitled "Improved Convertible Media Dryer for a Large Format Inkjet Print Engine," now U.S. Pat. No. 6,308,626, assigned to the assignee of the present invention and hereby incorporated by reference in its entirety. Referring again to FIG. 29, after a portion of print medium 90A containing a printed image is dried by media dryer assembly 30, it is attached to media take-up spool 681 by the operator of print engine 10 using obvious means such as a low-adhesion tape. Media take-up motor 682 rotates take-up spool 681 in continuous operation and thereby instantly removes any slack in print medium 90A, such that said media stays in continuous and even contact with platen member 260 and in even tension with the plurality of drive rollers 386 and pinch rollers 390.

As previously noted, precise advancement of print medium 90A by drive rollers 386 is dependent upon accurate regulation of the web tension in print medium 90A as it travels past inkjet print cartridges 100 in carriage assembly 22. Specifically, changes in the differential tension across the nip-point of drive rollers 386 and pinch rollers 390 is preferably minimized as print medium 90A is advanced by drive rollers 386 to produce the highest-quality printed images at high rates of speed using preferred inkjet print cartridges 100. Such changes in differential tension can occur, for example, as the quantity of media available from media supply assembly 64 decreases, and the quantity of print medium 90A accumulated on media take-up assembly 68 increases. Print engines of the prior art typically rely on mechanical friction at the spool holders 643 to control web tension of a print medium from the supply spool 641 to the nip-point, as well as open-loop servomotors to control web tension from the nip-point to the take-up spool 681. These conventional techniques are inadequate to effectively control differential tension across the nip-point to the required degree to ensure the highest quality prints. For example, one problem in conventional media handling systems is that frictional back-tension at the supply spool 641 spool holders 643 provides poor control for precise media advance accuracy. Another problem with conventional media handling systems is that open-loop servomotors require torque adjustment to compensate for the increasing weight and diameter of large rolls of printed media 90A on the take-up spool 681.

It will be apparent that applying a constant back-tension across the print medium 90A web from the supply side is one remediating factor in reducing differential tension across the nip-point and thereby improving media advance accuracy. Accordingly, in a preferred embodiment, media supply spool 641 is engaged in operable communication with mechanical slip-clutch 642, a friction mechanism that provides a constant drag of about 2 in-lbs, to about 12 in-lbs. In operation, as a print medium 90A is drawn from media supply spool 641 by drive rollers 386, mechanical slip-clutch 642 resists this action thus creating tension across the supply side of the print media web. HUCO Engineering Industries of San Rafael provide one example of a friction slip-clutch of the type described, but others of similar type and design may be used. This means for controlling the supply-side web tension of a print medium is known in the art and taught, for example, in U.S. Pat. No. 5,751,303 entitled "Printing Medium Management Apparatus," assigned to the assignee of the present invention and hereby incorporated by reference in its entirety.

In another preferred embodiment, take-up drive motor 682 is a closed-loop servomotor with integral encoder that advantageously overcomes limitations inherent in prior art open-loop servomotors by enabling the printing control system 32 to estimate the diameter of the media accumulated on take-up media spool 681. The radius of print medium 90A on take-up spool 681 may be determined by any means known in the art, including counting layers as they are wound onto the spool and multiplying by the known thickness of the print medium 90A, or by using an external sensing device (not shown) to measure the radius.

When printing high quality color images, it is important that a printing control system 32 be able to accurately and consistently produce an image and reproduce the colors contained in the image. However, as previously noted, there are many different types of printing media 90A, which may be used with print engine 10. Different print media 90A have different handling characteristics (e.g., media thickness, stiffness, feed rates, coatings, absorptive effects on color reproduction, etc.) and will react to exposure to heat from the media dryers, different types of ink, and tensioning forces quite differently. The differences between print media characteristics can lead to problems such as banding or other artifacts in the printed image. Therefore, to produce accurate and consistent printed images, it is important that several parameters be known and monitored during the printing process. These parameters include the print media characteristics such as the media type (e.g., coated matte paper, coated glossy paper, translucent film, clear film, vinyl, canvas, etc.), media dimensions, and the amount of the printing medium available to be printed on. The particular print medium characteristics are used in the control of the media speed, the head height position, as well as other printer operations which may be affected by the media characteristics.

To ensure consistent and accurate results, it is desirable to eliminate as many sources of potential error as possible from the printing process. One potential error source is operator error, which may occur when an operator adjusts the print engine 10 to accommodate different print media 90A. It is therefore preferable to reduce as much as possible the frequency of operator intervention to set controls or to select from numerous variables relating to operation of the print engine 10 for a given print medium 90A. To accomplish this goal, it is important that the printing control system 32 be adequately sophisticated to determine the required operating characteristics for a particular print medium 90A, when used in combination with a particular set of ink colors or ink types, and to automatically adjust printing operation accordingly. For example, to accurately reproduce a particular color on two different print media 90A; it may be necessary for the printing control system 32 to adjust the manner in which the ink is placed on the two different media. It may be necessary to make slight adjustments in the amount, or combination, of inks used, the media advance speed may require adjustment, color consistency may need to be monitored with increasing frequency as print cartridges 100 age and begin to fail. For these reasons, it is preferred that print engine 10 be capable of performing adjustments based on the changing conditions of printing operation and without requiring intervention by the operator.

Printing control system 32 is in signal communication with all systems of print engine 10, including height adjuster assembly 223, media advance motor 381, and take-up servomotor 682. In a preferred embodiment, Printing control system 32 includes in on-board non-volatile memory a look-up table with information for each of a plurality of printing media 90A. The operator indicates to printing control system 32 which particular print medium 90A is being supplied to print engine 10, and printing control system 32 then uses information in the look-up table associated with the particular print medium 90A selected to operate print engine 10. For a given print medium 90A, look-up table includes various media characteristics such as the type of media (e.g., coated matte, coated gloss, etc.), media dimensions (e.g., thickness, width, length), and any other information necessary for printing control system 32 to correctly identify the print medium. This data is used by printing control system 32 for multiple purposes to advantageously operate print engine 10, which includes adjusting the head-height position of penholder assembly 220, determining the advance interval for print medium 90A through print engine 10, and estimating the take-up media roll diameter to adjust the advance interval of take-up spool 681.

In a preferred embodiment, lookup table also includes data representing the length of print medium 90A on media roll 90. As printing control system 32 monitors the radius of print medium 90A on take-up spool 681, it also determines the print medium 90A which has been removed from media roll 90 and the portion remaining. The information in look-up table is then updated by printing control system 32. The data in look-up table preferably may be updated continuously, but may be updated at the completion of each print job or at some predetermined period. Print engine 10 may then notify the operator of print engine 10 if inadequate lengths of print medium 90A are available to complete a print job at any given image size or number of copies desired. Additionally, print engine 10 may record on the unused portion of the media roll 90 the type of media and the quantity remaining. This data may be read by the operator of print engine 10 and communicated to printing control system 32 at a later time when the unused portion of a media roll 90 is again placed into service for printing. Alternately, in second preferred embodiment, the data stored in look-up table is recorded on the unused portion of the media roll in a machine-readable form. Any type of text, symbol or glyph that can be read by image sensor assembly 224 can be used, such as bar code, when the media is again placed into service. This enables print engine 10 to automatically perform operating adjustments based on the print medium 90A type without requiring operator intervention.

Concerted action of media supply assembly 64, media sensor assembly 66 and media take-up assembly 68 ensures accurate media advance accuracy during printing operation of about 0.0001 inches. By maintaining the web tension of print medium 90A at near zero on the take-up side while sustaining a continuous drag of about 2–12 in-lb, on the supply side, the differential tension across the nip-point can be held nearly constant. This in turn helps to ensure that variations in the rate of media advance are minimized.

Media Drive System

The media drive system of the present invention provides the following inventive features: 1) Means to accurately transport and precisely position a print medium in a print zone. 2) Means to optimize the response time of a media drive train to effect accurate advances of a print medium within a limited operational window. 3) Means to optimize a media drive train through relative positioning and gear quality selection to minimize error. 4) Means to map the periodic error of a media drive train and store mapping data in a non-volatile control memory. 5) Means to compensate for and counteract the periodic error of a media drive train during printing operation by referencing an error map. 6) Means to optimize media advance accuracy by stabilizing the mediaweb tension.

The improved media drive system of the present invention includes a high-performance media drive train that matches or out-performs the media advance accuracy and cost of manufacture of prior art print engines, while yielding faster response time and generating more low-end torque for faster response times. Each is an important consideration in producing a print engine 10 capable of fully exploiting preferred inkjet print cartridge 100. A faster response time is necessary to accommodate the longer media advances between reciprocating scans of the carriage assembly, due to the greater number of jetting nozzles 100K of preferred inkjet print cartridge 100. Longer media advances also introduce greater potential for positioning error propagated from various mechanical sources, which introduce troublesome banding artifacts into the printed images. These positioning errors can be largely mitigated by increasing the number of nip-points (e.g., grit-roll/pinch-roll pairs) across the media web (see FIG. 31), together with an applied back-tension on the media supply side. But this solution increases the magnitude of combined inertial and frictional forces that resist a fast reaction time. However, these antagonists in turn can be overcome with a media drive train that generates significant low-end torque.

Unfortunately, these requirements are not satisfied by the media drive trains as taught and disclosed in the prior art. Conventional print engines typically use a stepper motor in conjunction with a drive-belt reduction stage, affording a nominal advance accuracy resolution of approximately 5 indicia/pixel. These designs also rely on fewer pairs of nip-rollers across the print zone and eschewed any consideration of an applied back-tension of the media web to the nip-point, since media advance errors that might result in banding artifacts tended to be buried in multi-pass print modes. Moreover, the nozzle plate length of prior art print cartridges supports only half as many jetting nozzles. Consequently, the ink lay-down rate per each reciprocation of the scanning carriage in a multi-pass print mode is only a fraction of that required for preferred print engine 10. Obviously, the media drive trains of the prior art are inadequate to support substituting of an inkjet print cartridge 100 with a similar form but which has twice as many jetting nozzles (i.e., 1048 vs. 524 dpi).

Figure 31:
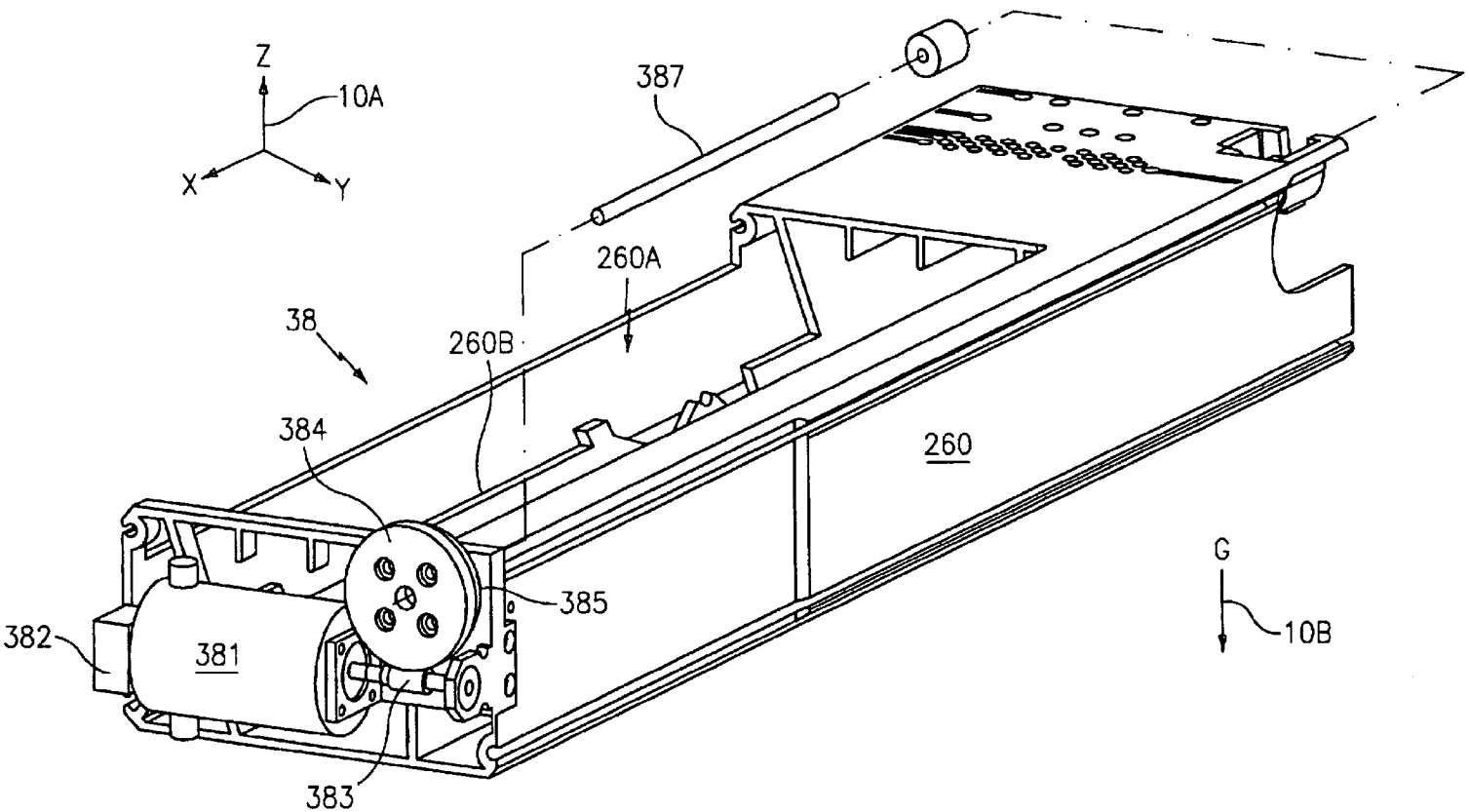
FIG. 31 is a perspective view of the preferred media drive system 38 of the present invention depicting the rotary encoder 382, servomotor 381, reduction gears 383 and 384 and roller drive shaft 387 of the media drive train instant.

The preferred media drive system 38 of the present invention embodies a design that satisfies each of the requirements here mentioned. Referring to FIG. 31, a servomotor 381 with 1000-count rotary encoder 382 engages a dual-pitch worm gear 383 that interfaces with an 80-tooth spur gear 384 effecting a 40:1 gear reduction. The spur gear 384 is rigidly fixed to a media-drive roller shaft 387 which drives a plurality of drive rollers 386 and corresponding pinch rollers 390 to propel a print medium 90A captured at the series of nip-points 10F. The servomotor 381 and worm gear 383 generate more low-end torque than prior art drive systems to overcome the significant back-tension introduced from the supply-side mechanical slip-clutch 642 and additional nip-points, or roller pairs (i.e., 12 versus 6). The media drive system 38 instant matches or exceeds the advance accuracy and cost-of-manufacture of prior art designs but accommodates the much faster print speeds and higher ink lay-down rates needed to fully exploit the benefits inherent in preferred inkjet print cartridge 100. This configuration results in a positioning resolution of about 0.00002 inch and provides a media advance accuracy of about 0.0001 inch for all print media 90A up to about ¼-inch thick.

Figure 32:
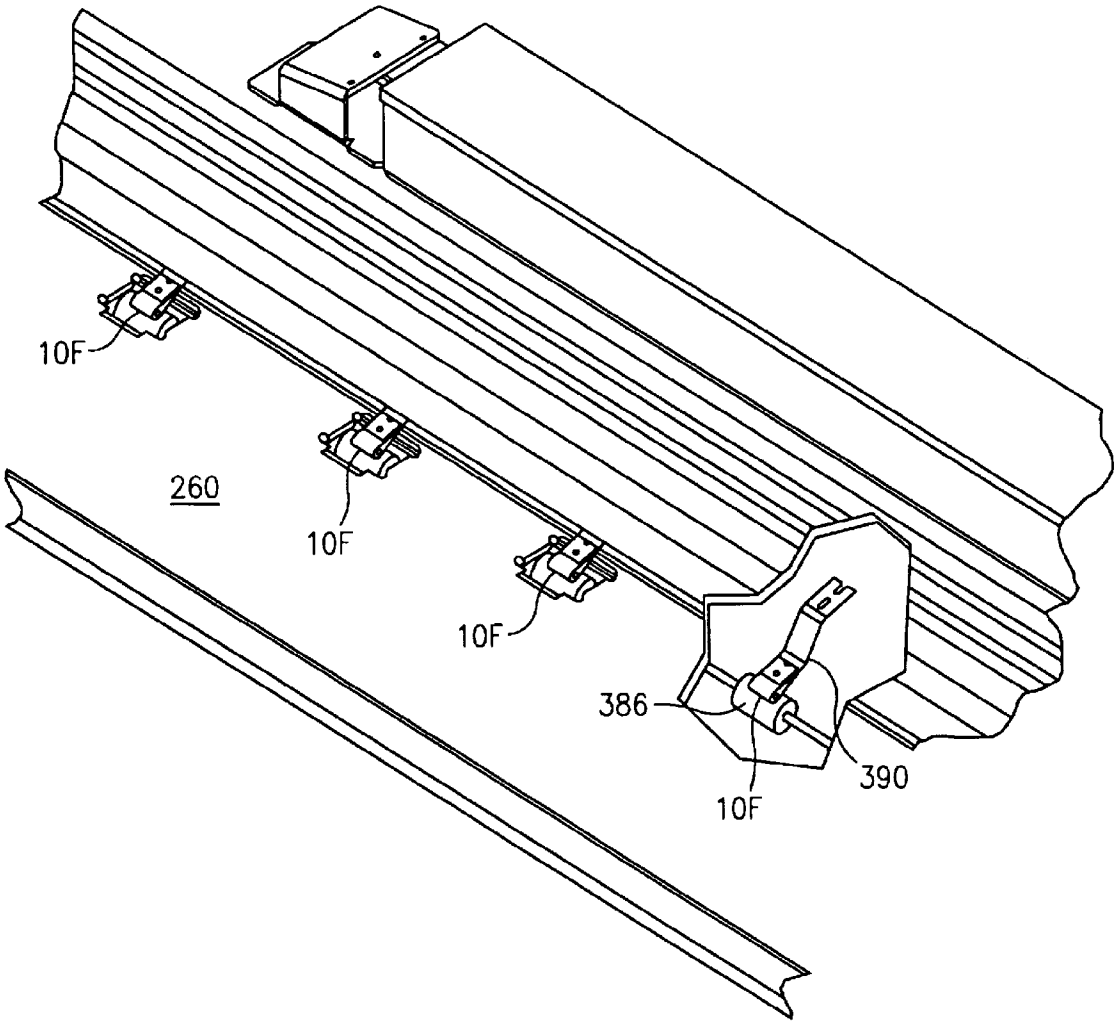
FIG. 32 is a partial cutaway perspective view depicting the drive rollers 386 and mating pinch rollers 390 of the media drive train instant.

Referring to FIGS. 31 and 32, preferred media drive system 38 includes a mechanical drive train including servomotor 381, worm gear 383, spur-gear 384, drive rollers 386 and pinch rollers 390. Servomotor 381 is fixedly engaged to an encoder 382 and a worm gear 383. Worm gear 383 meshes with spur gear 384, which is fixedly engaged to roller shaft 387 via gear-shaft adapter 385. Roller shaft 387 is a hardened steel torque-member fixedly engaged to a plurality of discreet drive rollers 386 in operable communication with a corresponding plurality of pinch rollers 390.

In operation, a given one drive roller 386 and a corresponding pinch roller 390 form a nip-point pair that, together with similar pairs so disposed, operatively capture a print medium 90A supplied from media roll 90 in transitory engagement within print zone 15 of print engine 10. Printing control system 32, in response to control signals directing a printing operation to commence, energizes servomotor 381 to transmit driving force through the media drive train instant thereby to position print medium 90A operatively within print zone 15. Servomotor 381 is preferably a DC servomotor with low motor inertia capable of generating 120 oz-in instantaneous peak torque to overcome the inertial and frictional resistance offered by the several and various drive train components including the servomotor armature, bearings, gears, shafts, roller pairs, media supply spool and mechanical slip-clutch. Driving force is transmitted first to worm gear 383, a right-hand, 32-pitch, dual-threaded gear with a 20-degree pressure angle and total indicated run-out (TIR) of less than 0.001 inch. Worm gear 383 transmits driving force via gear mesh to spur gear 384, an 80-tooth helical sprocket that effects a 40:1 gear reduction. Spur gear 384 provides a matching gear tooth profile, adaptive helix angle, and TIR of 0.001 inch. Hence, one inventive aspect of the present invention is embodied in the optimized gear-mesh interface, which minimizes media positioning error due to backlash through the use of matching quality gears and positioning.

Encoder 382 is fixedly engaged to the servomotor 381 armature shaft and rotates in precise coincidence therewith. Encoder 382 is preferably a rotary optical encoder with a 1000-indicia optical disk and index sensor (not shown) with quadrate read out, thus increasing the position-feedback resolution to 4000 positions-per-revolution (1000 PPR×4–4000 PPR). At a 40:1 gear reduction, servomotor 381 armature (and worm gear 383) rotates 40 times for each rotation of spur gear 384 with a corresponding coincident rotation of encoder 382 optical disk effecting a total read-out of 160,000 counts per revolution of spur gear 384 (4000 PPR×4.0). The circumference of drive roller 386 is approximately 3.2 inches: additionally, drive roller 386 is fixedly engaged to spur gear 384 via roller drive shaft 387 and rotates in precise coincidence therewith. Accordingly, each rotation of spur gear 384 effects a corresponding rotation of drive roller 386 to drive print media 90A a distance of 3.2 inches with an advance accuracy of approximately 0.00002 inches (3.2 /160,000=0.00002). As will be understood by those skilled in the art, no media drive train system of the kind herein described is ideal. Any such system having multiple elements will sponsor various error components that might include, but are not limited to, gear run-out, gear backlash, drive-shaft torsion, differential tension of the media web across the nip-point, and pinch roller deflection at the nip-point, to name a few. Moreover, said error components may be combinant or reductive in actual practice of the art. However, it will be seen that the granularity of the position-feedback system herein described is sufficient to achieve the required media advance accuracy of 0.0001 inch for preferred print engine 10.

The multiple combinant and reductive error components just described, in addition to others less troublesome and apparent, inspired two additional inventive aspects of preferred media drive system 38: 1) The use of an applied back-tension on the supply-side media web, as described elsewhere in this specification. 2) The use of a look-up table identifying the specific periodicity error component for any given print engine 10, thereby providing means to compensate for the various error components in their myriad potential combinations regardless of the error source.

In actual practice of the art, the inventors of media drive system 38 teach the use of an absolute index sensor attached to roller drive shaft 387 to measure the periodicity error thereof This location places the index sensor as close to the media drive train output and the driven member—media roll 90—as practicable. Here the measured error captures all combinant and reductive error components contributed from all drive train components (e.g., motor bearings, reduction gears, shaft bearings, etc.) with the exception of the drive rollers 386 themselves. In a preferred first embodiment, media drive system 38 is operated and measurements are taken of the rotation profile of drive shaft 387 as well as the expected versus actual media advance accuracy. This data is then mapped into a look-up table (not shown) during manufacture of print engine 10 and stored in non-volatile memory in printing control system 32 where it can be automatically recalled during printing operation. Thereafter, printing control system 32 refers to the mapped-error look-up table to calculate the final error contribution from all sources and automatically compensates for positioning inaccuracy in the media advance interval. In a preferred second embodiment, an absolute index sensor (not shown) is operatively attached to roller drive shaft 387 at a preferred location based on an initial set of measurements performed and recorded as described above, wherein the location chosen is determined by the maximum periodicity component measured. In this embodiment, the index sensor is disposed in electrical communication with printing control system 32 and provides on-going sensing of the error component, enabling printing control system 32 to perform adaptive positioning error compensation.

Figure 33:
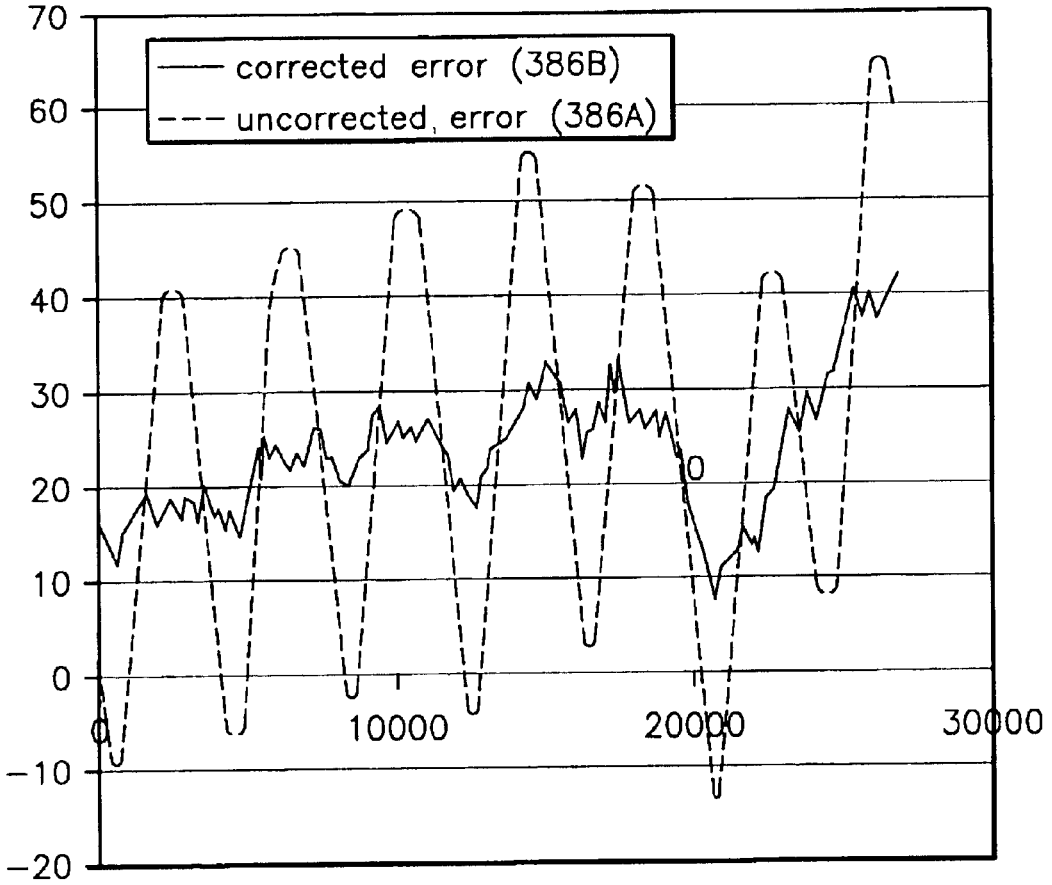
FIG. 33 is a chart depicting a typical periodicity error for a prior art inkjet print engine and the error for the inkjet print engine 10 of the present invention.

FIG. 33 depicts an uncorrected periodicity error, depicted by dashed line 386A, for a conventional media drive system used in a prior art large-format inkjet printer. An uncorrected periodicity error for preferred print engine 10 would have a similar profile. Superimposed on the example uncorrected error line is the corrected periodicity error, depicted by solid line 386B, for preferred media drive system 38 of preferred print engine 10. All values shown in FIG. 33 are in relative units, wherein the same unit of measure is used for both the prior art print engine and preferred print engine 10 and the same absolute index sensor was used to take measurements. As shown, the magnitude of the uncorrected periodicity error contributed by a conventional media drive system as measured from the indicated minima and maxima is about 80.625 relative units. By way of comparison, the magnitude of the corrected periodicity error for print engine 10 as measure from the indicated minima and maxima is about 32.50 relative units, or about a 60% reduction in the error component.

Printing Control System

The preferred embodiment of the printing control system 32 employs an internal PC electronics motherboard and fast microprocessor to handle the high-bandwidth requirements for transfer of image data to the printer. These very high data rates result from the use of 12 inkjet print cartridges 100 with a minimum of 524 jetting nozzles 100K each individually controllable and a firing rate of 18 kHz at 600 dpi print resolution, and 9 kHz at 120 dpi print resolution. Furthermore, the use of extended process ink colors to improve the quality of printed images requires that as many as 12 individual color planes be rendered, since each color plane represents the pixel grid of the entire large-format image. Consequently, the printing control system is designed to be able to handle the large amount of data that is routed timely to the print heads, or pauses in operation will occur while the print head is waiting for image data.

As one measure of the increased demand for data handling essential in implementing the preferred inkjet print cartridge 100, it is known that even the fastest large-format inkjet printers now current in the art use no more than about 30% of the available bandwidth of a 100BaseT fast Ethernet connection. This type of connection would be used, for example, to transmit image data from a rendering device (such as a print server, or raster image processor) over a network such as a LAN to a conventional large format inkjet printer. Using the same connection to transmit image data from the same type of rendering device to a print engine 10 of the present invention requires about 80% of the available bandwidth.

The printing control system 32 of the present invention incorporates two means to handle the data load required. First, combinations of different data compression techniques are employed to condense the image data being transmitted from a rendering device to prefer print engine 10. Second, Cat5 Low Voltage Differential Signal circuits are used to interconnect the inkjet print cartridges 100 with the printhead control board 234. This design both reduces the bandwidth demand for transfer of image data to the print engine 10, as well as reduces the cost of memory and processing power that otherwise would be needed. Additionally, printing control system 32 employs a state-of-the-art motherboard with a 650 MHz microprocessor, 256 Mb of on-board memory, a 100BaseT fast Ethernet connection, and shielded cables between the electronics assemblies and components disposed in the external electronics bay and printhead controller 234 residing on carriage assembly 22.

Although the present invention has been described with reference to discrete embodiments, no such limitation is to be read into the claims as they alone define the metes and bounds of the invention disclosed and taught herein and further enabled in actual practice of the art. One skilled in the art will recognize that certain insubstantial modifications, minor substitutions, and slight alterations of the apparatus and methods described and claimed herein, that nonetheless embody the spirit and essence of the claimed invention without departing from the scope of the following claims.

What is claimed is:

1. A large-format inkjet printer apparatus comprising:

a) a scanning carriage assembly that supports a set of inkjet print cartridges in close proximity to a print media comprising:

i) a rotating penholder assembly comprising a set of print cartridge sockets that electrically and physically interface with said set of inkjet print cartridges in releasable engagement; and ii) height adjuster assemblies disposed at each end of said rotating penholder assembly, wherein each of said height adjuster assemblies comprises a stepper motor that drives an axial screw which is operatively coupled to a transfer block, and said transfer block operatively engages and is guided by transfer shafts to move said rotating penholder assembly to a desired head height position;

b) an off-carriage ink delivery system that provides an ink supply to said inkjet print cartridges from a corresponding set of off-carriage ink reservoirs;

c) an auto-adjusting service station assembly that is visited by said scanning carriage assembly at periodic intervals and that is operatively disposed in said printer proximate to a printing zone;

d) a media handling system for transporting said print media through said printer;

e) a media drive system for transporting and positioning said print media within said print zone; and f) a printer control system for performing print engine control functions and data management and control operations.

2. The apparatus of claim 1, wherein said media has a width of up to 72 inches.

3. The apparatus of claim 1, wherein said media is selected from the group consisting of paper, vinyl, and fabric.

4. The apparatus of claim 1, wherein said media has a thickness of up to 0.25 inches.

5. The apparatus of claim 1, wherein said scanning carriage assembly further comprises an image sensor assembly that provides means to automatically measure and compensate for at least one of print cartridge print-head inaccuracy, jetting nozzle failure, and chromatic variation in printed image quality, and wherein said image sensor assembly comprises an image camera and a color-metric sensor.

6. The apparatus of claim 5, wherein said image camera is a digital camera with an optical quality lens.

7. The apparatus of claim 5, wherein said image camera captures and transmits information about performance test images and color sample charts to said printing control system.

8. The apparatus of claim 5, wherein said color-metric sensor comprises a photodiode.

9. The apparatus of claim 5, wherein said color-metric sensor monitors and corrects for variations in color accuracy and consistency.

10. The apparatus of claim 5, wherein said image sensor characterizes an interaction of a particular set of process ink colors with a particular media.

11. The apparatus of claim 1, wherein said ink delivery system continuously resupplies ink during a printing operation from said off-carriage ink reservoirs to said ink jet print cartridges.

12. The apparatus of claim 11, wherein said ink delivery system includes a gravity-feed, sealed fluid system comprised of said set of inkjet print cartridges connected to off-carriage ink reservoirs by ink supply tubes.

13. The apparatus of claim 12, wherein said ink supply tubes are connected to inkjet print cartridges by coupling a print cartridge fluid connector onto a print cartridge inlet port.

14. The apparatus of claim 13, wherein said ink supply tubes are purged of air and simultaneously filled with ink.

15. The apparatus of claim 12, wherein said ink delivery system is closed to the atmosphere and is filled with a first quantity of ink.

16. The apparatus of claim 15, wherein said ink delivery system further includes a cartridge memory to record data specific to a given one print cartridge.

17. The apparatus of claim 12, wherein said inkjet print cartridges, said ink supply tubes, and said ink reservoirs may be removed and replaced separately.

18. The apparatus of claim 12, wherein said inkjet print cartridges, said ink supply tubes, and said ink reservoirs are replaced as a single unit.

19. The apparatus of claim 11, wherein said set of inkjet print cartridges are installed in said penholder assembly and a corresponding set of said ink reservoirs are installed in an ink tray.

20. The apparatus of claim 19, wherein said ink supply tubes are installed between any ink cartridge and any ink reservoir, said ink supply tubes being devoid of ink and without designation as to color.

21. The apparatus of claim 1, wherein said service station assembly performs wiping and capping service routines in order to clean and maintain a nozzle plate of said inkjet print cartridge.

22. The apparatus of claim 1, wherein said media handling system comprises a media supply assembly, a media sensor assembly, and a media take-up assembly.

23. The apparatus of claim 22, wherein said media supply assembly comprises a supply spool in operable communication with a slip-clutch, said supply spool operatively supporting a print media roll.

24. The apparatus of claim 22, wherein said media sensor assembly comprises a potentiometer, a sensor arm, and a mounting bracket in operable communication with print media supplied from a media roll.

25. The apparatus of claim 22, wherein said media take-up assembly comprises a take-up spool in operable communication with a closed-loop servomotor.

26. The apparatus of claim 25, wherein said closed-loop servomotor drives said take-up spool and estimates the diameter of said take-up spool to control tension, detect faults, and signal failure.

27. The apparatus of claim 25, further comprising a media take-up motor that rotates said take-up spool in continuous operation and removes any slack in the print media.

28. The apparatus of claim 1, wherein said printer control system comprises an internal PC electronics motherboard and microprocessor.

29. The apparatus of claim 1, wherein said printer control system automatically controls said height adjuster assemblies.

30. The apparatus of claim 29, wherein said printer control system calculates an optimal head-height setting based on at least one of a type of print media selected, type of ink selected, and printing speed selected.

31. The apparatus of claim 29, wherein said printer control system stores in internal memory a calculation of head-height position data corresponding to a thickness for later referral by an operator when a similar media is loaded into said inkjet printer apparatus.

32. The apparatus of claim 1, wherein said printer control system transmits head-height position data to an on-carriage print head controller.

33. The apparatus of claim 1, further comprising a media sensor assembly that senses the presence of print media when it is positioned beneath a sensor arm and communicates a thickness value to said printer control system.

34. The apparatus of claim 33, wherein said media sensor assembly comprises a high-resolution sensor for measuring media thickness.

35. An inkjet printer carriage assembly, comprising:

a) a rotatable penholder assembly comprising individual print cartridge sockets that electrically and physically interface with inkjet printer cartridges in releasable engagement;

b) height adjuster assemblies disposed at each end of said penholder assembly, wherein each of said height adjuster assemblies comprises a stepper motor that drives an axial screw which is operatively coupled to a transfer block, and said transfer block operatively engages and is guided by transfer shafts to move said rotating penholder assembly to a desired head height position and wherein head-height adjustment is effected automatically when a new print media is loaded into said print engine; and c) an image-sensor assembly that provides means to automatically measure and compensate for at least one of print cartridge print-head inaccuracy, jetting nozzle failure, and chromatic variation in printed image quality.

36. The apparatus of claim 35, wherein said image sensor assembly comprises an image camera and a color-metric sensor.

37. The apparatus of claim 36, wherein said image camera is a digital camera with an optical quality lens.

38. The apparatus of claim 36, wherein said image camera captures and transmits information about performance test images and color sample charts to a printer control system.

39. The apparatus of claim 36, wherein said color-metric sensor comprises a photodiode.

40. The apparatus of claim 36, wherein said color-metric sensor monitors and corrects for variations in color accuracy and consistency.

41. The apparatus of claim 35, wherein said image sensor characterizes an interaction of a particular set of process ink colors with a particular media.

42. A print engine apparatus comprising:

a. a scanning carriage assembly that supports a set of inkjet print cartridges in close proximity to a print media comprising:

i) a rotating penholder assembly comprising a set of print cartridge sockets that electrically and physically interface with said set of inkjet print cartridges in releasable engagement; and ii) height adjuster assemblies disposed at each end of said rotating penholder assembly, wherein each of said height adjuster assemblies comprises a stepper motor that drives an axial screw which is operatively coupled to a transfer block, and said transfer block operatively engages and is guided by transfer shafts to move said rotating penholder assembly to a desired head height position;

b. an off-carriage ink delivery system that provides an ink supply to said inkjet print cartridges from a corresponding set of off-carriage ink reservoirs;

c. an auto-adjusting service station assembly that is visited by said scanning carriage assembly at periodic intervals and that is operatively disposed in said print engine proximate to a printing zone;

d. a media handling system for transporting said print media through said print engine;

e. a media drive system for transporting and positioning said print media within said print zone; and f. a printer control system for performing print engine control functions and data management and control operations.

43. The apparatus of claim 1, wherein said print engine is a multi-pass printer.

44. The apparatus of claim 42, wherein said print engine is a large-format multi-pass digital color ink printer.

45. The apparatus of claim 42, wherein the minimum print resolution of said printer is 600 dots-per-inch.

46. The apparatus of claim 42, wherein the minimum print resolution of said printer is 1200 dots-per-inch.

47. The apparatus of claim 42, wherein said scanning carriage assembly further comprises an image sensor assembly that provides means to automatically measure and compensate for at least one of print cartridge print-head inaccuracy, jetting nozzle failure, and chromatic variation in printed image quality, and wherein said image sensor assembly comprises an image camera and a color-metric sensor.

48. The apparatus of claim 47, wherein said image sensor assembly captures and transmits information about a series of test images that are printed on a pre-selected print media.

49. The apparatus of claim 48, wherein said pre-selected print media is selected from the group consisting of an unused portion of said print media and a disposable media.

50. The apparatus of claim 42, wherein said carriage assembly is operatively connected to a rail member and said carriage assembly reciprocates along said rail member.

51. The apparatus of claim 50, further comprising an encoder reader assembly to monitor the position of said carriage assembly by sensing indicia of a high-resolution encoder strip mounted to said rail member.

52. The apparatus of claim 51, wherein said encoder reader assembly provides position data for said carriage assembly to a print-head controller.

* * * * *

UNITED STATES PATENT AND TRADEMARK OFFICE

CERTIFICATE OF CORRECTION

PATENT NO. : 6,789,876 B2
DATED : September 14, 2004
INVENTOR(S) : Aaron Barclay et al.

It is certified that error appears in the above-identified patent and that said Letters Patent is hereby corrected as shown below:

Column 20,
Line 32, delete “carnage” and replace it with -- carriage --
Line 33, delete “and idler pulley 316A”

Column 54,
Line 13, delete “claim 1” and replace it with -- claim 42 --

Signed and Sealed this

Fourth Day of January, 2005

JON W. DUDAS
*Director of the United States Patent and Trademark Office*